US010107080B2

(12) United States Patent
Airey et al.

(10) Patent No.: US 10,107,080 B2
(45) Date of Patent: Oct. 23, 2018

(54) DIFFERENTIAL PRESSURE MOVER

(71) Applicant: Schlumberger Technology Corporation, Sugar land, TX (US)

(72) Inventors: Peter Airey, Saint Germain Laval (FR); Alain Nguyen-Thuyet, Paris (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 674 days.

(21) Appl. No.: 14/675,804

(22) Filed: Apr. 1, 2015

(65) Prior Publication Data

US 2015/0285043 A1 Oct. 8, 2015

(30) Foreign Application Priority Data

Apr. 3, 2014 (EP) ..... 14290094

(51) Int. Cl.
*E21B 43/12* (2006.01)
*E21B 49/08* (2006.01)

(52) U.S. Cl.
CPC ..... *E21B 43/129* (2013.01); *E21B 43/128* (2013.01); *E21B 49/081* (2013.01)

(58) Field of Classification Search
CPC ..... E21B 43/128; E21B 43/129; E21B 49/081
See application file for complete search history.

(56) References Cited

U.S. PATENT DOCUMENTS 4,378,850 A 4/1983 Barrington
4,591,320 A * 5/1986 Pope ..... F04B 47/08 417/390
4,796,699 A 1/1989 Upchurch
4,856,595 A 8/1989 Upchurch
4,896,772 A 1/1990 Walter et al.
4,915,168 A 4/1990 Upchurch
5,101,907 A * 4/1992 Schultz ..... E21B 23/04 166/319
5,127,477 A 7/1992 Schultz
5,238,070 A 8/1993 Schultz et al.
5,251,703 A 10/1993 Skinner
6,182,753 B1 2/2001 Schultz
6,253,857 B1 7/2001 Gano
(Continued)

FOREIGN PATENT DOCUMENTS

EP 0999344 A2 5/2000

OTHER PUBLICATIONS

Expanded search report for the equivalent European patent application No. 14290094.3 dated Jul. 29, 2014.
(Continued)

*Primary Examiner* — Matthew R Buck
(74) *Attorney, Agent, or Firm* — Michael Dae

(57) ABSTRACT

A downhole tool for conveyance within a wellbore extending into a subterranean formation. The downhole tool comprises a moveable member comprising a first surface defining a moveable boundary of a first chamber, and a second surface defining a moveable boundary of a second chamber. The downhole tool further comprises hydraulic circuitry selectively operable to establish reciprocating motion of the moveable member by exposing the first chamber to an alternating one of a first pressure and a second pressure that is substantially less than the first pressure.

12 Claims, 26 Drawing Sheets

(56) References Cited

U.S. PATENT DOCUMENTS

| | | | | |
|---|---|---|---|---|
| 7,083,009 | B2 * | 8/2006 | Paluch | E21B 49/081 166/250.17 |
| 7,469,748 | B2 * | 12/2008 | Ocalan | E21B 43/128 166/105 |
| 8,020,624 | B2 * | 9/2011 | Ocalan | E21B 43/128 166/105 |
| 8,196,667 | B2 * | 6/2012 | Ocalan | E21B 43/128 166/105 |
| 2004/0031318 | A1 | 2/2004 | Kurkjian et al. | |
| 2008/0115575 | A1 | 5/2008 | Meek et al. | |
| 2010/0206549 | A1 * | 8/2010 | Dowling | E21B 43/126 166/105 |
| 2010/0209265 | A1 * | 8/2010 | Dowling | F04B 23/08 417/404 |

OTHER PUBLICATIONS

Office Action issued in the related EP Application 142900943, dated Dec. 11, 2017 (6 pages).

* cited by examiner

DIFFERENTIAL PRESSURE MOVER

CROSS REFERENCE TO RELATED APPLICATIONS

This application claims the benefit of priority to European Patent Application 14290094.3, filed on Apr. 3, 2014, the entire content of which is incorporated herein by reference.

BACKGROUND OF THE DISCLOSURE

A pump utilized in a downhole tool may be driven by an electrical motor that is either (1) directly coupled to a piston via a linear transmission system such that rotation results in linear motion, or (2) coupled to a hydraulic pump, thus creating a high pressure line, such that routing the high pressure line and the hydraulic reservoir line in the proper chambers of a secondary piston system results in the linear motion. The result is either a pump mechanism or, more generally, a mechanical stroking device. However, such systems may be limited with regard to electrical power supply and/or other factors, some of which may be related to their implementation in small diameter tools and their operation at high temperature. There are also hydrostatic powered mechanisms, but they are generally designed for a single actuation. As a result, such as in water or air cushion sampling, an air chamber is utilized instead of the formation pressure to activate a piston and withdraw fluid from the formation. Once the sample chamber is full, however, further movement of the piston may be limited, if not impossible.

SUMMARY OF THE DISCLOSURE

The present disclosure introduces an apparatus comprising a downhole tool for conveyance within a wellbore extending into a subterranean formation. The downhole tool comprises a moveable member comprising a first surface, defining a moveable boundary of a first chamber, and a second surface, defining a moveable boundary of a second chamber. The downhole tool further comprises hydraulic circuitry selectively operable to establish reciprocating motion of the moveable member by exposing the first chamber to an alternating one of a first pressure and a second pressure that is substantially less than the first pressure.

The present disclosure also introduces a method comprising conveying a downhole tool within a wellbore extending into a subterranean formation, wherein the downhole tool comprises a moveable member, a first chamber comprising fluid at a first pressure, and a second chamber comprising fluid at a second pressure that is substantially less than the first pressure. The method further comprises reciprocating the moveable member by selectively exposing the moveable member to an alternating one of the first and second pressures.

The present disclosure also introduces a method comprising conveying a downhole tool within a wellbore extending into a subterranean formation, wherein the downhole tool comprises a high-pressure chamber, a low-pressure chamber, a first working chamber, and a second working chamber. The method further comprises pumping fluid from the subterranean formation by operating the downhole tool to alternatingly: expose the first working chamber to the high-pressure chamber while exposing the second working chamber to the low-pressure chamber; and expose the first working chamber to the low-pressure chamber while exposing the second working chamber to the high-pressure chamber.

The present disclosure also introduces a method comprising conveying a downhole tool within a wellbore extending into a subterranean formation, wherein the downhole tool comprises a high-pressure chamber, a low-pressure chamber, a working chamber, a pumping chamber, an intake conduit, and an exhaust conduit. The method further comprises pumping subterranean formation fluid from the intake conduit to the exhaust conduit via the pumping chamber by operating the downhole tool to alternatingly: expose the pumping chamber to the intake conduit while exposing the working chamber to the low-pressure chamber; and expose the pumping chamber to the exhaust conduit while exposing the working chamber to the high-pressure chamber.

The present disclosure also introduces an apparatus comprising a downhole tool for conveyance within a wellbore extending into a subterranean formation. The downhole tool comprises at least one working chamber, at least one pumping chamber, intake and exhaust conduits each in selective fluid communication with the at least one pumping chamber, and hydraulic circuitry operable to pump subterranean formation fluid from the intake conduit to the exhaust conduit via the at least one pumping chamber by alternatingly exposing the at least one working chamber to different first and second pressures.

The present disclosure also introduces an apparatus comprising a downhole tool for conveyance within a wellbore extending into a subterranean formation. The downhole tool comprises a moveable member comprising: a first surface defining a moveable boundary of a first chamber; and a second surface defining a moveable boundary of a second chamber. The downhole tool further comprises a motion member driven by the moveable member and having at least a portion positioned outside the first and second chambers, as well as hydraulic circuitry operable to establish reciprocation of the motion member by alternatingly exposing the first chamber to different first and second pressures.

The present disclosure also introduces a method comprising conveying a downhole tool within a wellbore extending into a subterranean formation, wherein the downhole tool comprises a first chamber, a second chamber, a moveable member, and a motion member, wherein: a first surface of the moveable member defines a moveable boundary of the first chamber; a second surface of the moveable member defines a moveable boundary of the second chamber; and at least a portion of the motion member is positioned outside the first and second chambers. The method further comprises reciprocating the motion member by alternatingly exposing the first chamber to different first and second pressures.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
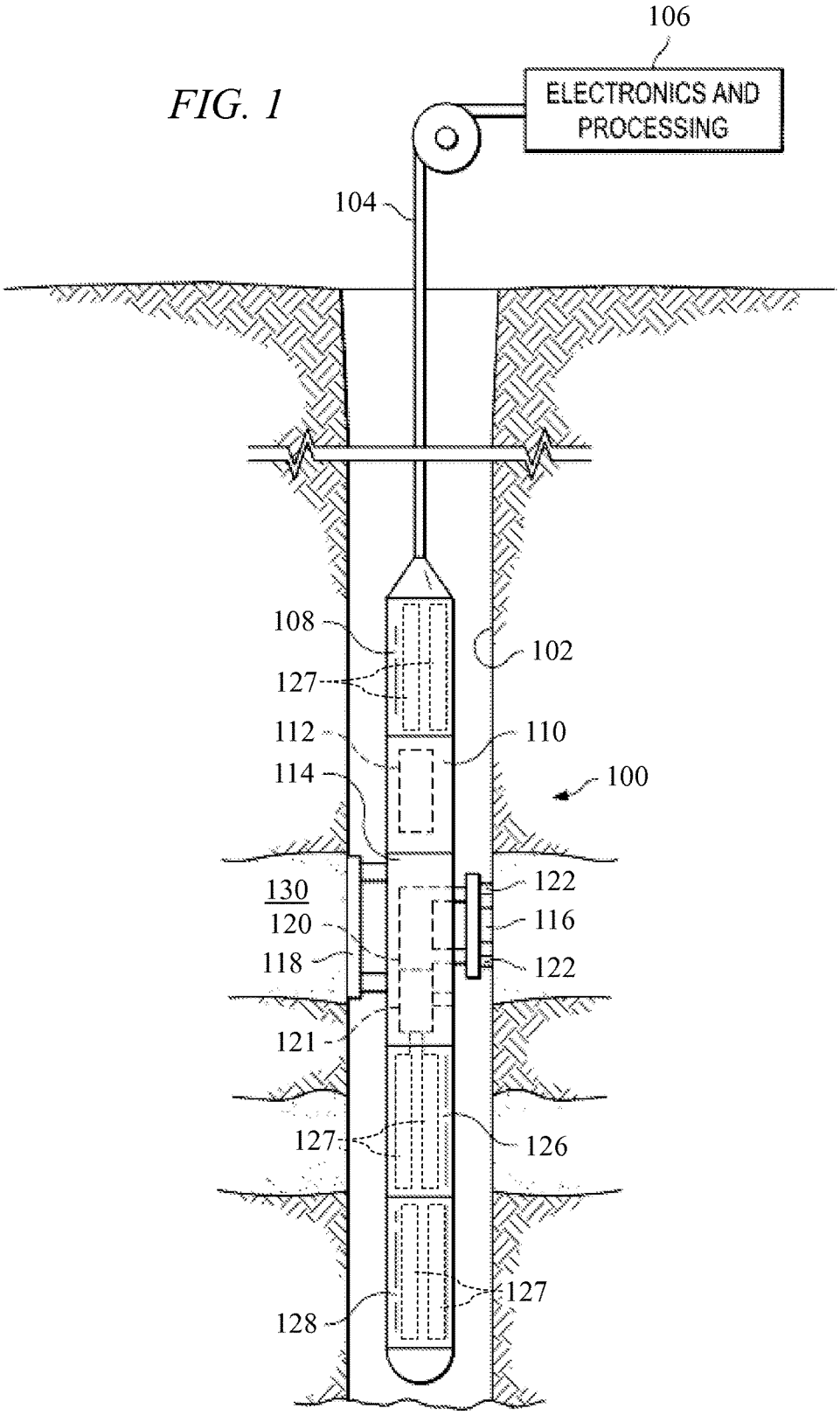
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of an example well site system to which one or more aspects of the present disclosure may be applicable. The well site, which may be situated onshore or offshore, comprises a downhole tool 100 configured to engage a portion of a sidewall of a borehole 102 penetrating a subterranean formation 130.

The downhole tool 100 may be suspended in the borehole 102 from a lower end of a multi-conductor cable 104 that may be spooled on a winch (not shown) at the Earth's surface. At the surface, the cable 104 may be communicatively coupled to an electronics and processing system 106. The electronics and processing system 106 may include a controller having an interface configured to receive commands from a surface operator. In some cases, the electronics and processing system 106 may further comprise a processor configured to implement one or more aspects of the methods described herein.

The downhole tool 100 may comprise a telemetry module 110, a formation test module 114, and a sample module 126. Although the telemetry module 110 is shown as being implemented separate from the formation test module 114, the telemetry module 110 may be implemented in the formation test module 114. The downhole tool 100 may also comprise additional components at various locations, such as a module 108 above the telemetry module 110 and/or a module 128 below the sample module 126, which may have varying functionality within the scope of the present disclosure.

The formation test module 114 may comprise a selectively extendable probe assembly 116 and a selectively extendable anchoring member 118 that are respectively arranged on opposing sides. The probe assembly 116 may be configured to selectively seal off or isolate selected portions of the sidewall of the borehole 102. For example, the probe assembly 116 may comprise a sealing pad that may be urged against the sidewall of the borehole 102 in a sealing manner to prevent movement of fluid into or out of the formation 130 other than through the probe assembly 116. The probe assembly 116 may thus be configured to fluidly couple a pump 121 and/or other components of the formation tester 114 to the adjacent formation 130. Accordingly, the formation tester 114 may be utilized to obtain fluid samples from the formation 130 by extracting fluid from the formation 130 using the pump 121. A fluid sample may thereafter be expelled through a port (not shown) into the borehole 102, or the sample may be directed to one or more detachable chambers 127 disposed in the sample module 126. In turn, the detachable fluid collecting chambers 127 may receive and retain the formation fluid for subsequent testing at surface or a testing facility. The detachable sample chambers 127 may be certified for highway and/or other transportation. The module 108 and/or the module 128 may comprise additional sample chambers 127, which may also be detachable and/or certified for highway and/or other transportation.

The formation tester 114 may also be utilized to inject fluid into the formation 130 by, for example, pumping the fluid from one or more fluid collecting chambers disposed in the sample module 126 via the pump 121. Moreover, while the downhole tool 100 is depicted as comprising one pump 121, it may also comprise multiple pumps. The pump 121 and/or other pumps of the downhole tool 100 may also comprise a reversible pump configured to pump in two directions (e.g., into and out of the formation 130, into and out of the collecting chamber(s) of the sample module 126, etc.). Example implementations of the pump 121 are described below.

The probe assembly 116 may comprise one or more sensors 122 adjacent a port of the probe assembly 116, among other possible locations. The sensors 122 may be configured to determine petrophysical parameters of a portion of the formation 130 proximate the probe assembly 116. For example, the sensors 122 may be configured to measure or detect one or more of pressure, temperature, composition, electric resistivity, dielectric constant, magnetic resonance relaxation time, nuclear radiation, and/or combinations thereof, although other types of sensors are also within the scope of the present disclosure.

The formation tester 114 may also comprise a fluid sensing unit 120 through which obtained fluid samples may flow, such as to measure properties and/or composition data of the sampled fluid. For example, the fluid sensing unit 120 may comprise one or more of a spectrometer, a fluorescence sensor, an optical fluid analyzer, a density and/or viscosity sensor, and/or a pressure and/or temperature sensor, among others.

The telemetry module 110 may comprise a downhole control system 112 communicatively coupled to the electronics and processing system 106. The electronics and processing system 106 and/or the downhole control system 112 may be configured to control the probe assembly 116 and/or the extraction of fluid samples from the formation 130, such as via the pumping rate of pump 121. The electronics and processing system 106 and/or the downhole control system 112 may be further configured to analyze and/or process data obtained from sensors disposed in the fluid sensing unit 120 and/or the sensors 122, store measurements or processed data, and/or communicate measurements or processed data to surface or another component for subsequent analysis.

One or more of the modules of the downhole tool 100 depicted in FIG. 1 may be substantially similar to and/or otherwise have one or more aspects in common with corresponding modules and/or components shown in other figures and/or discussed herein. For example, one or more aspects of the formation test module 114 and/or the sample module 126 may be substantially similar to one or more aspects of the fluid communication module 234 and/or the sample module 236, respectively, which are described below in reference to FIG. 2.

Figure 2:
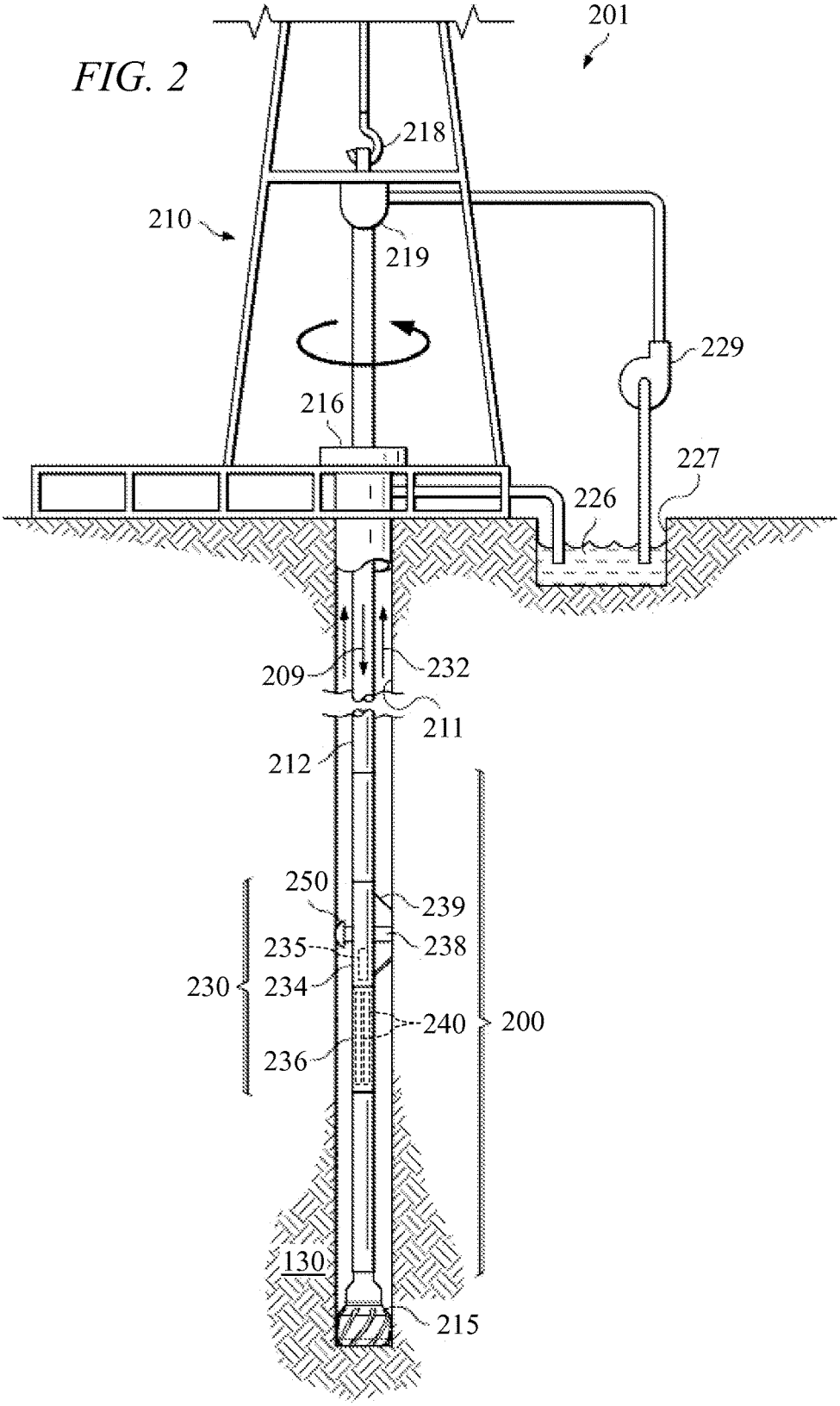
FIG. 2 is a schematic view of at least a portion of apparatus according to one or more aspects of the present disclosure.

FIG. 2 is a schematic view of at least a portion of apparatus according to one or more aspects of the present disclosure. Depicted components include a wellsite 201, a rig 210, and a downhole tool 200 suspended from the rig 210 and into a wellbore 211 via a drill string 212. The downhole tool 200, or a bottom hole assembly ("BHA") comprising the downhole tool 200, comprises or is coupled to a drill bit 215 at its lower end that is used to advance the downhole tool into the formation and form the wellbore. The drillstring 212 may be rotated by a rotary table 216 that engages a kelly at the upper end of the drillstring. The drillstring 212 is suspended from a hook 218, attached to a traveling block (not shown), through the kelly and a rotary swivel 219 that permits rotation of the drillstring relative to the hook.

The rig 210 is depicted as a land-based platform and derrick assembly utilized to form the wellbore 211 by rotary drilling in a manner that is well known. A person having ordinary skill in the art will appreciate, however, that one or more aspects of the present disclosure may also find application in other downhole applications, such as rotary drilling, and is not limited to land-based rigs.

Drilling fluid or mud 226 is stored in a pit 227 formed at the well site. A pump 229 delivers drilling fluid 226 to the interior of the drillstring 212 via a port in the swivel 219, inducing the drilling fluid to flow downward through the drillstring 212, as indicated in FIG. 2 by directional arrow 209. The drilling fluid 226 exits the drillstring 212 via ports in the drill bit 215, and then circulates upward through the annulus defined between the outside of the drillstring 212 and the wall of the wellbore 211, as indicated by direction arrows 232. In this manner, the drilling fluid 226 lubricates the drill bit 215 and carries formation cuttings up to the surface as it is returned to the pit 227 for recirculation.

The downhole tool 200, which may be part of or otherwise referred to as a BHA, may be positioned near the drill bit 215 (e.g., within several drill collar lengths from the drill bit 215). The downhole tool 200 comprises various components with various capabilities, such as measuring, processing, and storing information. A telemetry device (not shown) is also provided for communicating with a surface unit (not shown).

The downhole tool 200 also comprises a sampling while drilling ("SWD") system 230 comprising the fluid communication module 234 and sample module 236 described above, which may be individually or collectively housed in one or more drill collars for performing various formation evaluation and/or sampling functions. The fluid communication module 234 may be positioned adjacent the sample module 236, and may comprise one or more pumps 235, gauges, sensor, monitors and/or other devices that may also be utilized for downhole sampling and/or testing. The downhole tool 200 shown in FIG. 2 is depicted as having a modular construction with specific components in certain modules. However, the downhole tool 200 may be unitary or select portions thereof may be modular. The modules and/or the components therein may be positioned in a variety of configurations throughout the downhole tool 200.

The fluid communication module 234 comprises a fluid communication device 238 that may be positioned in a stabilizer blade or rib 239. The fluid communication device 238 may be or comprise one or more probes, inlets, and/or other means for receiving sampled fluid from the formation 130 and/or the wellbore 211. The fluid communication device 238 also comprises a flowline (not shown) extending into the downhole tool 200 for passing fluids therethrough. The fluid communication device 238 may be movable between extended and retracted positions for selectively engaging a wall of the wellbore 211 and acquiring one or more fluid samples from the formation 130. The fluid communication module 210 may also comprise a back-up piston 250 operable to assist in positioning the fluid communication device 227 against the wall of the wellbore 211.

The sample module 236 comprises one or more sample chambers 240. The sample chambers 240 may be detachable from the sample module 236 at surface, and may be certified for subsequent highway and/or other transportation.

Figure 3:
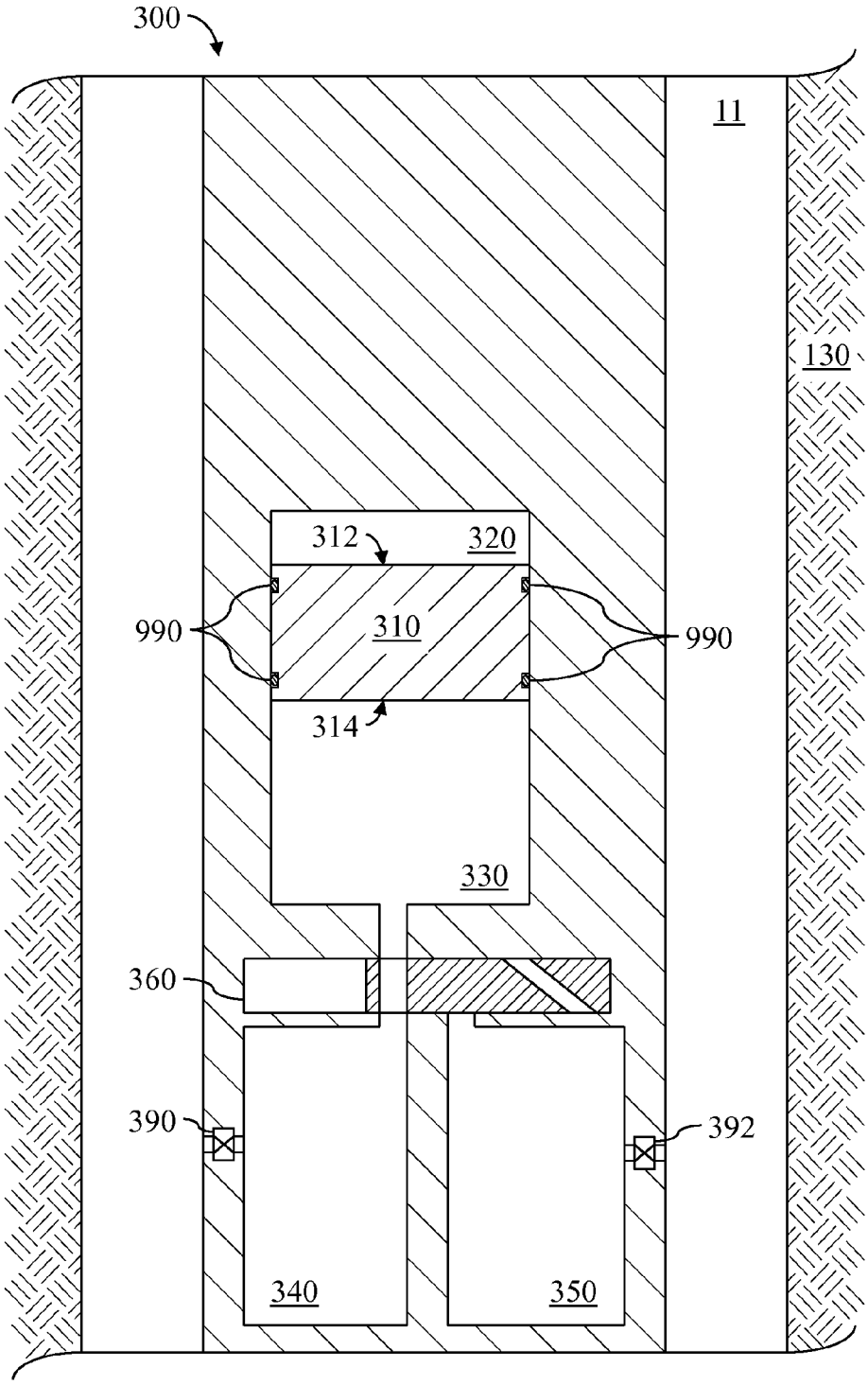
FIG. 3 is a schematic view of at least a portion of apparatus according to one or more aspects of the present disclosure.

FIG. 3 is a schematic view of at least a portion of apparatus comprising a downhole tool 300 according to one or more aspects of the present disclosure. The downhole tool 300 may be utilized in the implementation shown in FIG. 1 and/or FIG. 2. For example, the downhole tool 300 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2.

The downhole tool 300 comprises a piston 310, which may also be referred to herein as a moveable member. The piston 310 comprises a first surface 312 defining a moveable boundary that partially defines a first chamber 320. A second surface 314 of the piston 310 defines a moveable boundary that partially defines a second chamber 330. The second chamber 330 is in fluid communication with a selective one of a high-pressure chamber 340 and a low-pressure chamber 350.

For example, when in a first position (shown in FIG. 3), a valve 360 may fluidly couple the second chamber 330 to the high-pressure chamber 340, and when in a second position (shown in FIG. 4), the valve 360 may fluidly couple the second chamber 330 to the low-pressure chamber 350. The valve 360 may be or comprise various numbers and/or configurations of valves and/or other hydraulic circuitry, and/or may include one or more two-position valves, three-position valves, check valves, piloted valves, and/or other types of valves and/or other hydraulic circuitry fluidly coupling the second chamber 330 to a selective one of the high- and low-pressure chambers 340 and 350.

One or more of the first chamber 320, the high-pressure chamber 340, and the low-pressure chamber 350 may comprise nitrogen, argon, air, hydraulic fluid (e.g., hydraulic oil), and/or another gaseous or liquid fluid. The first chamber 320 may initially have an internal pressure that is substantially atmospheric and/or otherwise less than the initial pressure of the high-pressure chamber 340, and that may be greater than the initial pressure of the low-pressure chamber 350. The low-pressure chamber 350 may initially be substantially void of fluid, or may otherwise have an initial pressure that is substantially less than atmospheric pressure.

Figure 4:
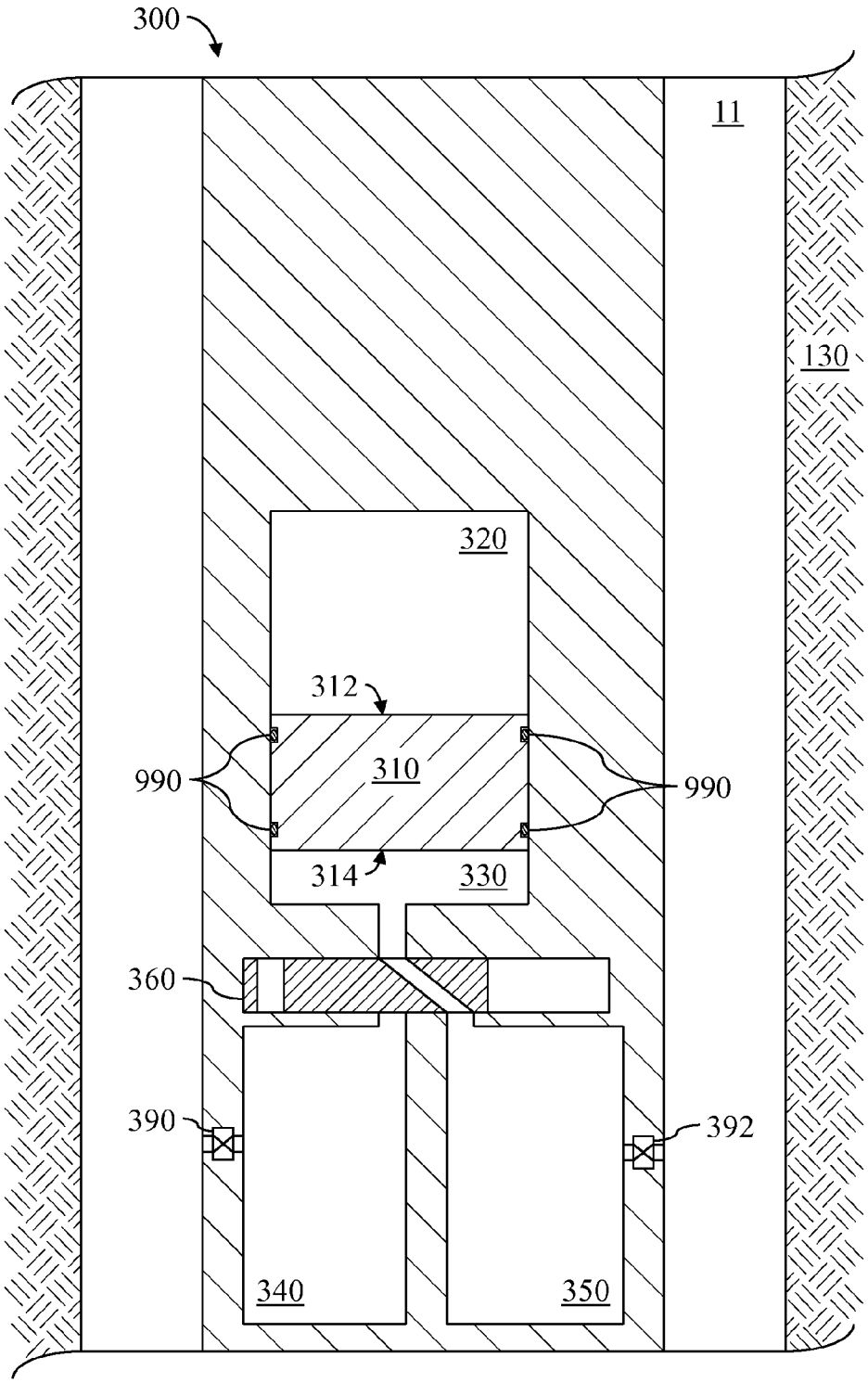
FIG. 4 is a schematic view of at least a portion of apparatus according to one or more aspects of the present disclosure.

In operation, the second chamber 330 may initially be in fluid communication with the low-pressure chamber 350, and the piston 310 may be initially positioned such that the first chamber 320 is substantially larger than the second chamber 330, as shown in FIG. 4. The valve 360 and/or other hydraulic circuitry may then be operated to place the second chamber 330 in fluid communication with the high-pressure chamber 340, as shown in FIG. 3. As a result, the pressure in the second chamber 330 becomes greater than the pressure in the first chamber 320, causing the piston 310 to move, and thereby increasing the volume of the second chamber 330 while decreasing the volume of the first chamber 320.

Thereafter, the valve 360 and/or other hydraulic circuitry may be operated to once again place the second chamber 330 in fluid communication with the low-pressure chamber 350, as shown in FIG. 4. As a result, the pressure in the second chamber 330 becomes less than the pressure in the first chamber 320, causing the piston 310 to move, and thereby decreasing the volume of the second chamber 330 while increasing the volume of the first chamber 320.

This alternating process may be repeated as desired, with each iteration transferring a portion of the contents of the high-pressure chamber 340 to the low-pressure chamber 350. Thus, after a finite number of strokes of the piston 310, the pressures in the high- and low-pressure chambers 340 and 350 and the second chamber 330 (and perhaps the first chamber 320) will equalize. Consequently, the downhole tool 300 may not be able to operate for a prolonged period of time without recharging the high-pressure chamber 340 and at least partially evacuating the low-pressure chamber 350, which may be performed downhole or at surface.

Recharging the high-pressure chamber 340 may comprise injecting or causing the injection of a pressurized fluid, such as nitrogen, argon, air, hydraulic fluid (e.g., hydraulic oil), and/or another gaseous or liquid fluid. If performed at surface, such injection may be via an externally accessible port 390 that may be in selective fluid communication with the high-pressure chamber 340, and/or a similar port 392 that may be in selective fluid communication with the low-pressure chamber 350 (e.g., in conjunction with operation of the valve 360 and the second chamber 330. Evacuating or otherwise resetting the low-pressure chamber 350 may similarly be performed via the port 392. However, other or additional means for resetting the downhole tool 300 at surface and/or downhole are also within the scope of the present disclosure. Thus, while the downhole tools depicted in FIG. 3 and other figures of the present disclosure are shown as including one or both of the ports 390 and 392, a person having ordinary skill in the art will readily recognize that such ports are provided merely as an example of myriad means for externally accessing, filling, and/or evacuating various downhole tool chambers within the scope of the present disclosure.

Figure 5:
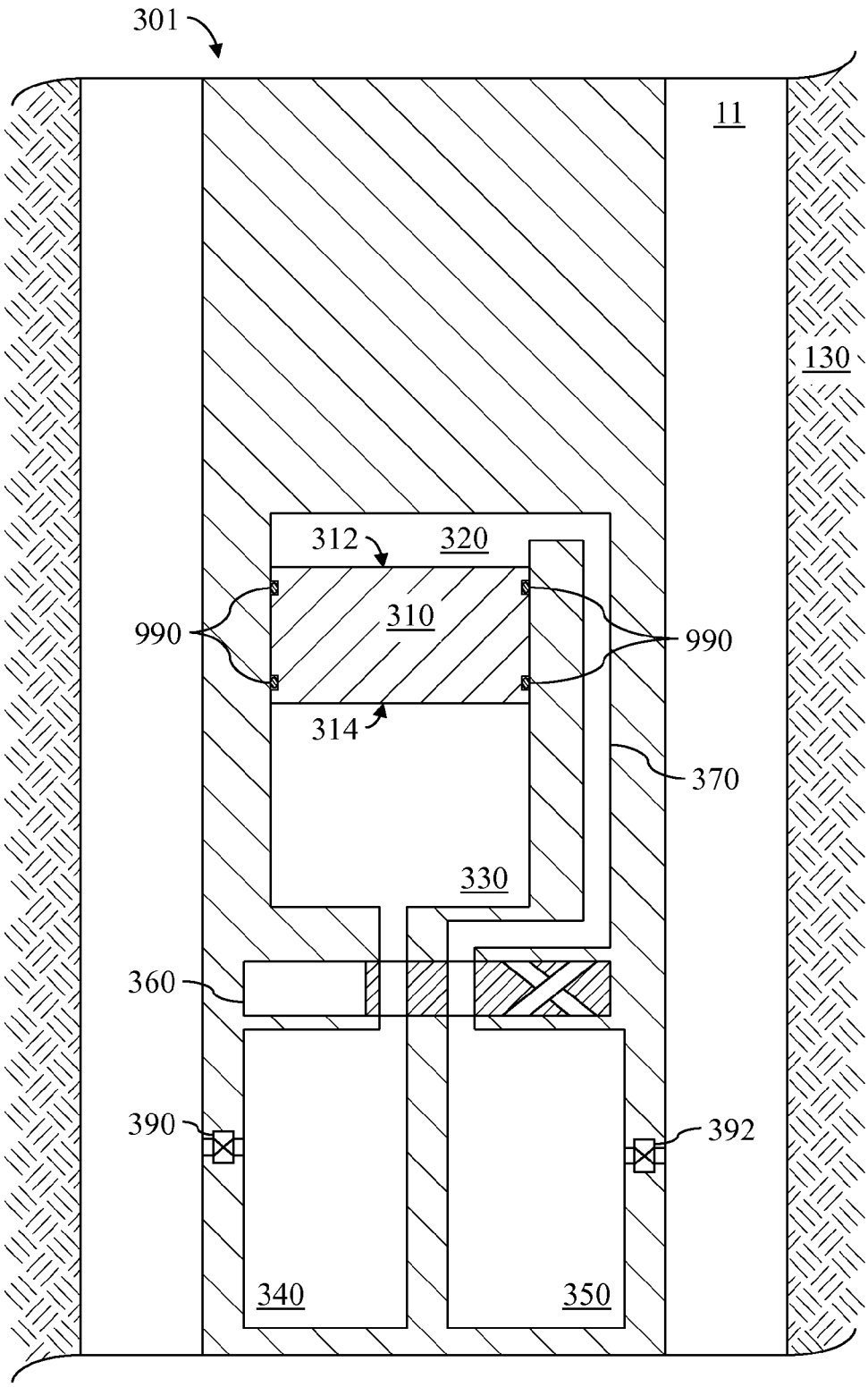
FIG. 5 is a schematic view of at least a portion of apparatus according to one or more aspects of the present disclosure.
Figure 6:
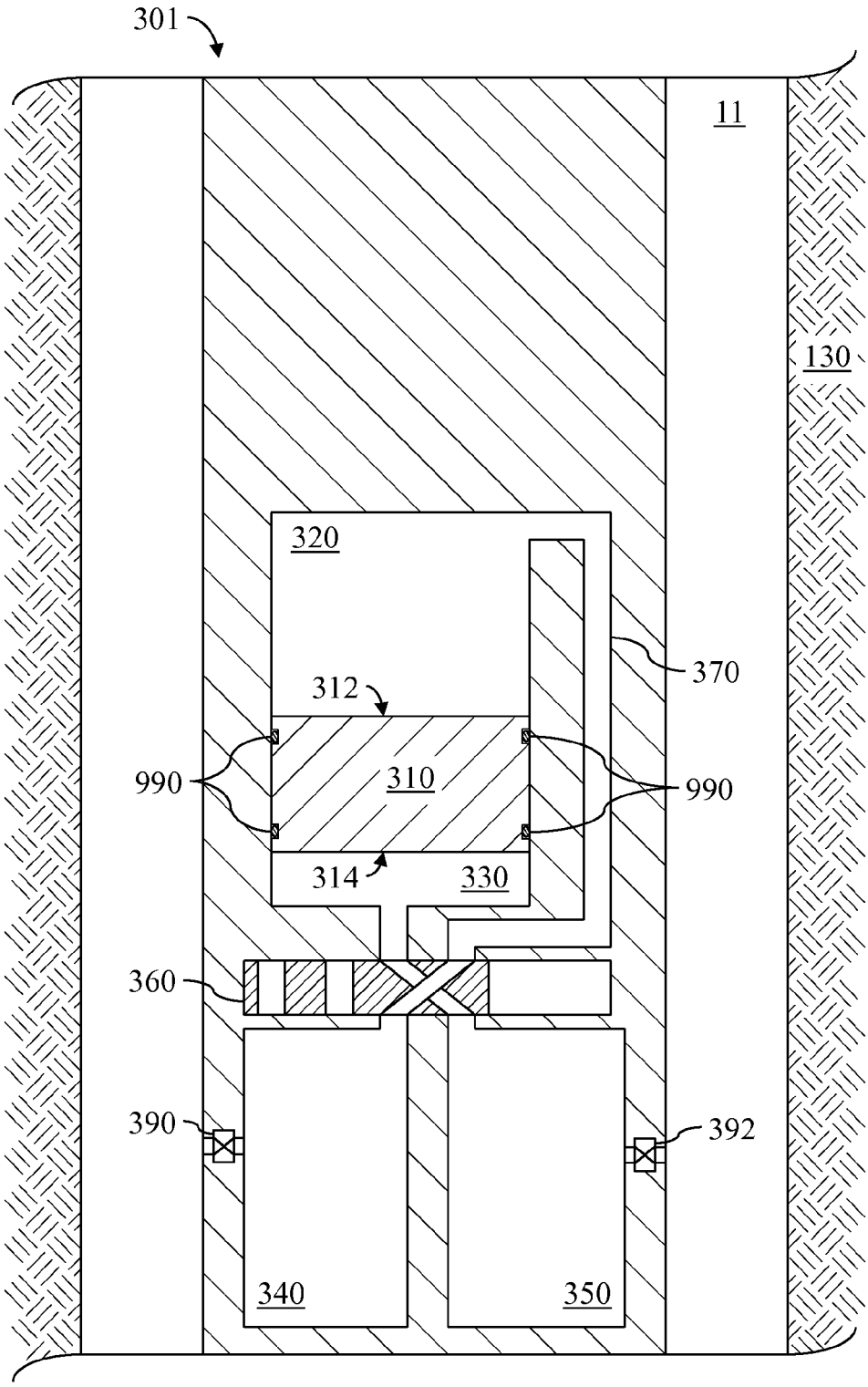
FIG. 6 is a schematic view of at least a portion of apparatus according to one or more aspects of the present disclosure.

FIGS. 5 and 6 are schematic views of at least a portion of apparatus comprising a downhole tool 301 according to one or more aspects of the present disclosure. The downhole tool 301 may be utilized in the implementation shown in FIG. 1 and/or FIG. 2. For example, the downhole tool 301 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2.

The downhole tool 301 may also have one or more aspects in common with, or be substantially similar or identical to, the downhole tool 300 shown in FIGS. 3 and 4, including where indicated by like reference numbers. However, as shown in FIGS. 5 and 6, the first chamber 320 may also be alternatingly placed in fluid communication with the high- and low-pressure chambers 340 and 350 via one or more flowlines 370 extending between the first chamber 320 and the valve 360. Thus, for example, when the valve 360 is in the first position (as shown in FIG. 5), the first chamber 320 may be in fluid communication with the low-pressure chamber 350, and the second chamber 330 may be in fluid communication with the high-pressure chamber 340. When the valve is in the second position (as shown in FIG. 6), the first chamber 320 may be in fluid communication with the high-pressure chamber 340, and the second chamber 330 may be in fluid communication with the low-pressure chamber 350.

In operation, the first chamber 320 may initially be in fluid communication with the high-pressure chamber 340 (via the flowline 370 and the valve 360), the second chamber 330 may initially be in fluid communication with the low-pressure chamber 350 (via the valve 360), and the piston 310 may be initially positioned such that the first chamber 320 is substantially larger than the second chamber 330, as shown in FIG. 6. The valve 360 and/or other hydraulic circuitry may then be operated to place the second chamber 330 in fluid communication with the high-pressure chamber 340, and to place the first chamber 320 in fluid communication with the low-pressure chamber 350, as shown in FIG. 5. As a result, the pressure in the second chamber 330 becomes greater than the pressure in the first chamber 320, causing the piston 310 to move, and thereby increasing the volume of the second chamber 330 while decreasing the volume of the first chamber 320.

Thereafter, the valve 360 and/or other hydraulic circuitry may be operated to once again place the second chamber 330 in fluid communication with the low-pressure chamber 350, as shown in FIG. 6. As a result, the pressure in the second chamber 330 becomes less than the pressure in the first chamber 320, causing the piston 310 to move, and thereby decreasing the volume of the second chamber 330 while increasing the volume of the first chamber 320.

This alternating process may be repeated as desired. As described above, a portion of the contents of the high-pressure chamber 340 is transferred to the low-pressure chamber 350 with each iteration. Thus, after a finite number of strokes of the piston 310, the pressures in the high- and low-pressure chambers 340 and 350 and the first and second chambers 320 and 330 will equalize. Consequently, the downhole tool 301 may not be operable for a prolonged period of time without recharging the high-pressure chamber 340 and/or at least partially evacuating the low-pressure chamber 350, such as via the externally accessible ports 390 and/or 392 if this is performed at surface.

Figure 7:
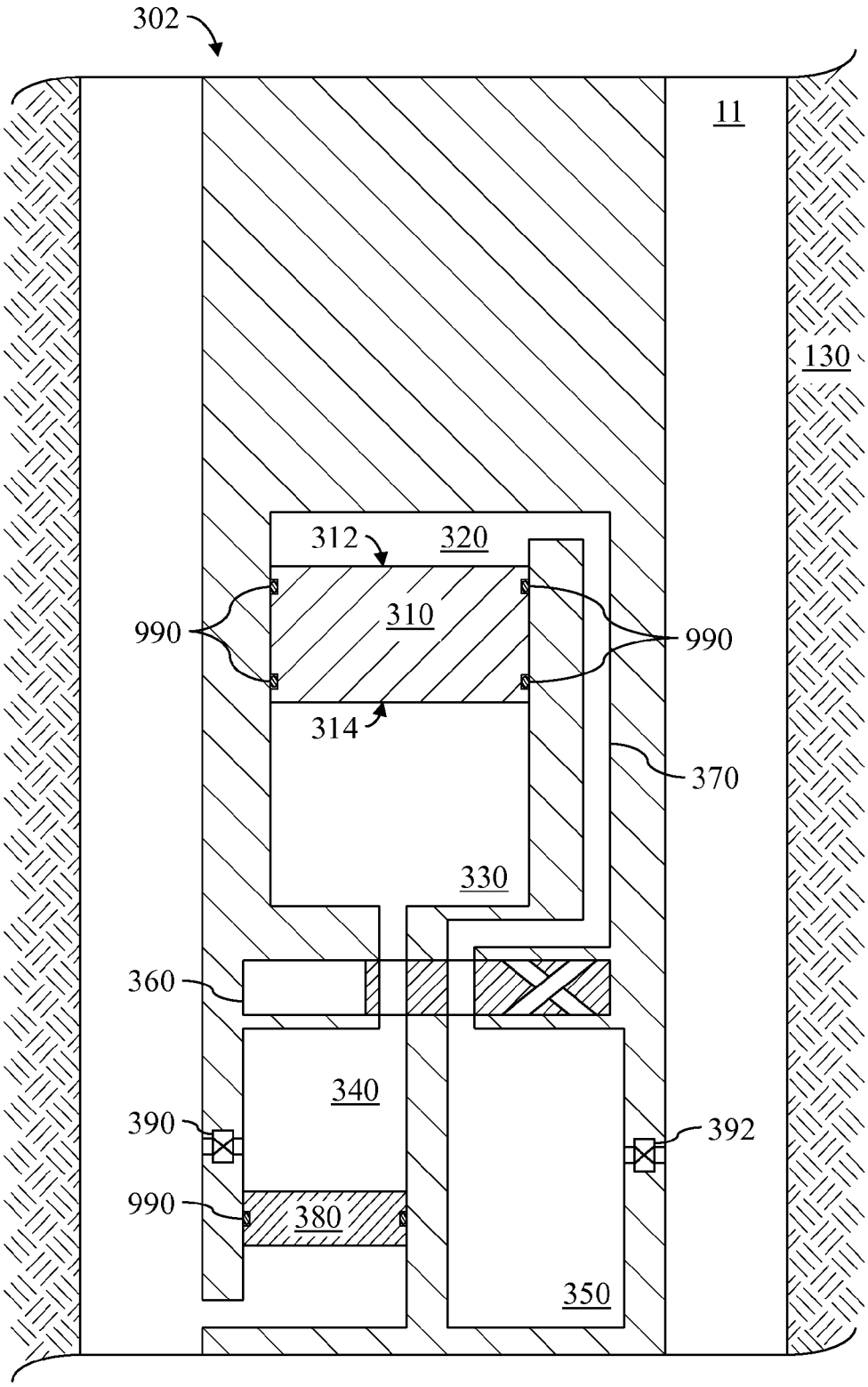
FIG. 7 is a schematic view of at least a portion of apparatus according to one or more aspects of the present disclosure.

FIG. 7 is a schematic view of at least a portion of apparatus comprising a downhole tool 302 according to one or more aspects of the present disclosure. The downhole tool 302 may be utilized in the implementation shown in FIG. 1 and/or FIG. 2. For example, the downhole tool 302 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2.

The downhole tool 302 may also have one or more aspects in common with, or substantially similar or identical to, the downhole tool 300 shown in FIGS. 3 and 4 and/or the downhole tool 301 shown in FIGS. 5 and 6, including where indicated by like reference numbers. However, as shown in FIG. 7, the high-pressure chamber 340 may have a moveable boundary defined by a first surface 382 of a piston 380. A second surface 384 of the piston 380 may be in fluid communication with the wellbore 11, such that fluid within the high-pressure chamber 340 substantially remains the same as the wellbore pressure. FIG. 7 demonstrates that the high-pressure source may be the hydrostatic wellbore pressure and/or other external ambient pressure, and that a compliant barrier (the piston 380) may communicate such high pressure to reciprocate the piston 310 as described above, and without the wellbore and/or other ambient fluid contaminating the fluid in the first, second, high-pressure, and low-pressure chambers 320, 330, 340, and 350.

Operation of the downhole tool 302 is substantially similar to operation of the downhole tool 301 described above. However, the pressure within the high-pressure chamber 340 remains substantially similar to the wellbore pressure. As a result, sufficient fluid is ultimately transferred from the high-pressure chamber 340 to the low-pressure chamber 350 such that the pressure in the second chamber 330 can no longer overcome the wellbore pressure, the piston 380 can no longer be moved to enlarge (or perhaps even create) the high-pressure chamber 340, and the piston 310 can no longer reciprocate. The downhole tool 302 may then be operated downhole and/or removed from the wellbore 11, whereby the high-pressure chamber 340 may be recharged, and the first chamber 320 and/or the low-pressure chamber 350 may be at least partially evacuated, such as via the externally accessible ports 390 and/or 392 if performed at surface.

The differential pressure mover embodied by the downhole tools 300, 301, and 302 described above and shown in FIGS. 3-7 may be considered as constituting a reciprocating engine. However, in the implementations and figures described above, the engine is not explicitly depicted as driving another component, mechanism, actuator, etc. Nonetheless, a person having ordinary skill in the art will readily recognize that a rod, shaft, gear, lever, member, and/or other mechanical, electrical, magnetic, electromagnetic, or other coupling may allow the engine to drive a downhole pump, tractor, motor, actuator, and/or other apparatus that may operate in conjunction with some manner of motive force. To that end, while the following disclosure introduces a number of example implementations, a person having ordinary skill in the art will also readily recognize that many other implementations exist within the scope of the present disclosure.

Figure 8:
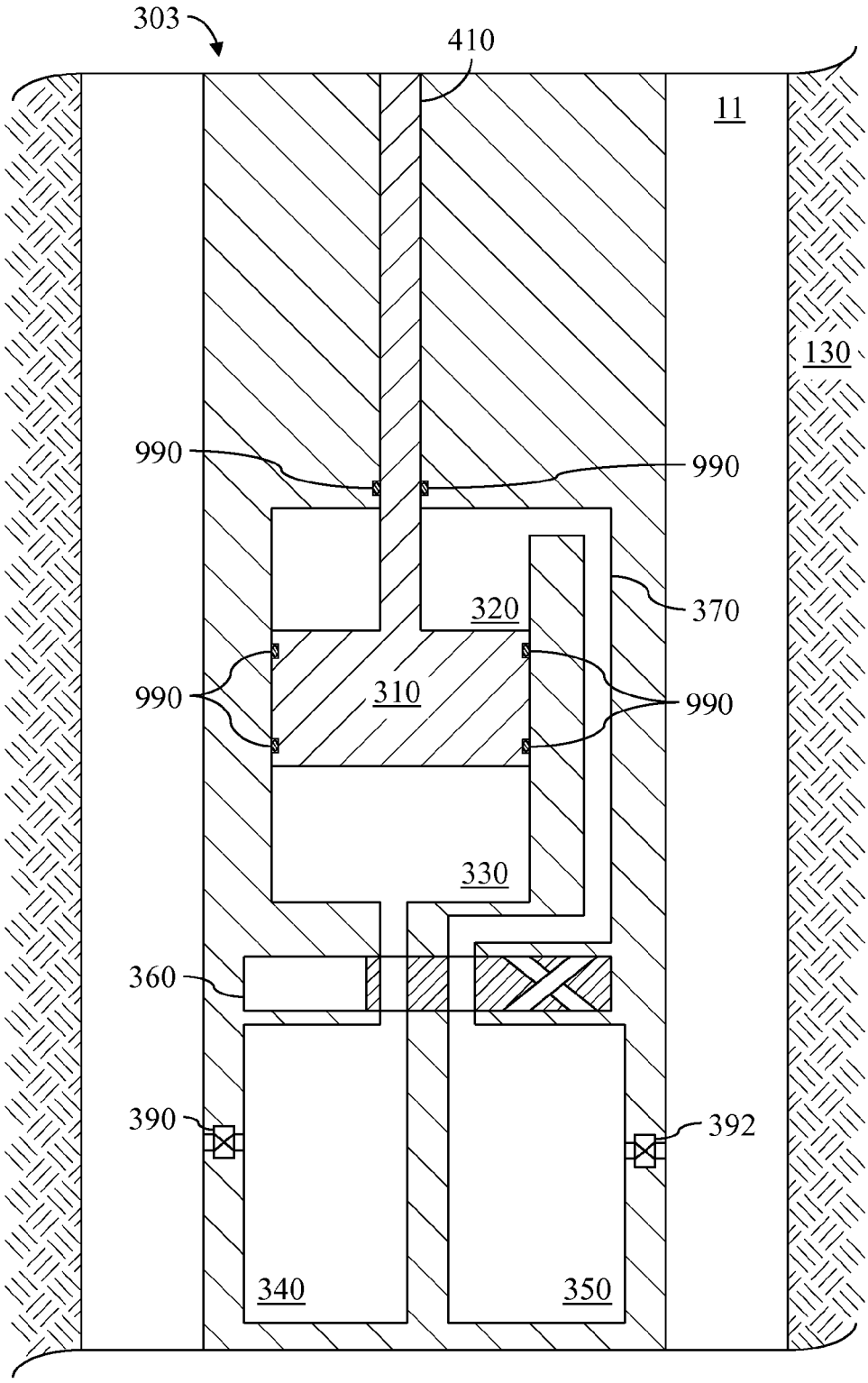
FIG. 8 is a schematic view of at least a portion of apparatus according to one or more aspects of the present disclosure.

FIG. 8 is a schematic view of at least a portion of apparatus comprising a downhole tool 303 according to one or more aspects of the present disclosure. The downhole tool 303 may be utilized in the implementation shown in FIG. 1 and/or FIG. 2. For example, the downhole tool 303 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2.

The downhole tool 303 may also have one or more aspects in common with, or be substantially similar or identical to, one or more of the downhole tool 300 shown in FIGS. 3 and 4, the downhole tool 301 shown in FIGS. 5 and 6, and/or the downhole tool 302 shown in FIG. 7, including where indicated by like reference numbers, However, as shown in FIG. 8, a rod, shaft, and/or other motion member 410 may extend from the piston 310. As such, reciprocating motion of the piston 310 is transferred to the motion member 410, which reciprocation may be utilized elsewhere in the downhole tool 303 for various purposes.

The motion member 410 may be a discrete member coupled to the piston 310 by threads, welding, and/or other fastening means, or the motion member 410 may be integrally formed with the piston 310. The motion member 410 may extend through various components/features of the downhole tool 303 or otherwise to a location outside the perimeter of the first chamber 320. The motion member 410 may extend upward or downward (relative to the orientation shown in FIG. 8) from the piston 310. The downhole tool 303 may comprise two or more instances of the motion member 410, including one extending upward from the piston 310, and another extending downward from the piston 310. The multiple instances of the motion member 410 may not be identical.

Figure 9:
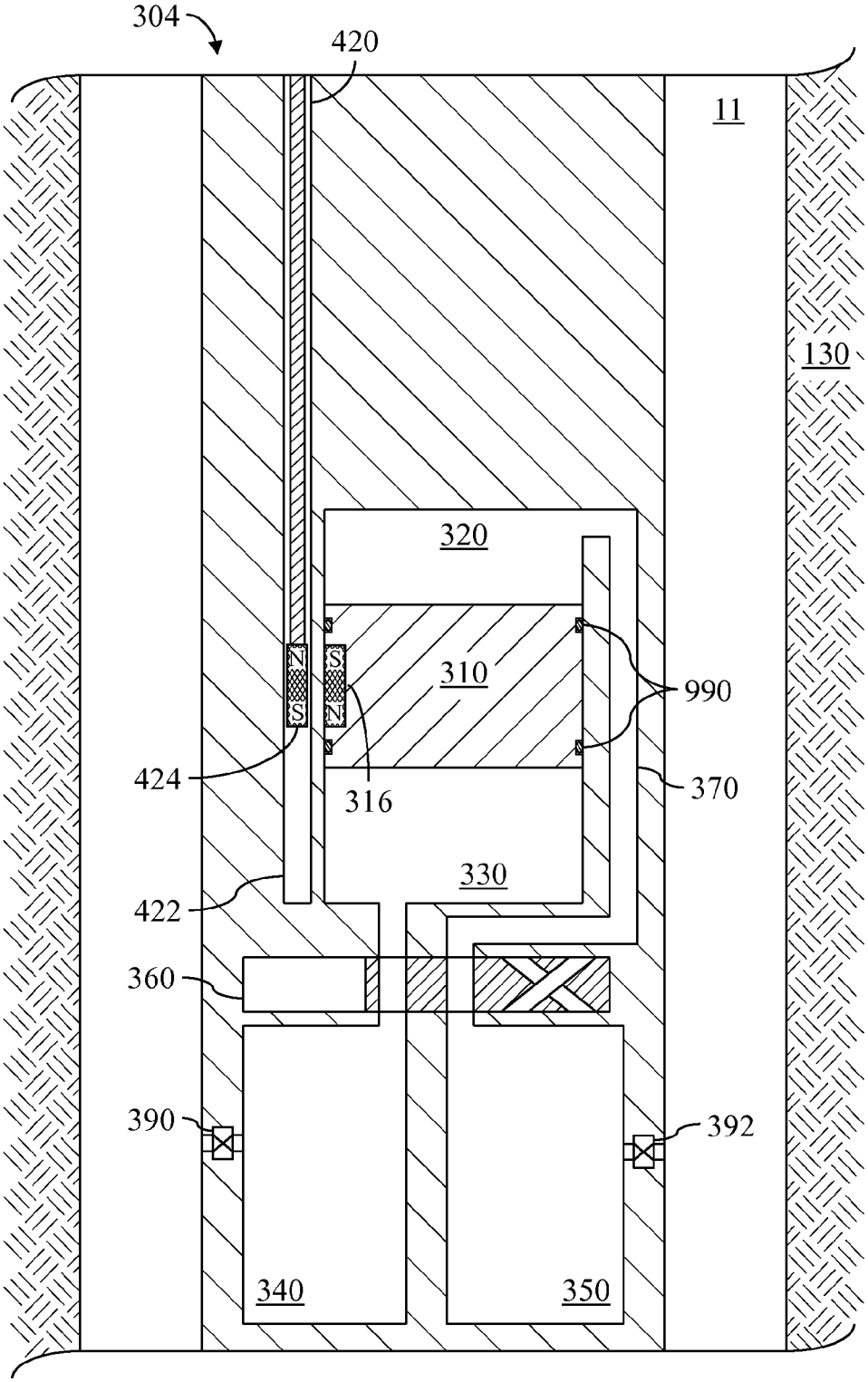
FIG. 9 is a schematic view of at least a portion of apparatus according to one or more aspects of the present disclosure.

FIG. 9 is a schematic view of at least a portion of apparatus comprising a downhole tool 304 according to one or more aspects of the present disclosure. The downhole tool 304 may be utilized in the implementation shown in FIG. 1 and/or FIG. 2. For example, the downhole tool 304 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2.

The downhole tool 304 may also have one or more aspects in common with, or be substantially similar or identical to, one or more of the downhole tool 300 shown in FIGS. 3 and 4, the downhole tool 301 shown in FIGS. 5 and 6, the downhole tool 302 shown in FIG. 7, and/or the downhole tool 303 shown in FIG. 8, including where indicated by like reference numbers. However, as shown in FIG. 9, the piston 310 may comprise a magnetic or electromagnetic (hereafter collectively "magnetic") member 316, and the downhole tool 304 may further comprise a rod, shaft, and/or other motion member 420 extending within an elongated passageway 422. The motion member 420 may comprise a magnetic member 424 positioned proximate the magnetic member 316 of the piston 310. The two magnetic members 316 and 424 may be oriented relative to one another in a manner permitting their cooperation, such that reciprocating motion of the piston 310 is transferred to the motion member 420. For example, as depicted by "N" (for North) and "S" (for South) designations in FIG. 9, the polarities of the magnetic members 316 and 424 may be opposed, although other arrangements are also within the scope of the present disclosure. As with the motion member 410 shown in FIG. 8, reciprocation of the motion member 420 may be utilized elsewhere in the downhole tool 304 for various purposes.

The magnetic members 316 and 424 may be discrete members coupled to the piston 310 and the motion member 420, respectively, via threads, welding, interference fit, and/or other fastening means. The motion member 420 may extend through various components/features of the downhole tool 304, and may extend upward or downward (relative to the orientation shown in FIG. 9) from the magnetic member 424. The downhole tool 304 may comprise two or more instances of the motion member 410, including one extending upward from the magnetic member 424, and another extending downward from the magnetic member 424. The multiple instances of the motion member 420 may not be identical, and two or more of such instances may utilize the same magnetic member 424.

Figure 10:
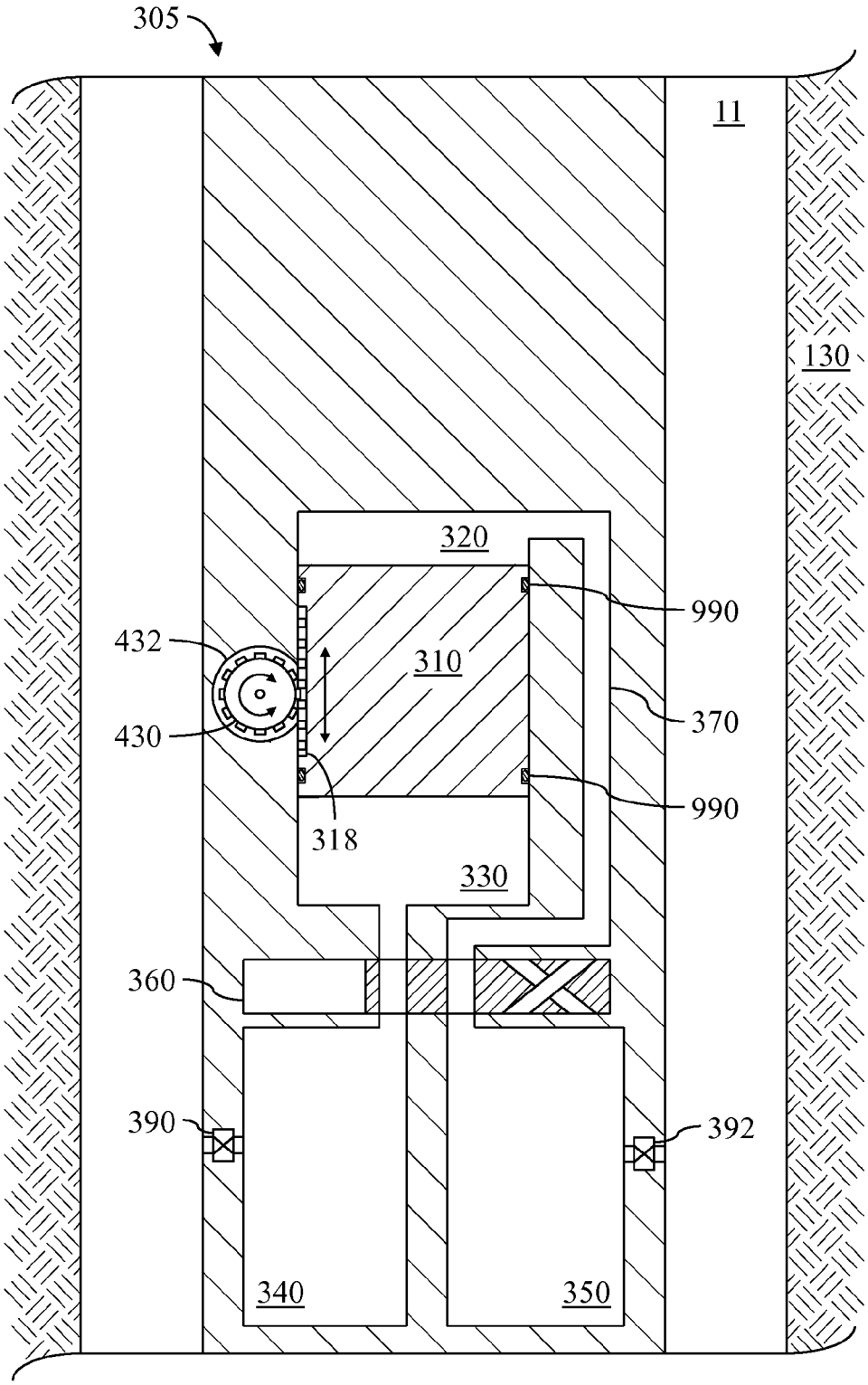
FIG. 10 is a schematic view of at least a portion of apparatus according to one or more aspects of the present disclosure.

FIG. 10 is a schematic view of at least a portion of apparatus comprising a downhole tool 305 according to one or more aspects of the present disclosure. The downhole tool 305 may be utilized in the implementation shown in FIG. 1 and/or FIG. 2. For example, the downhole tool 305 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2.

The downhole tool 305 may also have one or more aspects in common with, or be substantially similar or identical to, one or more of the downhole tool 300 shown in FIGS. 3 and 4, the downhole tool 301 shown in FIGS. 5 and 6, the downhole tool 302 shown in FIG. 7, the downhole tool 303 shown in FIG. 8, and/or the downhole tool 304 shown in FIG. 9, including where indicated by like reference numbers. However, as shown in FIG. 10, the piston 310 may comprise a linear gear or rack 318, and the downhole tool 304 may further comprise a geared member or pinion 430 operable to rotate within a recess 432 in response to the linear reciprocation of the piston 310. As with the members 410 and 420 described above, rotation of the geared member or pinion 430 may be utilized elsewhere in the downhole tool 305 for various purposes.

As mentioned above, one or more aspects of the present disclosure may be applicable to pumping implementations. For example, the shape of the piston 310 may at least partially define at least one pumping chamber that may be utilized to pump or otherwise displace formation fluid, hydraulic fluid (e.g., hydraulic oil), drilling fluid (e.g., mud), and/or other fluids. The piston 310 may at least partially define two pumping chambers, which may be considered and/or operated as a double-acting or duplex pump, such as where one pumping chamber draws from an intake while the other pumping chamber simultaneously expels to an exhaust.

Figure 11:
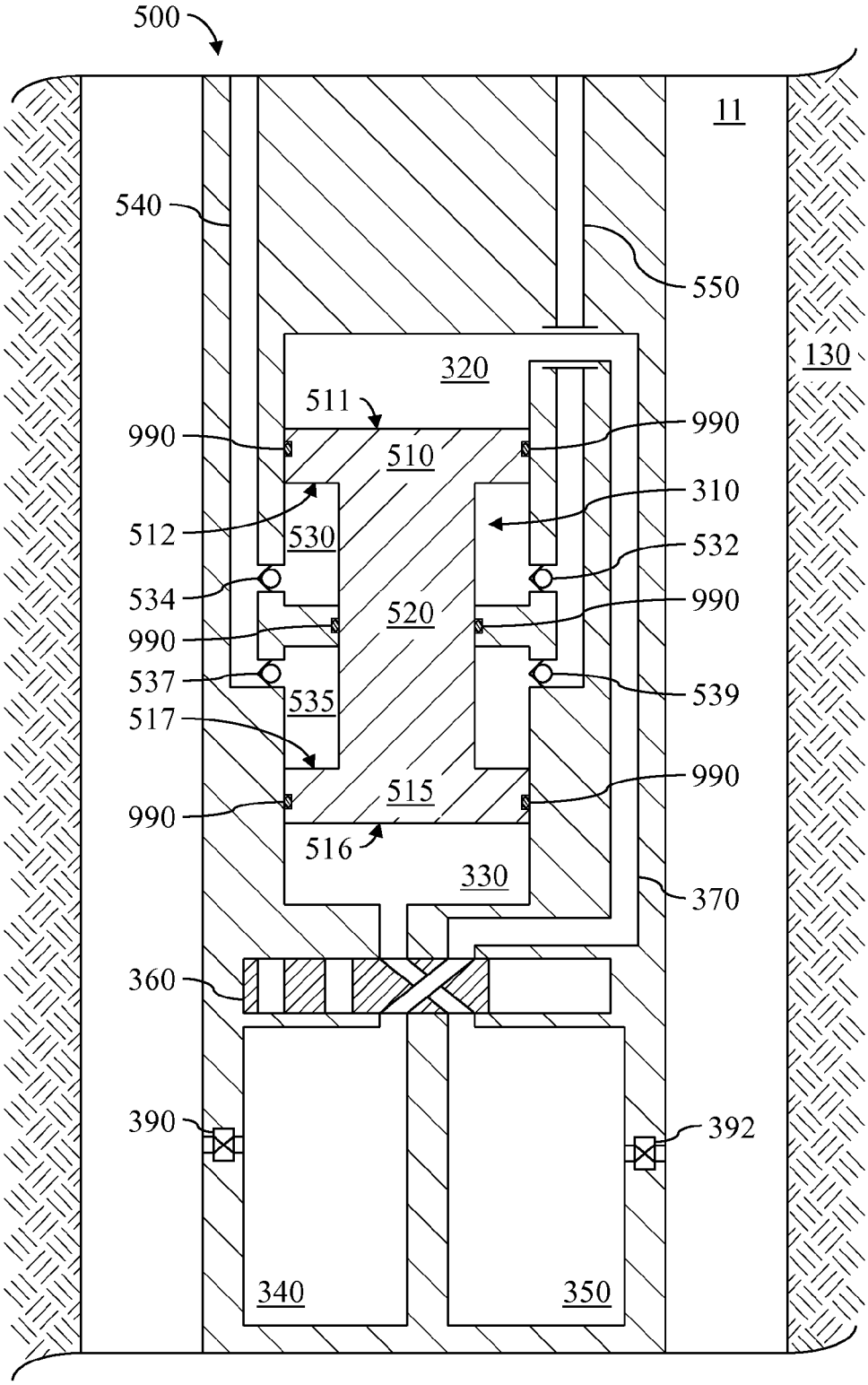
FIG. 11 is a schematic view of at least a portion of apparatus according to one or more aspects of the present disclosure.

FIG. 11 is a schematic view of at least a portion of apparatus comprising a downhole tool 500 according to one or more aspects of the present disclosure. The downhole tool 500 may be utilized in the implementation shown in FIG. 1 and/or FIG. 2. For example, the downhole tool 500 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2.

The downhole tool 500 may also have one or more aspects in common with, or be substantially similar to, one or more of the downhole tool 300 shown in FIGS. 3 and 4, the downhole tool 301 shown in FIGS. 5 and 6, the downhole tool 302 shown in FIG. 7, the downhole tool 303 shown in FIG. 8, the downhole tool 304 shown in FIG. 9, and/or the downhole tool 305 shown in FIG. 10, including where indicated by like reference numbers. However, as shown in FIG. 11, the piston 310 may comprise a first piston head 510, a second piston head 515, and a link and/or other member 520 extending between the first and second piston heads 510 and 515. The member 520 may be a discrete member coupled to the first and second piston heads 510 and 515 by threads, welding, and/or other fastening means, or the member 520 may be integrally formed with the first piston head 510 and/or the second piston head 515. The first piston head 510 comprises a first surface 511, having a surface area A11, and a second surface 512, having a surface area A12. The second piston head 515 comprises a first surface 516, having a surface area A22, and a second surface 517, having a surface area A21.

The first surface 511 of the first piston head 510 defines a moveable boundary that partially defines the first chamber 320, which is in fluid communication with a selective one of the high- and low-pressure chambers 340 and 350 via, for example, the flowline(s) 370, the valve 360, and/or other hydraulic circuitry. The second surface 512 of the first piston head 510 defines a moveable boundary that partially defines a first pumping chamber 530. The first pumping chamber 530 may be further defined by the outer surface of the member 520 of the piston 310, as well as other internal surfaces of the downhole tool 400.

The first surface 516 of the second piston head 515 defines a moveable boundary that partially defines the second chamber 330, which is in fluid communication with a selective one of the high- and low-pressure chambers 340 and 350 via, for example, the valve 360 and/or other hydraulic circuitry. The second surface 517 of the second piston head 515 defines a moveable boundary that partially defines a second pumping chamber 535. The second pumping chamber 535 may be further defined by the outer surface of the member 520 of the piston 310, as well as other internal surfaces of the downhole tool 400.

The downhole tool 500 further comprises one or more flowlines providing an intake conduit 540 for receiving formation fluid from the formation 130. For example, a portion of the downhole tool 500 and/or associated apparatus not shown in FIG. 11 may comprise one or more probes, packers, inlets, and/or other means for interfacing and providing fluid communication with the formation 130. Examples of such interfacing means may include the one or more instances of the probe assembly 116 shown in FIG. 1 and/or the fluid communication device 238 shown in FIG. 2, among other examples within the scope of the present disclosure.

The downhole tool 500 further comprises one or more flowlines providing an exhaust conduit 550 for expelling formation fluid into the wellbore 11 and/or another portion of the downhole tool 500. For example a portion of the downhole tool 500 and/or associated apparatus not shown in FIG. 11 may comprise one or more ports and/or other means for expelling fluid into the wellbore 11, as well as one or more sample bottles and/or other chambers that may be utilized to store a captured sample of formation fluid for retrieval at surface.

The surface areas A11, A12, A21, and A22 of the surfaces 511, 512, 517, and 516, respectively, are sized to exert a translational force on the piston 310 in response to the pressure PI of fluid in the intake conduit 540, the pressure PE of fluid in the exhaust conduit 550, the pressure PH of fluid in the high-pressure chamber 340, and the pressure PL of fluid in the low-pressure chamber 350. Accordingly, the differences between these pressures PI, PE, PH, and PL may be utilized to reciprocate the piston 310 and, in turn, pump fluid from the intake conduit 540 to the exhaust conduit 550. For example, to sample representative fluid from the formation 130, the piston 310 may be axially reciprocated to first perform a clean up operation while the obtained formation fluid partially comprises drilling fluid (mud) and/or other contaminants, and then further reciprocated to capture a representative sample of fluid from the formation 130. The surface areas A11, A12, A21, and A22 of the surfaces 511, 512, 517, and 516, respectively, may be designed for a specific environment, such as may have a known wellbore (hydrostatic) pressure PW and a given maximum drawdown pressure PD defined by the difference between the wellbore pressure PW and the minimum formation fluid pressure PF. Once the downhole tool 500 is fluidly coupled to the formation 130, such as by one or more instances of the probe assembly 116 shown in FIG. 1 and/or the fluid communication device 238 shown in FIG. 2, the pumping operation may be initiated.

An intake stroke is initiated by exposing the first chamber 320 to the high-pressure chamber 340 while simultaneously exposing the second chamber 330 to the low-pressure chamber 350, such as by establishing fluid communication between the chambers via operation of the valve 360 and/or other hydraulic circuitry. The resulting net force ((A11×PH)−(A12×PI)+(A21×PI)−(A22×PL)) operates to move the piston 310 downward (relative to the orientation depicted in FIG. 11). As the piston 310 translates downward, the first pumping chamber 530 decreases volumetrically, thus expelling fluid into the exhaust conduit 550 via a check valve 532. Another check valve 534 prevents simultaneously expelling fluid from the first pumping chamber 530 into the intake conduit 540. At the same time, the second pumping chamber 535 increases volumetrically, thus drawing fluid from the intake conduit 540 via a check valve 537. Another check valve 539 prevents simultaneously drawing fluid from the exhaust conduit 550 into the second pumping chamber 535.

After the intake stroke, and if fluid analysis (e.g., performed along the intake conduit 540, the exhaust conduit 550, and/or elsewhere in the downhole tool 500 and/or associated apparatus) indicates that the sampled formation fluid is not representative (e.g., contains excessive infiltrate and/or other contaminants), an exhaust stroke may be initiated. For example, the first chamber 320 may be exposed to the low-pressure chamber 350 while the second chamber 330 is simultaneously exposed to the high-pressure chamber 340, such as by operation of the valve 360 and/or other hydraulic circuitry. The resulting net force ((A11×PL)−(A12×PI)+(A21×PI)−(A22×PH)) operates to move the piston 310 upward (relative to the orientation depicted in FIG. 11). As the piston 310 translates upward, the first pumping chamber 530 increases volumetrically, thus drawing fluid from the intake conduit 540 via the check valve 534, while the check valve 532 prevents simultaneously drawing fluid from the exhaust conduit 550 into the first pumping chamber 530. At the same time, the second pumping chamber 535 decreases volumetrically, thus expelling fluid into the exhaust conduit 550 via the check valve 539, while the check valve 537 simultaneously prevents expelling fluid from the second pumping chamber 535 into the intake conduit 540.

Thus, the first and second chambers 320 and 330 may be employed as working chambers, alternatingly exposed to the different pressures of the high- and low-pressure chambers 340 and 350 to impart reciprocating motion to the moveable member 310. The valve 360 and/or equivalent or related hydraulic circuitry between the first and second working chambers 320 and 330 and the high- and low-pressure chambers 340 and 350 may also comprise and/or be operated as a choke or choking system, such as may be utilized to control the resulting pumping rate of the downhole tool 500.

Figure 12:
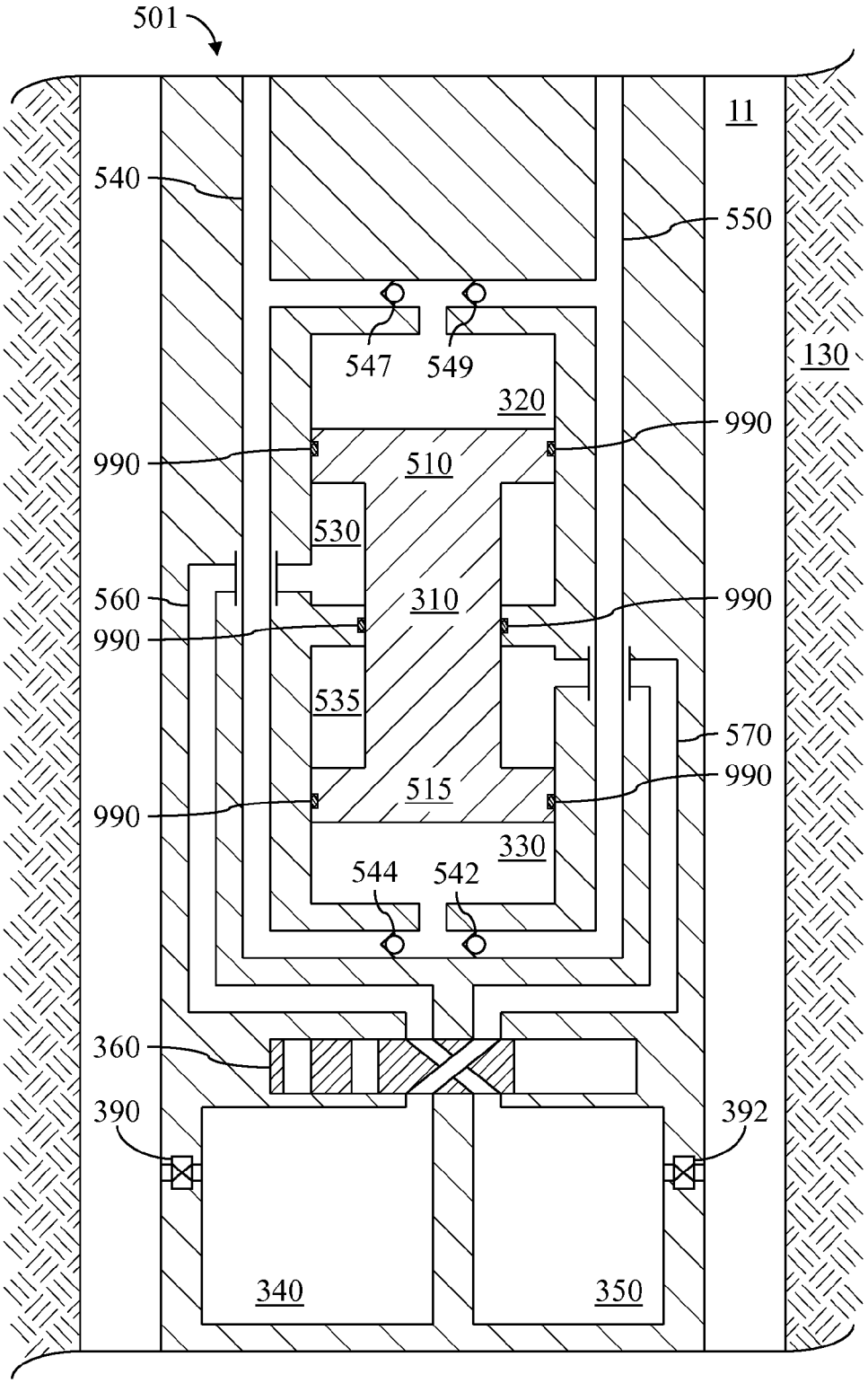
FIG. 12 is a schematic view of at least a portion of apparatus according to one or more aspects of the present disclosure.

FIG. 12 is a schematic view of at least a portion of apparatus comprising a downhole tool 501 according to one or more aspects of the present disclosure. The downhole tool 501 may be utilized in the implementation shown in FIG. 1 and/or FIG. 2. For example, the downhole tool 501 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2.

The downhole tool 501 may also have one or more aspects in common with, or be substantially similar to, the downhole tool 500 shown in FIG. 11, including where indicated by like reference numbers, with the following possible exceptions. For example, in contrast to the implementation shown in FIG. 11, the first and second chambers 320 and 330 may instead be utilized as the pumping chambers, and the first and second pumping chambers 530 and 535 may instead be utilized as the working chambers. That is, the intake and exhaust conduits 540 and 550 may be in fluid communication with the first and second chambers 320 and 330, whereas the first and second chambers 530 and 535 may be in selectively alternating fluid communication with the high- and low-pressure chambers 340 and 350. Carrying forward the naming convention adopted above, the first and second working chambers 320 and 330 described in relation to FIG. 11 are first and second pumping chambers 320 and 330 in FIG. 12. Similarly, the first and second pumping chambers 530 and 535 described in relation to FIG. 11 are first and second working chambers 530 and 535 in FIG. 12.

The downhole tool 501 comprises one or more flowlines 560 fluidly coupling the first working chamber 530 to a selective one of the high- and low-pressure chambers 340 and 350 via the valve 360 and/or other hydraulic circuitry. Similarly, one or more flowlines 570 fluidly couple the second working chamber 535 to a selective one of the high- and low-pressure chambers 340 and 350 via the valve 360 and/or other hydraulic circuitry.

In operation, the reciprocating motion of the piston 310 is generated as described above with respect to FIG. 11, except for the reversed roles of chambers 320, 330, 530, and 535. The first working chamber 530 is exposed to the low-pressure chamber 350 while the second working chamber 535 is simultaneously exposed to the high-pressure chamber 340. As the piston 310 consequently translates downward (relative to the orientation depicted in FIG. 12), the second pumping chamber 330 decreases volumetrically, thus expelling fluid into the exhaust conduit 550 via a check valve 542. Another check valve 544 prevents the fluid from being expelled into the intake conduit 540. At the same time, the first pumping chamber 320 increases volumetrically, thus drawing pumped fluid from the intake conduit 540 via a check valve 547. Another check valve 549 prevents fluid from being drawn into the first pumping chamber 320 from the exhaust conduit 550.

The first working chamber 530 is then exposed to the high-pressure chamber 340 while the second working chamber 535 is simultaneously exposed to the low-pressure chamber 350. As the piston 310 subsequently translates upward (relative to the orientation depicted in FIG. 12), the second pumping chamber 330 increases volumetrically, thus drawing fluid from the intake conduit 540 via the check valve 544, while the check valve 542 prevents fluid from being drawn into the second pumping chamber 330 from the exhaust conduit 550. At the same time, the first pumping chamber 320 decreases volumetrically, thus expelling fluid into the exhaust conduit 550 via the check valve 549, while the check valve 547 prevents fluid from being expelled into the intake conduit 540.

Figure 13:
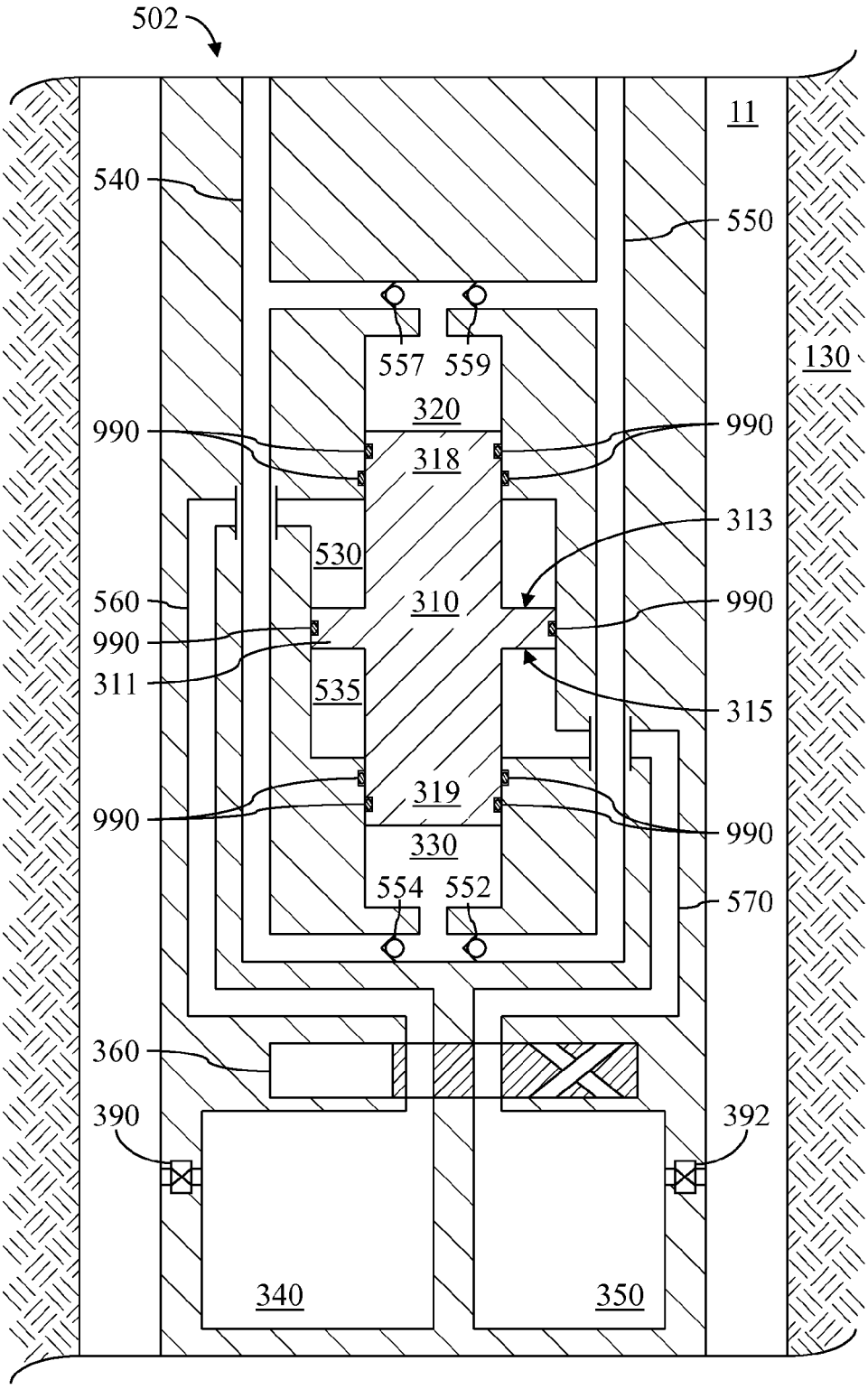
FIG. 13 is a schematic view of at least a portion of apparatus according to one or more aspects of the present disclosure.

FIG. 13 is a schematic view of at least a portion of apparatus comprising a downhole tool 502 according to one or more aspects of the present disclosure. The downhole tool 502 may be utilized in the implementation shown in FIG. 1 and/or FIG. 2. For example, the downhole tool 502 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2.

The downhole tool 502 may also have one or more aspects in common with, or be substantially similar to, the downhole tool 501 shown in FIG. 12, including where indicated by like reference numbers, with the following possible exceptions. For example, instead of comprising the piston heads 510 and 515 shown in FIG. 12, the piston 310 may comprise a flange portion 311 extending radially outward from a central portion of the piston 310. First and second opposing surfaces 313 and 315 define moveable boundaries of the first and second working chambers 530 and 535, respectively. A first end 318 of the piston 310 defines a moveable boundary of the first pumping chamber 320, and a second end 319 defines a moveable boundary of the second pumping chamber 330.

In operation, the reciprocating motion of the piston 310 is generated as described above, with the first and second working chambers 530 and 535 operating to drive the reciprocating motion of the piston 310. As the piston 310 translates downward (relative to the orientation depicted in FIG. 13), the second pumping chamber 330 decreases volumetrically, thus expelling fluid into the exhaust conduit 550 via a check valve 552. Another check valve 554 prevents fluid from being expelled into the intake conduit 540. At the same time, the first pumping chamber 320 increases volumetrically, thus drawing fluid from the intake conduit 540 via a check valve 557. Another check valve 559 prevents fluid from being drawn into the first chamber 320 from the exhaust conduit 550.

As the piston 310 subsequently translates upward (relative to the orientation depicted in FIG. 13), the second pumping chamber 330 increases volumetrically, thus drawing fluid from the intake conduit 540 via the check valve 554, while the check valve 552 prevents fluid from being drawn into the second pumping chamber 330 from the exhaust conduit 550. At the same time, the first pumping chamber 320 decreases volumetrically, thus expelling fluid into the exhaust conduit 550 via the check valve 559, while the check valve 557 prevents the fluid from being expelled into the intake conduit 540.

Figure 14:
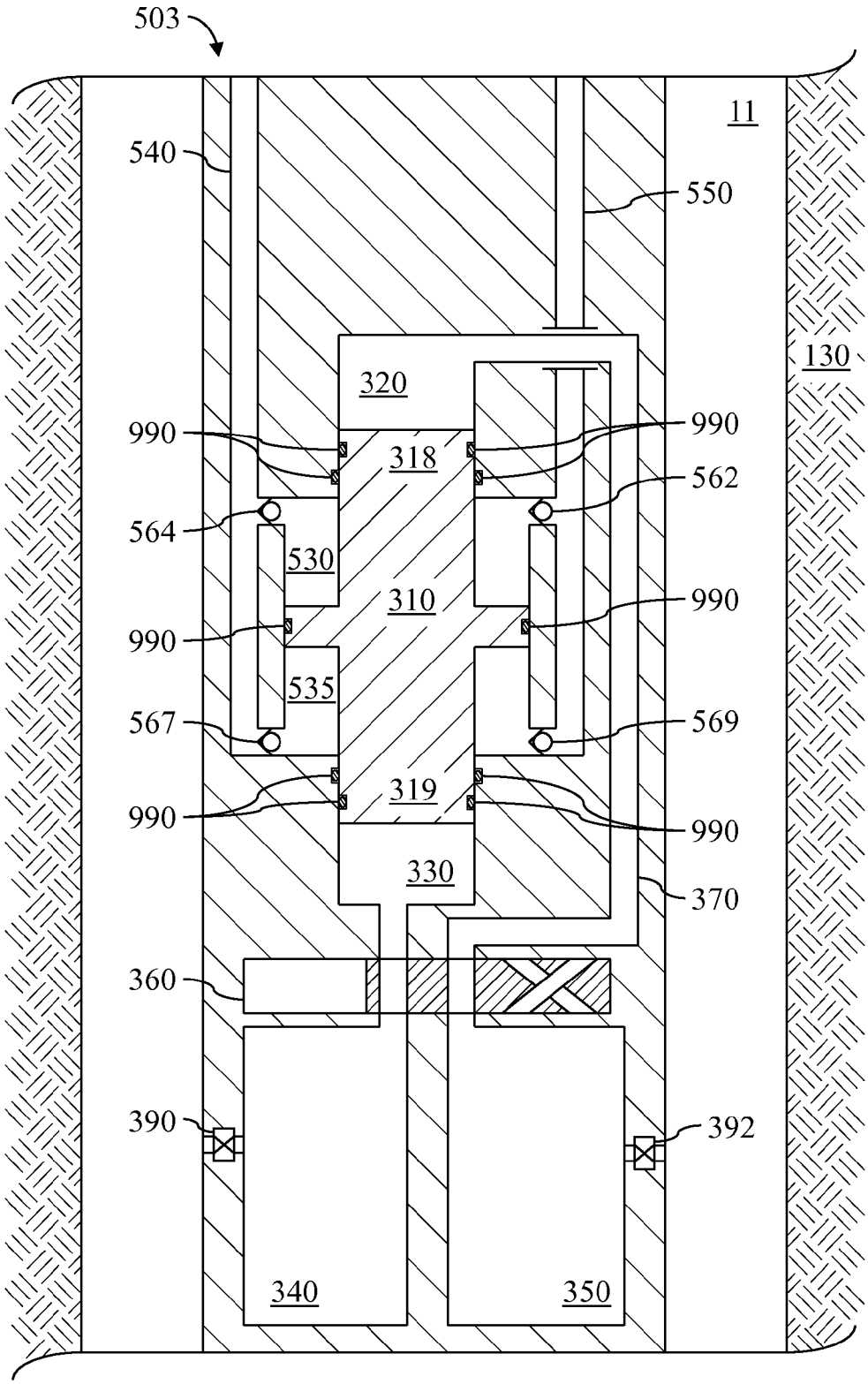
FIG. 14 is a schematic view of at least a portion of apparatus according to one or more aspects of the present disclosure.

FIG. 14 is a schematic view of at least a portion of apparatus comprising a downhole tool 503 according to one or more aspects of the present disclosure. The downhole tool 503 may be utilized in the implementation shown in FIG. 1 and/or FIG. 2. For example, the downhole tool 501 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2.

The downhole tool 503 may also have one or more aspects in common with, or be substantially similar to, the downhole tool 500 shown in FIG. 11 and/or the downhole tool 502 shown in FIG. 13, including where indicated by like reference numbers, with the following possible exceptions. That is, the chambers 320 and 330 are again utilized as the working chambers, and the chambers 530 and 535 are again utilized as the pumping chambers. The intake and exhaust conduits 540 and 550 may be in fluid communication with the first and second pumping chambers 530 and 535, whereas the first and second working chambers 320 and 330 may be in selectively alternating fluid communication with the high- and low-pressure chambers 340 and 350.

In operation, the reciprocating motion of the piston 310 is generated as described above. As the piston 310 translates downward (relative to the orientation depicted in FIG. 14), the second pumping chamber 535 decreases volumetrically, thus expelling fluid into the exhaust conduit 550 via a check valve 569. Another check valve 567 prevents fluid from being expelled into the intake conduit 540. At the same time, the first pumping chamber 320 increases volumetrically, thus drawing fluid from the intake conduit 540 via a check valve 564. Another check valve 562 prevents fluid from being drawn into the first pumping chamber 530 from the exhaust conduit 550.

As the piston 310 subsequently translates upward (relative to the orientation depicted in FIG. 14), the second pumping chamber 535 increases volumetrically, thus drawing fluid from the intake conduit 540 via the check valve 567, while the check valve 569 prevents fluid from being drawn into the second pumping chamber 535 from the exhaust conduit 550. At the same time, the first pumping chamber 530 decreases volumetrically, thus expelling fluid into the exhaust conduit 550 via the check valve 562, while the check valve 564 prevents fluid from being expelled into the intake conduit 540.

Figure 15:
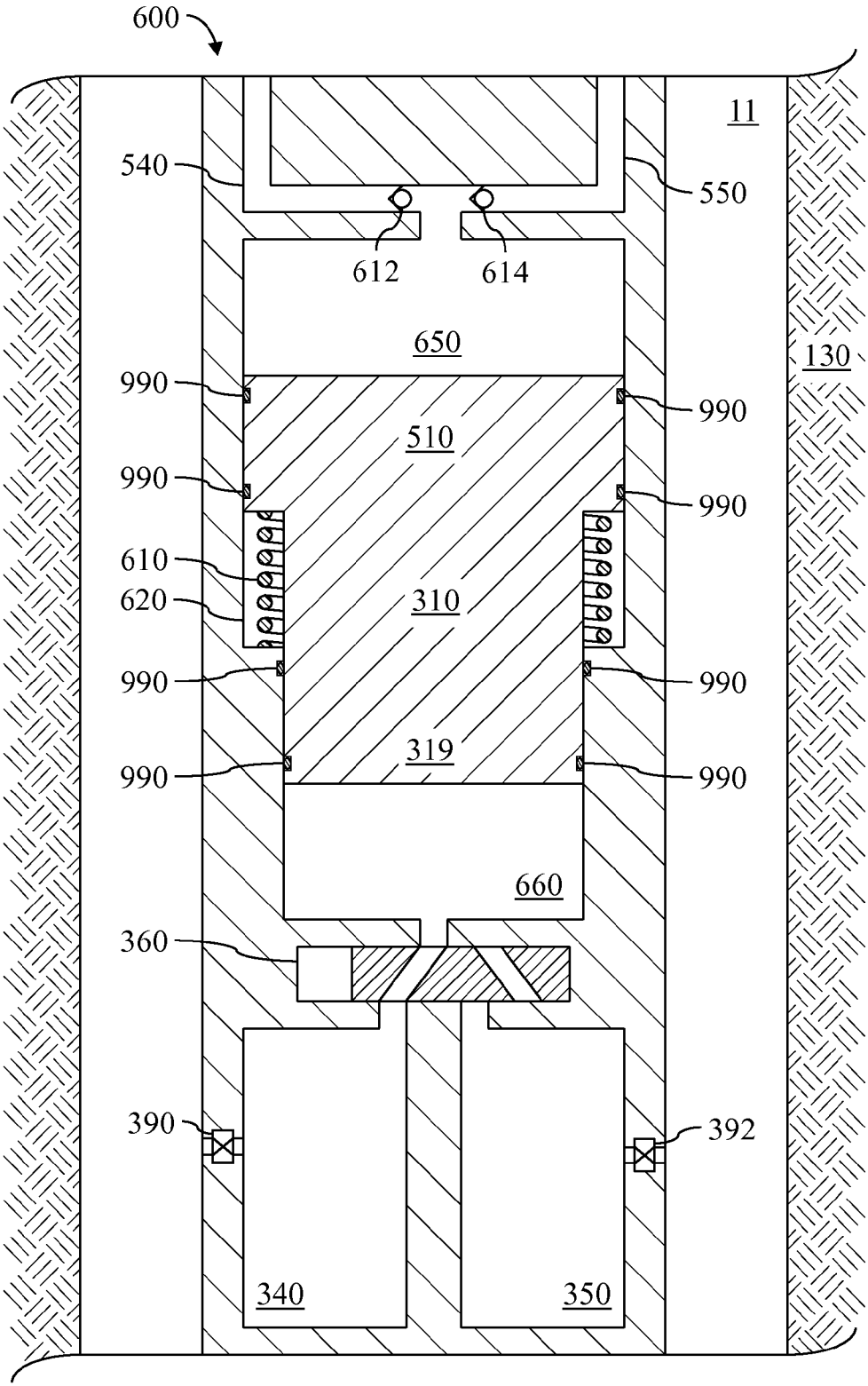
FIG. 15 is a schematic view of at least a portion of apparatus according to one or more aspects of the present disclosure.
Figure 16:
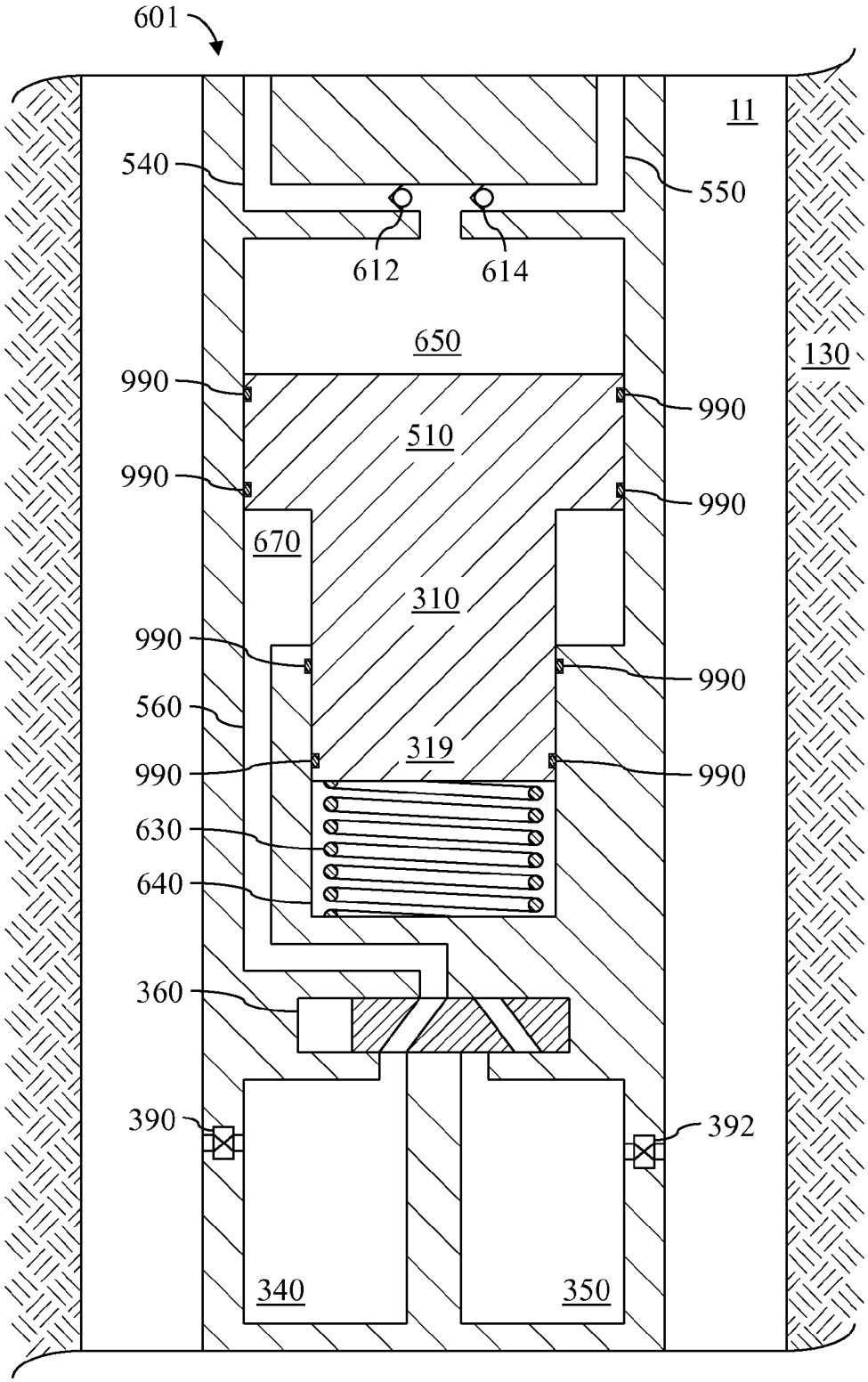
FIG. 16 is a schematic view of at least a portion of apparatus according to one or more aspects of the present disclosure.

Aspects of the present disclosure may also be applicable or adaptable to implementations in which a reciprocating engine is driven by means other than alternatingly drawing and expelling fluid into/from two opposing chambers. For example, fluid removal may be utilized to drive the piston 310 in one direction, and the return stroke may be accomplished utilizing another source of energy, such as a spring, a high-pressure gas, and/or a low-pressure chamber, among other examples. Such implementations may reduce the number of control valves and/or other hydraulic circuitry. FIGS. 15 and 16 depict examples of such implementations, comprising single-acting pumps with spring- or gas-powered return strokes. For example, a spring may power the exhaust stroke, although the roles may be inversed, such that the spring may be utilized to power the intake stroke, while the exhaust stroke may be powered by dumping fluid in an atmospheric chamber.

FIG. 15 is a schematic view of at least a portion of apparatus comprising a downhole tool 600 according to one or more aspects of the present disclosure. The downhole tool 600 may be utilized in the implementation shown in FIG. 1 and/or FIG. 2. For example, the downhole tool 600 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2. The downhole tool 600 may also have one or more aspects in common with, or be substantially similar to, one or more of the downhole tool 300 shown in FIGS. 3 and 4, the downhole tool 301 shown in FIGS. 5 and 6, the downhole tool 302 shown in FIG. 7, the downhole tool 303 shown in FIG. 8, the downhole tool 304 shown in FIG. 9, the downhole tool 305 shown in FIG. 10, the downhole tool 500 shown in FIG. 11, the downhole tool 501 shown in FIG. 12, the downhole tool 502 shown in FIG. 13, and/or the downhole tool 503 shown in FIG. 14, including where indicated by like reference numbers.

The downhole tool 600 comprises a biasing member 610 contained within a chamber 620. The biasing member 610 may provide or contribute to the force that moves the piston 310 upward (relative to the orientation shown in FIG. 15). That is, in a manner similar to those described above, the intake and exhaust conduits 540 and 550 may be in fluid communication with a single pumping chamber 650, whereas a single working chamber 660 may be alternatingly exposed to the high- and low-pressure chambers 340 and 350. The piston 310 may comprise a piston head 510 defining a moveable boundary of the pumping chamber 650, and an opposing end 319 of the piston 310 may define a moveable boundary of the working chamber 660.

In operation, exposing the working chamber 660 to the low-pressure chamber 350 (via operation of the valve 360 and/or other hydraulic circuitry) may generate a downward force on the piston 310 sufficient to overcome the biasing force of the biasing member 610, thus moving the piston 310 downward (relative to the orientation shown in FIG. 15) and subsequently drawing pumped fluid from the intake conduit 540 into the pumping chamber 650 via a check valve 612. Another check valve 614 may prevent the entry of fluid from the exhaust conduit 550 into the pumping chamber 650. Thereafter, the biasing force of the biasing member 610 acting on the piston head 510, whether alone or in cooperation with the force resulting from exposure of the working chamber 660 to the high-pressure chamber 340 (via operation of the valve 360 and/or other hydraulic circuitry), may move the piston 310 upward (relative to the orientation shown in FIG. 15) and subsequently expel fluid into the exhaust conduit 550 via the check valve 614. The check valve 612 may simultaneously prevent fluid from being expelled into the intake conduit 540.

The chamber 620 housing the biasing member 610 may be defined by surfaces of the piston head 510, other surfaces of the piston 310, and/or internal surfaces of the downhole tool 600. The biasing member 610 may comprise one or more compression springs, Belleville springs, and/or other biasing elements. In related implementations, the biasing member 610 may be operable to cause or contribute to the intake stroke of the piston 310, instead of the exhaust stroke, such as implementations in which the biasing member 610 may comprise one or more tension springs, or implementations in which the biasing member 610 may comprise one or more compression springs positioned other than as depicted in FIG. 15. The biasing member 610 may also or alternatively comprise electrical, magnetic, electromagnetic, and/or other means for biasing the piston 310 in an upward and/or downward direction (relative to the orientation shown in FIG. 15).

FIG. 16 is a schematic view of at least a portion of apparatus comprising a downhole tool 601 according to one or more aspects of the present disclosure. The downhole tool 601 may be utilized in the implementation shown in FIG. 1 and/or FIG. 2. For example, the downhole tool 601 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2.

The downhole tool 601 may also have one or more aspects in common with, or be substantially similar to, the downhole tool 600 shown in FIG. 15, including where indicated by like reference numbers, with the following possible exceptions. For example, a biasing member 630 contained within a chamber 640 may provide or contribute to the force that moves the piston 310 upward (relative to the orientation shown in FIG. 16). That is, as described above, the intake and exhaust conduits 540 and 550 may be in fluid communication with the pumping chamber 650. A working chamber 670 is alternatingly exposed to a selective one of the high- and low-pressure chambers 340 and 350, respectively. The working chamber 670 may be defined by a surface of the piston head 510, a central surface of the piston 310, and/or other surfaces of the downhole tool 6901. The end 319 of the piston 310, other surfaces of the piston 310, and/or one or more surfaces of the downhole tool 601 may define boundaries of the chamber 640 containing the biasing member 630.

In operation, exposing the working chamber 670 to the low-pressure chamber 350 (via operation of the valve 360 and/or other hydraulic circuitry) may generate a downward force on the piston 310 sufficient to overcome the biasing force of the biasing member 630, thus moving the piston 310 downward (relative to the orientation shown in FIG. 16) and subsequently drawing pumped fluid from the intake conduit 540 into the pumping chamber 650 via the check valve 612. The check valve 614 may prevent the entry of fluid from the exhaust conduit 550 into the pumping chamber 650. Thereafter, the biasing force provided by the biasing member 630 on the end 319 of the piston 310, whether alone or in cooperation with the force resulting from exposing the working chamber 670 to the high-pressure chamber 340 (via operation of the valve 360 and/or other hydraulic circuitry), may move the piston 310 upward (relative to the orientation shown in FIG. 16) and subsequently expel fluid into the exhaust conduit 550 via the check valve 614. The check valve 612 may simultaneously prevent fluid from being expelled into the intake conduit 540.

The biasing member 630 may comprise one or more compression springs, Belleville springs, and/or other biasing elements. In related implementations, the biasing member 630 may be operable to cause or contribute to the intake stroke of the piston 310, instead of the exhaust stroke, such as implementations in which the biasing member 630 may comprise one or more tension springs, or implementations in which the biasing member 630 may comprise one or more compression springs positioned other than as depicted in FIG. 16. The biasing member 630 may also or alternatively comprise electrical, magnetic, electromagnetic, and/or other means for biasing the piston 310 in an upward and/or downward direction (relative to the orientation shown in FIG. 16).

Figure 17:
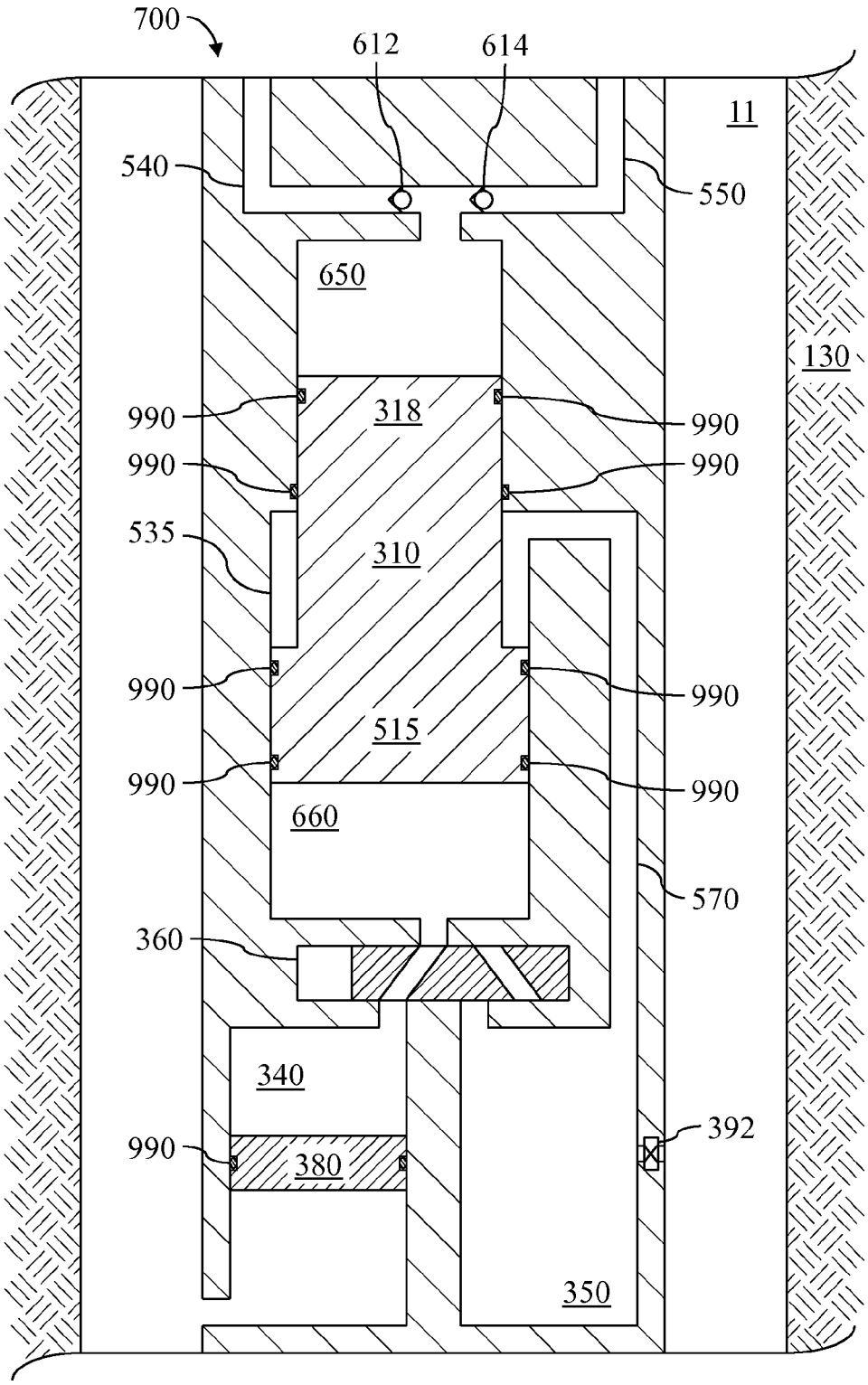
FIG. 17 is a schematic view of at least a portion of apparatus according to one or more aspects of the present disclosure.

FIG. 17 is a schematic view of at least a portion of apparatus comprising a downhole tool 700 according to one or more aspects of the present disclosure. The downhole tool 700 may be utilized in the implementation shown in FIG. 1 and/or FIG. 2. For example, the downhole tool 700 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2. The downhole tool 700 may also have one or more aspects in common with, or be substantially similar to, one or more of the downhole tool 300 shown in FIGS. 3 and 4, the downhole tool 301 shown in FIGS. 5 and 6, the downhole tool 302 shown in FIG. 7, the downhole tool 303 shown in FIG. 8, the downhole tool 304 shown in FIG. 9, the downhole tool 305 shown in FIG. 10, the downhole tool 500 shown in FIG. 11, the downhole tool 501 shown in FIG. 12, the downhole tool 502 shown in FIG. 13, the downhole tool 503 shown in FIG. 14, the downhole tool 600 shown in FIG. 15, and/or the downhole tool 601 shown in FIG. 16, including where indicated by like reference numbers.

In operation, the reciprocating motion of the piston 310 is generated as described above, with a working chamber 660 being alternatingly exposed to the high- and low-pressure chambers 340 and 350. The high-pressure chamber 340 may have a substantially constant internal pressure due to movement of a piston 380 in relation to the pressure differential between the high-pressure chamber 340 and the wellbore 11.

As the piston 310 translates downward (relative to the orientation depicted in FIG. 17), the pumping chamber 650 increases volumetrically, thus drawing fluid from the intake conduit 540 via the check valve 612. As the piston 310 subsequently translates upward (relative to the orientation depicted in FIG. 17), the pumping chamber 650 decreases volumetrically, thus expelling pumped fluid into the exhaust conduit 550 via the check valve 614.

Figure 18:
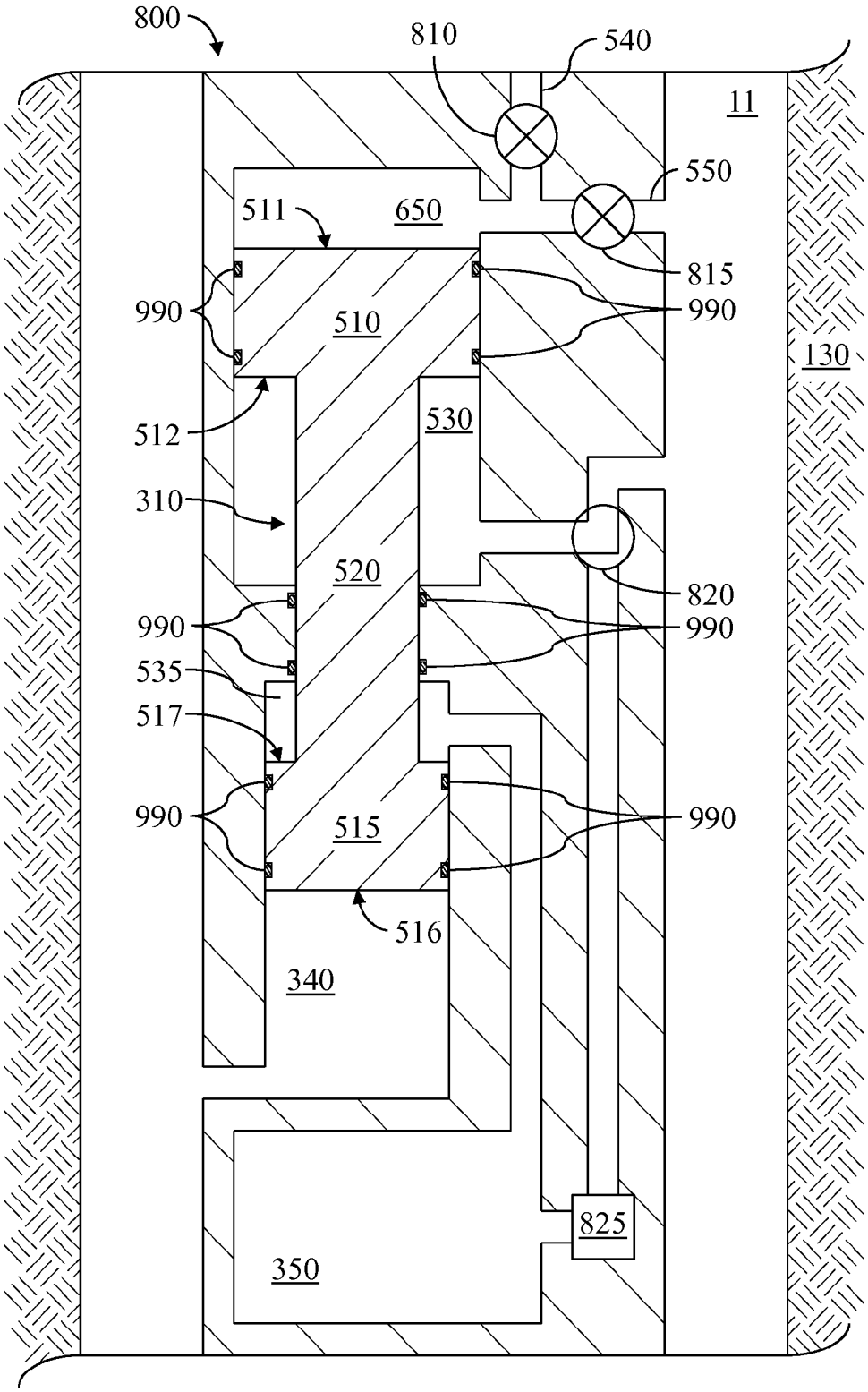
FIG. 18 is a schematic view of at least a portion of apparatus according to one or more aspects of the present disclosure.
Figure 19:
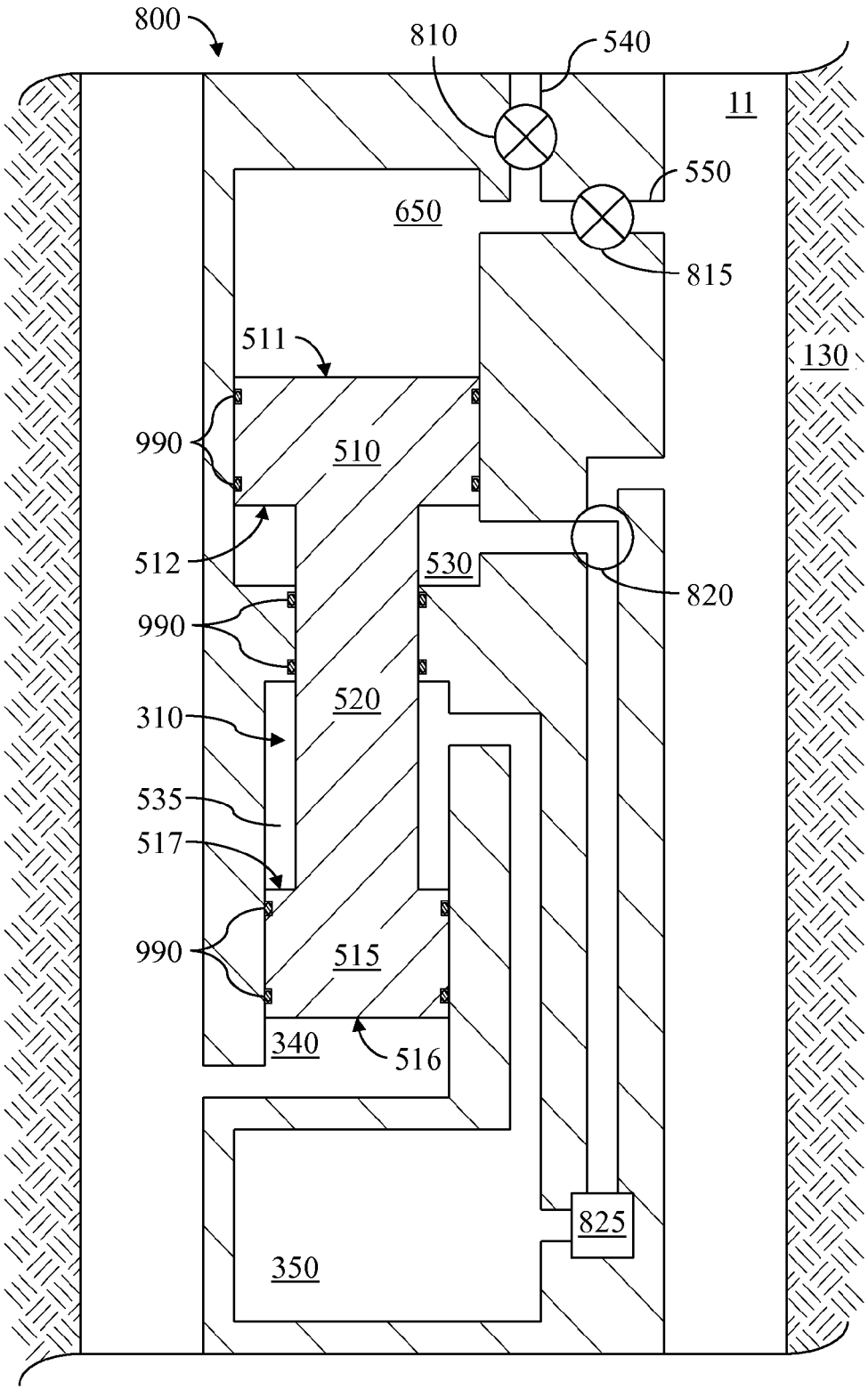
FIG. 19 is a schematic view of at least a portion of apparatus according to one or more aspects of the present disclosure.

FIGS. 18 and 19 are schematic views of at least a portion of apparatus comprising a downhole tool 800 according to one or more aspects of the present disclosure. The downhole tool 800 may be utilized in the implementation shown in FIG. 1 and/or FIG. 2. For example, the downhole tool 800 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2. The downhole tool 800 may also have one or more aspects in common with, or be substantially similar to, one or more of the downhole tool 300 shown in FIGS. 3 and 4, the downhole tool 301 shown in FIGS. 5 and 6, the downhole tool 302 shown in FIG. 7, the downhole tool 303 shown in FIG. 8, the downhole tool 304 shown in FIG. 9, the downhole tool 305 shown in FIG. 10, the downhole tool 500 shown in FIG. 11, the downhole tool 501 shown in FIG. 12, the downhole tool 502 shown in FIG. 13, the downhole tool 503 shown in FIG. 14, the downhole tool 600 shown in FIG. 15, the downhole tool 601 shown in FIG. 16, and/or the downhole tool 700 shown in FIG. 17, including where indicated by like reference numbers.

The downhole tool 800 comprises a piston 310 having a first piston head 510, a second piston head 515, and a link or other member 520 extending between the first and second piston heads 510 and 515. The member 520 may be a discrete member coupled to the first and second piston heads 510 and 515 by threads, welding, and/or other fastening means, or the member 520 may be integrally formed with the first piston head 510 and/or the second piston head 515. The first piston head 510 comprises a first surface 511, having an area B11, and a second surface 512, having an area B12. The second piston head 515 comprises a first surface 516, having an area B22, and a second surface 517, having an area B21.

The first surface 511 of the first piston head 510 defines a moveable boundary that partially defines a pumping chamber 650 in fluid communication with a selective one of an exhaust conduit 550 (which may be in constant or selective fluid communication with the wellbore 11) and an intake conduit 540. For example, a valve 810 and/or other hydraulic circuitry may selectively fluidly couple the pumping chamber 650 to the intake conduit 540, while another valve 815 and/or other hydraulic circuitry may selectively fluidly couple the pumping chamber 650 to the exhaust conduit 550. However, the valves 810 and 815 may instead collectively comprise a single valve, more than two valves, and/or other hydraulic circuitry. The valves 810 and 815 and/or the equivalent hydraulic circuitry may comprise check valves permitting fluid flow in a single direction, although piloted and/or other types of valves are also within the scope of the present disclosure.

The one or more flowlines of the intake conduit 540 provide for communicating formation fluid to and/or from the formation 130. For example, a portion of the downhole tool 800 and/or associated apparatus not shown in FIG. 18 may comprise one or more probes, packers, inlets, and/or other means for interfacing and providing fluid communication with the formation 130. Examples of such interfacing means may include the one or more instances of the probe assembly 116 shown in FIG. 1 and/or the fluid communication device 238 shown in FIG. 2, among other examples within the scope of the present disclosure.

The second surface 512 of the first piston head 510 defines a moveable boundary that partially defines a first working chamber 530 in fluid communication with a selective one of the wellbore 11 and a low-pressure chamber 350. For example, a valve 820 comprising a two-position valve, additional valves, and/or other hydraulic circuitry may fluidly couple the first working chamber 530 to a selective one of the wellbore 11 (or the exhaust conduit 50) and the low-pressure chamber 350.

The low-pressure chamber 350 may comprise hydraulic fluid and/or another gaseous or liquid fluid at atmospheric pressure or another pressure that is substantially less than hydrostatic pressure within the wellbore 11 (PW). That is, as with other implementations described above, the low-pressure chamber 350 may be filled (or evacuated) before the downhole tool 800 is inserted into the wellbore 11 and subsequently conveyed toward the formation 130. The downhole tool 800 may comprise one or more valves 825 and/or other hydraulic circuitry operable to isolate the low-pressure chamber 350 during such filling and/or otherwise during pumping operations. The valves 820 and 825 and/or the equivalent hydraulic circuitry may comprise check valves permitting fluid flow in a single direction, although other piloted and/or other types of valves are also within the scope of the present disclosure.

The second surface 517 of the second piston head 515 defines a moveable boundary that partially defines a second working chamber 535 in fluid communication with the low-pressure chamber 350. The second working chamber 535 may be in constant fluid communication with the low-pressure chamber 350, as depicted in FIG. 18, or in selective fluid communication with the low-pressure chamber 350 via one or more valves and/or other hydraulic circuitry (not shown).

The high-pressure chamber is partially defined by the surface 516 of the piston head 515. The high-pressure chamber 340 may be in constant fluid communication with the wellbore 11, as depicted in FIG. 18, or in selective fluid communication with the wellbore 11 via one or more valves and/or other hydraulic circuitry (not shown).

The central member 520 of the piston 310 may also define partial boundaries of the one or more of the chambers described above. For example, in the implementation depicted in FIG. 18, the member 520 defines partial boundaries of the first and second working chambers 530 and 535.

The surface areas B11, B12, B21, and B22 of the surfaces 511, 512, 517, and 516, respectively, are sized to exert a desired translational force on the piston 310 in response to the pressure PF of fluid in the formation 130, the pressure PW of fluid in the wellbore 11, and the pressure PL of fluid in the low-pressure chamber 350. Accordingly, the differences between these three pressures PF, PW, and PL may be utilized to reciprocate the piston 310 as described above. For example, to sample representative fluid from the formation 130, the piston 310 may be axially reciprocated to first perform a clean up operation while the obtained formation fluid partially comprises drilling fluid (mud) and/or other contaminants, and then further reciprocated to capture a representative sample of fluid from the formation 130. The surface areas B11, B12, B21, and B22 of the surfaces 511, 512, 517, and 516, respectively, may be designed for a specific environment, with a known wellbore (hydrostatic) pressure PW and a given maximum drawdown pressure PD defined by the difference between the wellbore pressure PW and the minimum formation fluid pressure PF. Once the downhole tool 800 is fluidly coupled to the formation 130, such as by one or more instances of the probe assembly 116 shown in FIG. 1 and/or the fluid communication device 238 shown in FIG. 2, the pumping operation may be initiated.

An intake stroke is initiated by exposing the pumping chamber 650 to the formation 130, such as by operation of the valve 810, the valve 815, and/or other hydraulic circuitry, and exposing the first working chamber 530 to the low-pressure chamber 350, such as by operation of the valve 820, the valve 825, and/or other hydraulic circuitry, as depicted in FIG. 19. The resulting net force ((B11×PF)−(B12×PL)+(B21×PL)−(B22×PW)) operates to urge the piston 310 downward (relative to the orientation depicted in FIGS. 18 and 19). Consequently, the pumping chamber 650 expands and draws in formation fluid, the first working chamber 530 contracts and expels fluid (e.g., wellbore fluid) into the low-pressure chamber 350, the second working chamber 535 expands and draws in fluid from the low-pressure chamber 350, while the high-pressure chamber 340 contracts and expels wellbore fluid into the wellbore 11. The valve 825 and/or equivalent hydraulic circuitry between the low-pressure chamber 350 and the first working chamber 530 may comprise and/or be operated as a choke or choking system that may be utilized to control the resulting flow rate into the first chamber 320.

After the intake stroke, and if fluid analysis (e.g., performed in or along the intake conduit 540 and/or elsewhere in the downhole tool 800 and/or associated apparatus) indicates that the sampled formation fluid is not representative (e.g., contains excessive infiltrate and/or other contaminants), an exhaust stroke may be initiated. For example, the pumping chamber 650 and the first working chamber 530 may once again be exposed to exhaust conduit 550 and/or the wellbore 11, such as by operation of the valves 810, 815, 820, 825, and/or other hydraulic circuitry, as depicted in FIG. 18. The resulting net force ((B11×PW)−(B12×PW)+(B21×PL)−(B22×PW)) operates to urge the piston 310 upward (relative to the orientation depicted in FIGS. 18 and 19). Consequently, the pumping chamber 650 contracts and expels fluid into the exhaust conduit 550 (and perhaps to the wellbore 11), the first working chamber 530 expands and draws in fluid from the wellbore 11 (or the exhaust conduit 550), the second working chamber 535 contracts and expels fluid into the low-pressure chamber 350, and the second chamber 340 expands and draws in fluid from the wellbore 11.

The intake and exhaust strokes may then be repeated a number of times until the sampled fluid from the formation 130 is considered representative, at which time the sampled fluid may be stored in the pumping chamber 650, perhaps sealed by a sealing mechanism (not shown), and retrieved to surface. The sampled formation fluid may also or alternatively be exhausted from the pumping chamber 650 into a sample chamber located elsewhere in the downhole tool 800 and/or associated apparatus, such as into one or more instances of the sample chamber 127 shown in FIG. 1 and/or the sample chambers 240 shown in FIG. 2. In such implementations, the downhole tool 800 and/or associated apparatus may further comprise valving and/or other hydraulic circuitry that may be piloted and/or otherwise operated to direct the sampled formation fluid from the pumping chamber 650 to the desired sample chamber/module. For example, the valves shown in FIGS. 18 and 19 and/or other hydraulic circuitry may be piloted with another isolation valve system located between the probe and the sample chamber, or that is positioned differently in the toolstring, with a checking pressure that is sufficient to overcome the sample chamber friction (e.g., with the back pressure at PW).

As with other implementations described above, the piston 310, the chambers 320, 340, 350, 530, and 535, and the associated hydraulic circuitry, may collectively form a pump that may be utilized for various pumping operations downhole. For example, the pump 121 shown in FIG. 1 and/or the pump 235 shown in FIG. 2 may be or comprise the apparatus shown in FIGS. 18 and 19, among other apparatus within the scope of the present disclosure.

Figure 20:
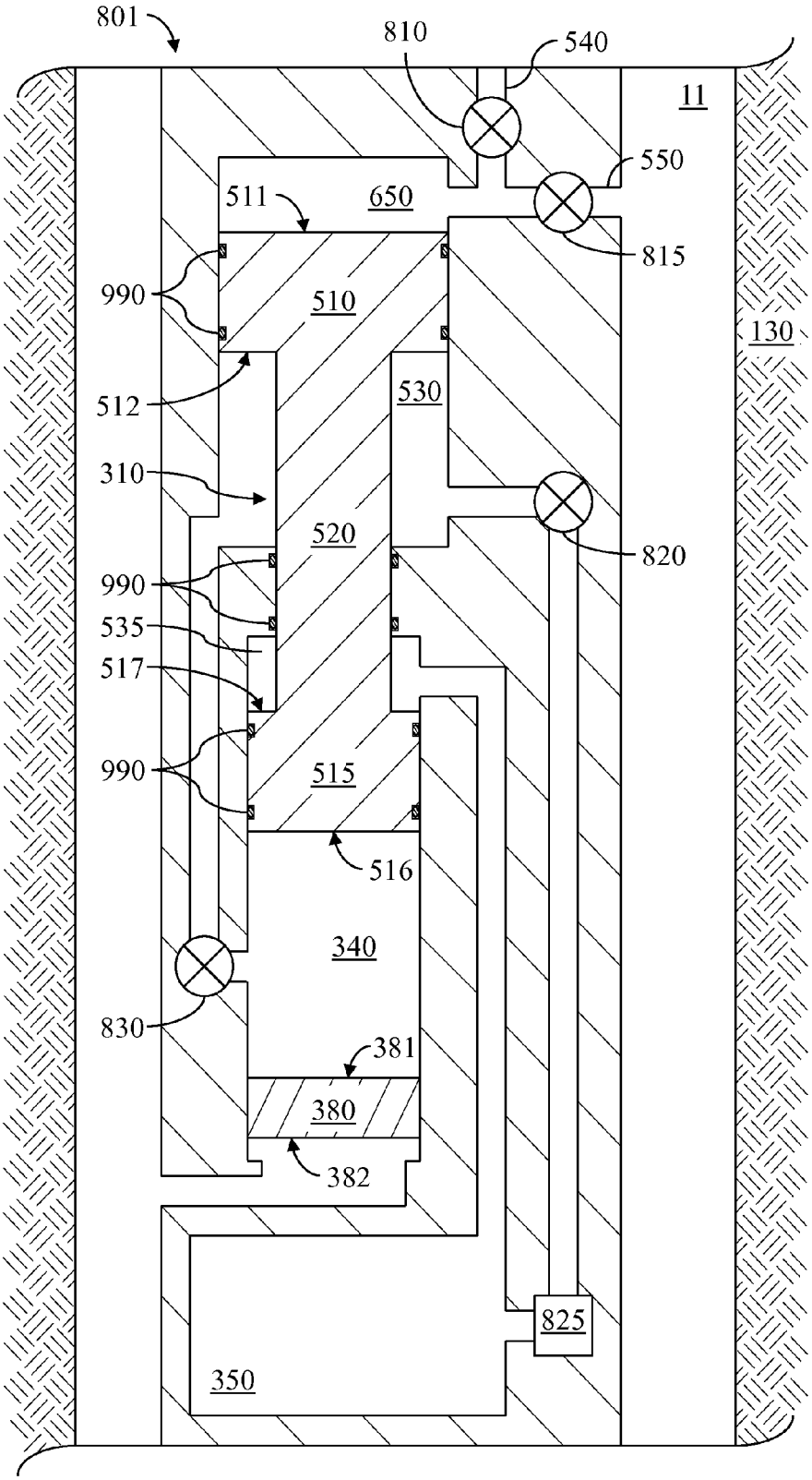
FIG. 20 is a schematic view of at least a portion of apparatus according to one or more aspects of the present disclosure.

FIG. 20 is a schematic view of a similar implementation of the downhole tool 800 shown in FIGS. 18 and 19, designated herein by reference numeral 801. The downhole tool 801 shown in FIG. 20 may have one or more aspects in common with, or be substantially similar to, the downhole tool 800 shown in FIGS. 18 and 19, with the following possible exceptions.

In the implementation depicted in FIG. 20, the first working chamber 530 is in fluid communication with a selective one of the low-pressure chamber 350 and the high-pressure chamber 340. For example, the valve 820 and/or other hydraulic circuitry may selectively fluidly couple the first working chamber 530 to the low-pressure chamber 350, and an additional valve 830 and/or other hydraulic circuitry may selectively fluidly couple the first working chamber 530 to the high-pressure chamber 340. However, the valves 820 and 830 may instead collectively comprise a different number and/or configuration of valves and/or other hydraulic circuitry, and/or may include one or more check valves, piloted valves, and/or other types of valves within the scope of the present disclosure.

The high-pressure chamber 340 may comprise a moveable boundary defined by a floating piston 380, and contains hydraulic fluid and/or another gaseous or liquid fluid. A first surface 381 of the floating piston 380 defines the moveable boundary. A second surface 382 of the piston 380 is exposed to the wellbore 11, such that the fluid within the high-pressure chamber 340 substantially remains at the wellbore pressure PW.

Similar to the operation of the downhole tool 800 shown in FIGS. 18 and 19, the intake stroke for the downhole tool 801 shown in FIG. 20 is initiated by exposing the pumping chamber 650 to the formation 130, such as by operation of the valve 810, the valve 815, and/or other hydraulic circuitry, and exposing the first working chamber 530 to the low-pressure chamber 350, such as by operation of the valve 820, the valve 825, and/or other hydraulic circuitry. However, initiating the intake stroke of the downhole tool 801 also comprises isolating the first working chamber 530 from the wellbore pressure PW of the high-pressure chamber 340, such as by operation of the valve 830 and/or other hydraulic circuitry. The resulting net force ((B11×PF)−(B12×PL)+(B21×PL)−(B22×PW)) operates to move the piston 310 downward (relative to the orientation depicted in FIG. 20). Consequently, the pumping chamber 650 expands and draws in formation fluid, the first working chamber 530 contracts and expels hydraulic fluid into the low-pressure chamber 350, the second working chamber 535 expands and draws in fluid from the low-pressure chamber 350, and the high-pressure chamber 340 contracts. The valves 820 and/or 825 and/or equivalent hydraulic circuitry between the low-pressure chamber 350 and the first working chamber 530 may comprise and/or be operated as a choke or choking system that may be utilized to control the resulting flow rate into the first working chamber 530.

After the intake stroke, and if fluid analysis (e.g., performed in or along the intake conduit 540 and/or elsewhere in the downhole tool 801 and/or associated apparatus) indicates that the sampled formation fluid is not representative (e.g., contains excessive infiltrate and/or other contaminants), an exhaust stroke may be initiated. That is, the pumping chamber 650 may once again be exposed to the exhaust conduit 550 (and perhaps to the wellbore 11), such as by operation of the valves 810, 815, and/or other hydraulic circuitry, and the first working chamber 530 may be exposed to the wellbore pressure PW within the high-pressure chamber 340, such as by operation of the valve 830 and/or other hydraulic circuitry. The resulting net force ((B11×PW)−(B12×PW)+(B21×PL)−(B22×PW)) operates to move the piston 310 upward (relative to the orientation depicted in FIG. 20). Consequently, the pumping chamber 650 contracts and expels fluid into the exhaust conduit 550, the first working chamber 530 expands and draws in fluid from the high-pressure chamber 340, the second working chamber 535 contracts and expels fluid into the low-pressure chamber 350, and the high-pressure chamber 340 expands.

The intake and exhaust strokes may then be repeated a number of times until the fluid sampled from the formation 130 is considered representative, at which time the sampled fluid may be stored in the pumping chamber 650, perhaps sealed by a sealing mechanism (not shown), and retrieved to surface. The sampled formation fluid may also or alternatively be exhausted from the pumping chamber 650 into a sample chamber located elsewhere in the downhole tool 801 and/or associated apparatus, such as into one or more instances of the sample chambers 127 shown in FIG. 1 and/or the sample chambers 240 shown in FIG. 2. In such implementations, the downhole tool 801 and/or associated apparatus may further comprise valving and/or other hydraulic circuitry that may be piloted and/or otherwise operated to direct the sampled formation fluid from the pumping chamber 650 to the desired sample chamber/module. For example, the valves shown in FIG. 20 and/or other hydraulic circuitry may be piloted with another isolation valve system located between the probe and the sample chamber, or that is positioned differently in the toolstring, with a checking pressure that is sufficient to overcome the sample chamber friction (e.g., with the back pressure at PW).

Figure 21:
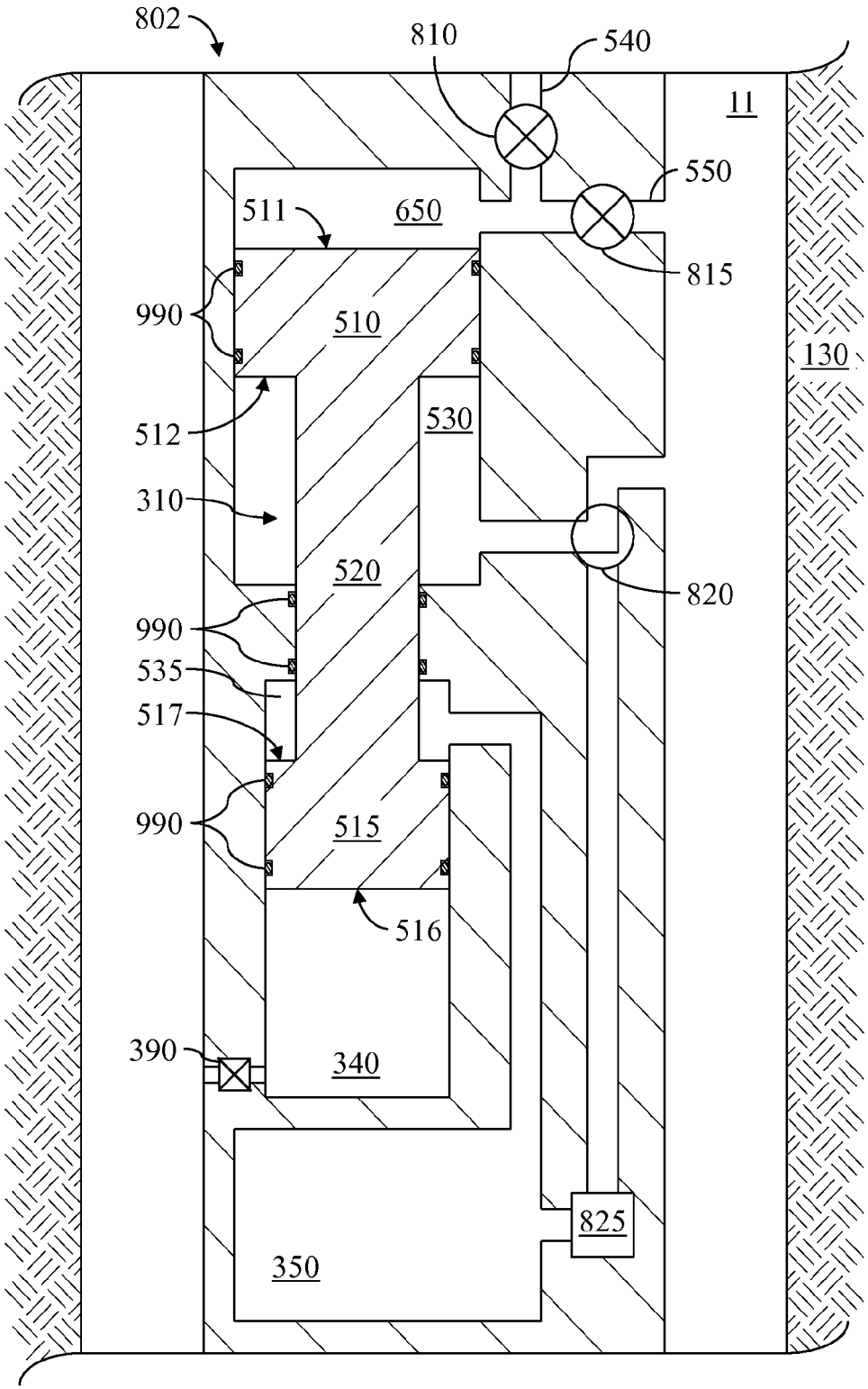
FIG. 21 is a schematic view of at least a portion of apparatus according to one or more aspects of the present disclosure.

FIG. 21 is a schematic view of a similar implementation of the downhole tool 800 shown in FIGS. 18 and 19, designated herein by reference numeral 802. The downhole tool 802 shown in FIG. 21 may have one or more aspects in common with, or be substantially similar to, one or more of the downhole tool 800 shown in FIGS. 18 and 19 and/or the downhole tool 801 shown in FIG. 20, with the following possible exceptions.

As with the implementations described above, the first surface 516 of the second piston head 515 defines a moveable boundary that partially defines the high-pressure chamber 340. However, in the implementation shown in FIG. 21, the high-pressure chamber 340 is not in fluid communication with the wellbore 11. Instead, the high-pressure chamber 340 comprises a pressurized fluid, such as nitrogen, argon, air, hydraulic fluid (e.g., hydraulic oil), and/or another gaseous or liquid fluid, which may be injected into the high-pressure chamber 340 via a fill port 390 and/or other means before the downhole tool 802 is inserted into the wellbore 11 and conveyed toward the formation 130. Such an implementation may increase pumping efficiency in low-pressure-differential scenarios, perhaps including in underbalanced scenarios in which the wellbore pressure PW is less than the formation pressure PF.

The surface areas B11, B12, B21, and B22 of the surfaces 511, 512, 517, and 516, respectively, are sized to exert a desired translational force on the piston 310 in response to the pressure PF of fluid in the formation 130, the pressure PW of fluid in the wellbore 11, the pressure PH of fluid in the high-pressure chamber 340, and the pressure PL of fluid in the low-pressure chamber 350. Accordingly, the differences between these four pressures PF, PW, PH, and PL may be utilized to reciprocate the piston 310 and, in turn, draw fluid from the formation 130 during a formation fluid sampling operation. For example, to sample representative fluid from the formation 130, the piston 310 may be axially reciprocated to first perform a clean up operation while the obtained formation fluid partially comprises drilling fluid (mud), other wellbore fluids, and/or contaminants, and may then be further reciprocated to capture a representative sample of fluid from the formation 130. The surface areas B11, B12, B21, and B22 of the surfaces 511, 512, 517, and 516, respectively, may be designed for a specific environment, with a known wellbore (hydrostatic) pressure PW and a given maximum drawdown pressure PD. Once the downhole tool 802 is fluidly coupled to the formation 130, such as by one or more instances of the probe assembly 116 shown in FIG. 1 and/or the fluid communication device 238 shown in FIG. 2, the pumping operation may be initiated.

An intake stroke is initiated by exposing the pumping chamber 650 to the formation 130, such as by operation of the valve 810, the valve 815, and/or other hydraulic circuitry, and exposing the first working chamber 530 to the low-pressure chamber 350, such as by operation of the valve 820, the valve 825, and/or other hydraulic circuitry. The resulting net force ((B11×PF)−(B12×PL)+(B21×PL)−(B22×PH)) operates to move the piston 310 downward (relative to the orientation depicted in FIG. 21). Consequently, the pumping chamber 650 expands and draws in formation fluid, the first working chamber 530 contracts and expels fluid (e.g., wellbore fluid) into the low-pressure chamber 350, the second working chamber 535 expands and draws in fluid from the low-pressure chamber 350, and the second chamber 340 contracts (thereby increasing the pressure PH therein). The valve 825 and/or equivalent hydraulic circuitry between the low-pressure chamber 350 and the first working chamber 530 may comprise and/or be operated as a choke or choking system that may be utilized to control the resulting flow rate into the pumping chamber 650.

After the intake stroke, and if fluid analysis (e.g., performed in the intake conduit 540 and/or elsewhere in the downhole tool 802 and/or associated apparatus) indicates that the sampled formation fluid is not representative (e.g., contains excessive infiltrate and/or other contaminants), an exhaust stroke may be initiated. For example, the pumping chamber 650 and the first working chamber 530 may once again be exposed to the exhaust conduit 550 (and perhaps the wellbore 11), such as by operation of the valves 810, 815, 820, 825, and/or other hydraulic circuitry. The resulting net force ((B11×PW)−(B12×PW)+(B21×PL)−(B22×PH)) operates to move the piston 310 upward (relative to the orientation depicted in FIG. 21). Consequently, the pumping chamber 650 contracts and expels fluid into the exhaust conduit 550, the first working chamber 530 expands and draws in fluid from the wellbore 11, the second working chamber 535 contracts and expels fluid into the low-pressure chamber 350, and the second chamber 340 expands (thereby decreasing the pressure PH therein).

The intake and exhaust strokes may then be repeated a number of times until the sampled fluid from the formation 130 is considered representative, at which time the sampled fluid may be stored in the pumping chamber 650, perhaps sealed by a sealing mechanism (not shown), and retrieved to surface. The sampled formation fluid may also or alternatively be exhausted from the pumping chamber 650 into a sample chamber located elsewhere in the downhole tool 802 and/or associated apparatus, such as into one or more instances of the sample chambers 127 shown in FIG. 1 and/or the sample chambers 240 shown in FIG. 2. In such implementations, the downhole tool 802 and/or associated apparatus may further comprise valving and/or other hydraulic circuitry that may be piloted and/or otherwise operated to direct the sampled formation fluid from the pumping chamber 650 to the sample chamber/module. For example, the valves shown in FIG. 21 and/or other hydraulic circuitry may be piloted with another isolation valve system located between the probe and the sample chamber, or that is positioned differently in the toolstring, with a checking pressure that is sufficient to overcome the sample chamber friction (e.g., with the back pressure at PW or PH).

Figure 22:
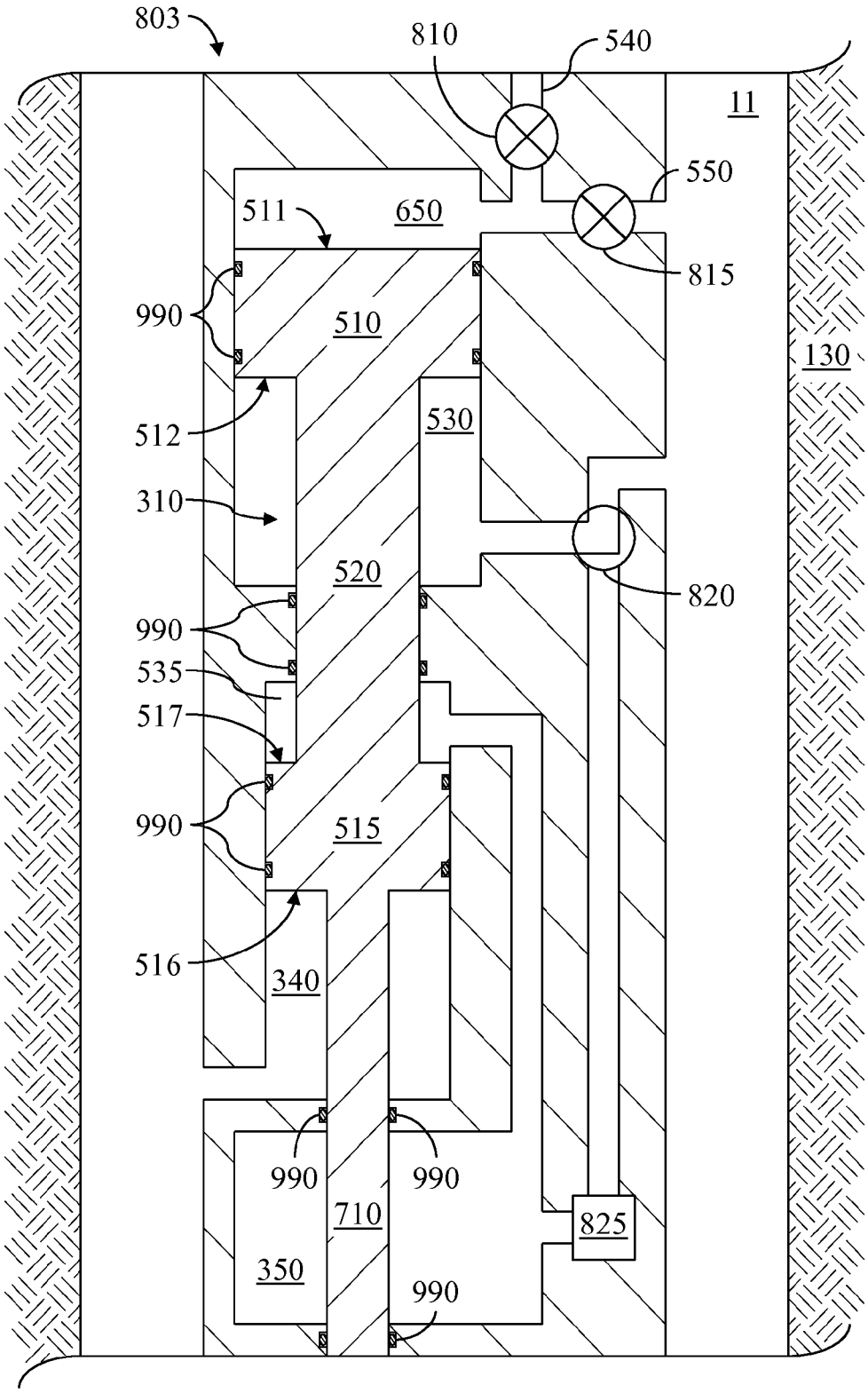
FIG. 22 is a schematic view of at least a portion of apparatus according to one or more aspects of the present disclosure.

FIG. 22 is a schematic view of a similar implementation of the downhole tool 800 shown in FIGS. 18 and 19, designated herein by reference numeral 803. The downhole tool 803 shown in FIG. 22 may have one or more aspects in common with, or be substantially similar to, one or more of the downhole tool 800 shown in FIGS. 18 and 19, the downhole tool 801 shown in FIG. 20, and/or the downhole tool 802 shown in FIG. 21, with the following possible exceptions.

The downhole tool 803 comprises a motion member 710 extending from the second piston head 515. The motion member 710 may be a discrete member coupled to the second piston head 515 by threads, welding, and/or other fastening means, or the motion member 710 may be integrally formed with the second piston head 515 and/or the rest of the piston 310. The motion member 710 may extend through the low-pressure chamber 350 and/or other components/features of the downhole tool 803. Operation of the downhole tool 803 is identical or substantially similar to operation of the downhole tool 800, 801, and/or 802 described above, among others within the scope of the present disclosure. However, the reciprocating motion of the piston 310 may be utilized for mechanical and/or other purposes by coupling and/or other engagement of the protruding end (not shown) of the motion member 710 with another component and/or feature of the downhole tool 803 and/or associated apparatus. In this manner, the reciprocating action of the piston 310 (and, thus, the protruding motion member 710) may be utilized for purposes other than, or in addition to, sampling fluid from the formation 130.

The motion member 710 may alternatively extend upward (relative to the orientation shown in FIG. 22) from the first piston head 510. In a similar implementation, the downhole tool 803 may comprise two instances of the motion member 710, including one extending upward from the first piston head 510, and another extending downward from the second piston head 515.

FIGS. 23-26 are schematic views of at least a portion of apparatus comprising a downhole tool 1000 according to one or more aspects of the present disclosure. The downhole tool 1000 may be utilized in the implementation shown in FIG. 1 and/or FIG. 2, among others within the scope of the present disclosure. For example, the downhole tool 1000 may be, or may be substantially similar to, the downhole tool 100 shown in FIG. 1, the downhole tool 200 shown in FIG. 2, and/or other components, modules, and/or tools coupled to, associated with, and/or otherwise shown in FIGS. 1 and/or 2. The downhole tool 1000 may also have one or more aspects in common with one or more of the downhole tool 300 shown in FIGS. 3 and 4, the downhole tool 301 shown in FIGS. 5 and 6, the downhole tool 302 shown in FIG. 7, the downhole tool 303 shown in FIG. 8, the downhole tool 304 shown in FIG. 9, the downhole tool 305 shown in FIG. 10, the downhole tool 500 shown in FIG. 11, the downhole tool 501 shown in FIG. 12, the downhole tool 502 shown in FIG. 13, the downhole tool 503 shown in FIG. 14, the downhole tool 600 shown in FIG. 15, the downhole tool 601 shown in FIG. 16, the downhole tool 700 shown in FIG. 17, the downhole tool 800 shown in FIGS. 18 and 19, the downhole tool 801 shown in FIG. 20, the downhole tool 802 shown in FIG. 21, and/or the downhole tool 803 shown in FIG. 22, including where indicated by like reference numbers.

The downhole tool 1000 comprises the piston 310 shown in FIGS. 18-21, including the first piston head 510, the second piston head 515, and the link or other member 520 extending between the first and second piston heads 510 and 515. The first surface 511 of the first piston head 510 has an area C11, and the second surface 512 of the first piston head 510 has an area C12. The first surface 516 of the second piston head 515 has an area C21, and the second surface 517 of the second piston head 515 has an area C22.

The first surface 511 of the first piston head 510 defines a moveable boundary that partially defines the pumping chamber 650, which may be further defined by other internal surfaces of the downhole tool 1000. The second surface 512 of the first piston head 510 defines a moveable boundary that partially defines a first working chamber 530, which may be further defined by the outer surface of the member 520 of the piston 310 and other internal surfaces of the downhole tool 1000. The second surface 517 of the second piston head 515 defines a moveable boundary that partially defines the second working chamber 535, which may be further defined by the outer surface of the member 520 of the piston 310 and other internal surfaces of the downhole tool 1000. The first surface 516 of the second piston head 515 defines a moveable boundary that partially defines a third working chamber 1030, which may be further defined by other internal surfaces of the downhole tool 1000.

The downhole tool 1000 further comprises one or more flowlines providing an intake conduit 540 for receiving formation fluid from the formation 130. For example, a portion of the downhole tool 1000 and/or associated apparatus not shown in FIGS. 23-26 may comprise one or more probes, packers, inlets, and/or other means for interfacing and providing fluid communication with the formation 130. Examples of such interfacing means may include the one or more instances of the probe assembly 116 shown in FIG. 1 and/or the fluid communication device 238 shown in FIG. 2, among other examples within the scope of the present disclosure.

The downhole tool 1000 further comprises one or more flowlines providing an exhaust conduit 550 for expelling formation fluid into the wellbore 11 and/or another portion of the downhole tool 1000. For example a portion of the downhole tool 1000 and/or associated apparatus not shown in FIGS. 23-26 may comprise one or more ports and/or other means for expelling fluid into the wellbore 11, as well as one or more sample bottles and/or other chambers that may be utilized to store a captured sample of formation fluid for retrieval at surface.

The pumping chamber 650 is in fluid communication with a selective one of the intake conduit 540 and an exhaust conduit 550. For example, a valve 810 and/or other hydraulic circuitry may selectively fluidly couple the pumping chamber 650 to the intake conduit 540, while another valve 815 and/or other hydraulic circuitry may selectively fluidly couple the pumping chamber 650 to the exhaust conduit 550. However, the valves 810 and 815 may instead collectively comprise a single valve, more than two valves, and/or other hydraulic circuitry. The valves 810 and 815 and/or the equivalent hydraulic circuitry may comprise check valves permitting fluid flow in a single direction, although piloted and/or other types of valves are also within the scope of the present disclosure.

The downhole tool 1000 also comprises valves 1060 and 1065. The valve 1060 is configurable between a first position (shown in FIGS. 23 and 25), fluidly coupling the first working chamber 530 with the low-pressure chamber 350, and a second position (shown in FIGS. 24 and 26), fluidly coupling the first working chamber 530 with the high-pressure chamber 340. The valve 1065 is configurable between a first position (shown in FIGS. 23 and 25), fluidly coupling the third working chamber 1030 with the high-pressure chamber 340, and a second position (shown in FIGS. 24 and 26), fluidly coupling the third working chamber 1030 with the low-pressure chamber 350. The valves 1060 and 1065 may be or comprise various numbers and/or configurations of valves and/or other hydraulic circuitry, and/or may include one or more two-position valves, three-position valves, check valves, piloted valves, and/or other types of valves and/or other hydraulic circuitry.

The downhole tool 1000 may also comprise one or more flowlines 1070 fluidly coupling the first working chamber 530 to a selective one of the high- and low-pressure chambers 340 and 350 via the valve 1060 and/or other hydraulic circuitry. Similarly, one or more flowlines 1075 may fluidly couple the third working chamber 1030 to a selective one of the high- and low-pressure chambers 340 and 350 via the valve 1065 and/or other hydraulic circuitry. One or more flowlines 1080 may also fluidly couple the second working chamber 535 to the low-pressure chamber 350. The downhole tool 1000 may comprise additional flowlines, including those shown but not numbered in FIGS. 23-26, among others.

The downhole tool 1000 may also comprise the piston 380 shown in FIGS. 7, 17, and 20. Thus, the high-pressure chamber 340 may have a moveable boundary defined by the first surface 382 of the piston 380. The second surface 384 of the piston 380 may be in fluid communication with the wellbore 11, such that fluid within the high-pressure chamber 340 substantially remains the same as the wellbore pressure.

One or more of the first working chamber 530, the second working chamber 535, the third working chamber 1030, the high-pressure chamber 340, and the low-pressure chamber 350 may comprise nitrogen, argon, air, hydraulic fluid (e.g., hydraulic oil), and/or another gaseous or liquid fluid, collectively referred to below as working fluid 1090. The first working chamber 530 may initially have an internal pressure that is substantially atmospheric and/or otherwise less than the initial (e.g., wellbore) pressure of the high-pressure chamber 340.

As with other implementations described above, the piston 310, the chambers 340, 350, 530, 535, 650, and 1030, and the associated hydraulic circuitry, may collectively form a pump that may be utilized for various pumping operations downhole. For example, the pump 121 shown in FIG. 1 and/or the pump 235 shown in FIG. 2 may be or comprise the apparatus shown in FIGS. 23-26, among other apparatus within the scope of the present disclosure.

For example, as with the example implementations described above, the piston 310 may be reciprocated by alternately exposing its surfaces to the high and low pressures of the high-pressure chamber 340 and the low-pressure chamber 350, respectively, via operation of the valves 1060 and 1065. The pressure within the high-pressure chamber 340 may substantially remain at or near hydrostatic pressure due to the piston 380 being in fluid communication with the wellbore 11. The pressure within the low-pressure chamber 350 may initially be at or near atmospheric pressure.

However, unlike the example implementations described above, the downhole tool 1000 comprises two "power" chambers, the first working chamber 530 and the third working chamber 1030, which may be utilized individually or together to impart a pumping motion to the piston 310. The pressure differential (e.g., overbalance+drawdown) that can be generated in the pumping chamber 650 with respect to the hydrostatic pressure of the wellbore 11 during an inlet stroke depends on the amount of the area of the piston 310 that is exposed to the low-pressure chamber 350. By sizing the piston heads 510 and 515 differently, three differential pressure ratios may be possible: the pressure applied to the second surface 512 of the first piston head 510 ("P1"), the pressure applied to the first surface 516 of the second piston head 515 ("P2"), and the combined application of these two pressures ("P1+P2"). For example, the difference between the two pressure differentials P1 and P2 may be at least partially attributable to the area C12 of the second surface 512 of the first piston head 510 being smaller than the area C21 of the first surface 516 of the second piston head 515.

Accordingly, a surface operator, surface controller, and/or controller of the downhole tool 1000 may utilize the smallest pressure differential that would be sufficient to extract fluid from the formation 130. The choice of which power chamber(s) to utilize may be made at any time during the job based on observation of pressures and flow rates. Such operation may reduce the risk of formation collapse and consequent plugging due to excessive differential pressure. Utilizing the smallest pressure differential that is sufficient to extract fluid from the formation 130 may also reduce the risk of capturing a non-representative sample due to phase changes induced by excessive differential pressure. Such operation may also reduce consumption of the on-board working fluid 1090, which may increase the total volume of formation fluid that can be pumped in a single trip downhole.

Figure 23:
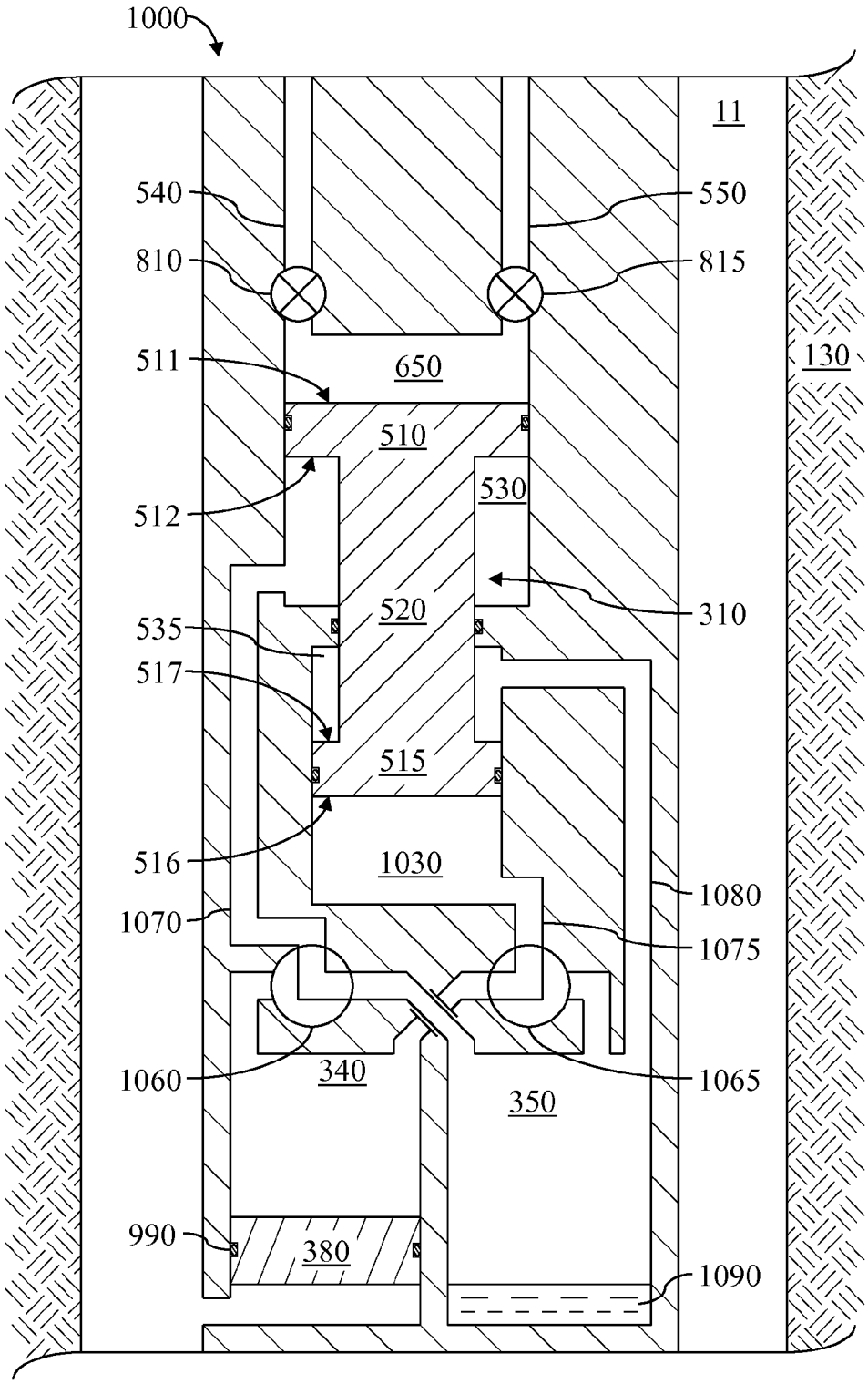
FIG. 23 is a schematic view of at least a portion of apparatus according to one or more aspects of the present disclosure.

FIG. 23 depicts an inlet stroke of the piston 310 utilizing "low power" corresponding to the smallest of the possible pressure differentials (P1). That is, the valves 1060 and 1065 are configured to fluidly connect the first working chamber 530 to the low-pressure chamber 350, and to fluidly connect the third working chamber 1030 to the high-pressure chamber 340. This low power mode may be the most economical mode in terms of consumption of the working fluid 1090, relative to the medium and high power modes described below. For example, the amount of working fluid 1090 displaced into the low-pressure chamber 350 is the least compared to the medium and high power modes. However, the suction differential generated in the low power mode may not be sufficient for some circumstances.

Figure 24:
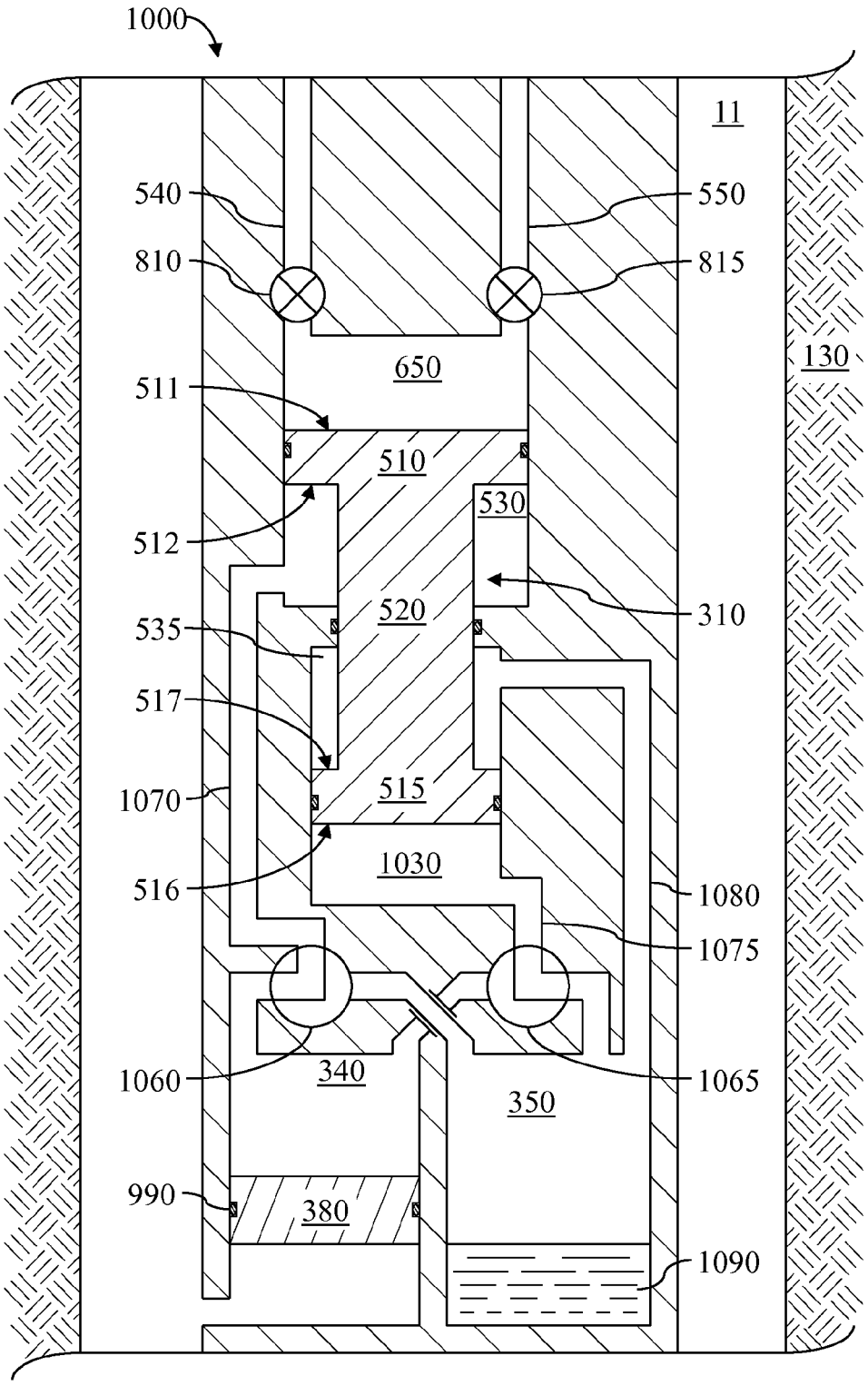
FIG. 24 is a schematic view of at least a portion of apparatus according to one or more aspects of the present disclosure.

FIG. 24 depicts an inlet stroke of the piston 310 utilizing "medium power" corresponding to the median of the possible pressure differentials (P2). That is, the valves 1060 and 1065 are configured to fluidly connect the first working chamber 530 to the high-pressure chamber 340, and to fluidly connect the third working chamber 1030 to the low-pressure chamber 350. Thus, the larger of the power chambers (the third working chamber 1030) may be utilized to create a moderate suction differential pressure. The medium power mode, however, displaces more working fluid 1090 into the low-pressure chamber 350 relative to the low power mode depicted in FIG. 23.

Figure 25:
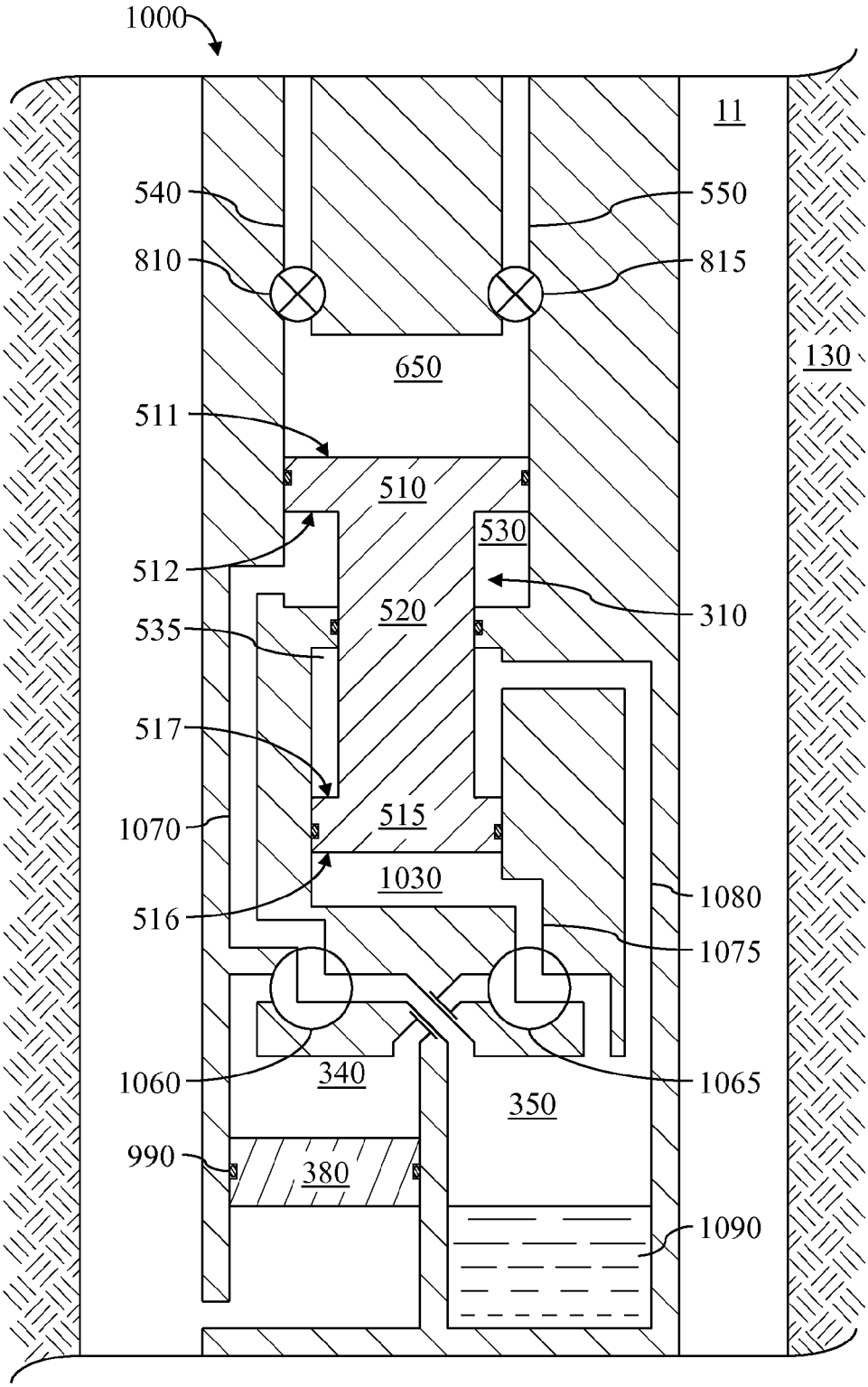
FIG. 25 is a schematic view of at least a portion of apparatus according to one or more aspects of the present disclosure.

FIG. 25 depicts an inlet stroke of the piston 310 utilizing "high power" corresponding to the largest of the possible pressure differentials (P1+P2). That is, the valves 1060 and 1065 are configured to fluidly connect the first working chamber 530 and the third working chamber 1030 to the low-pressure chamber 350. Thus, relative to the low and median power modes, the high power mode generates the most suction differential, but also displaces the most working fluid 1090 into the low-pressure chamber 350.

Figure 26:
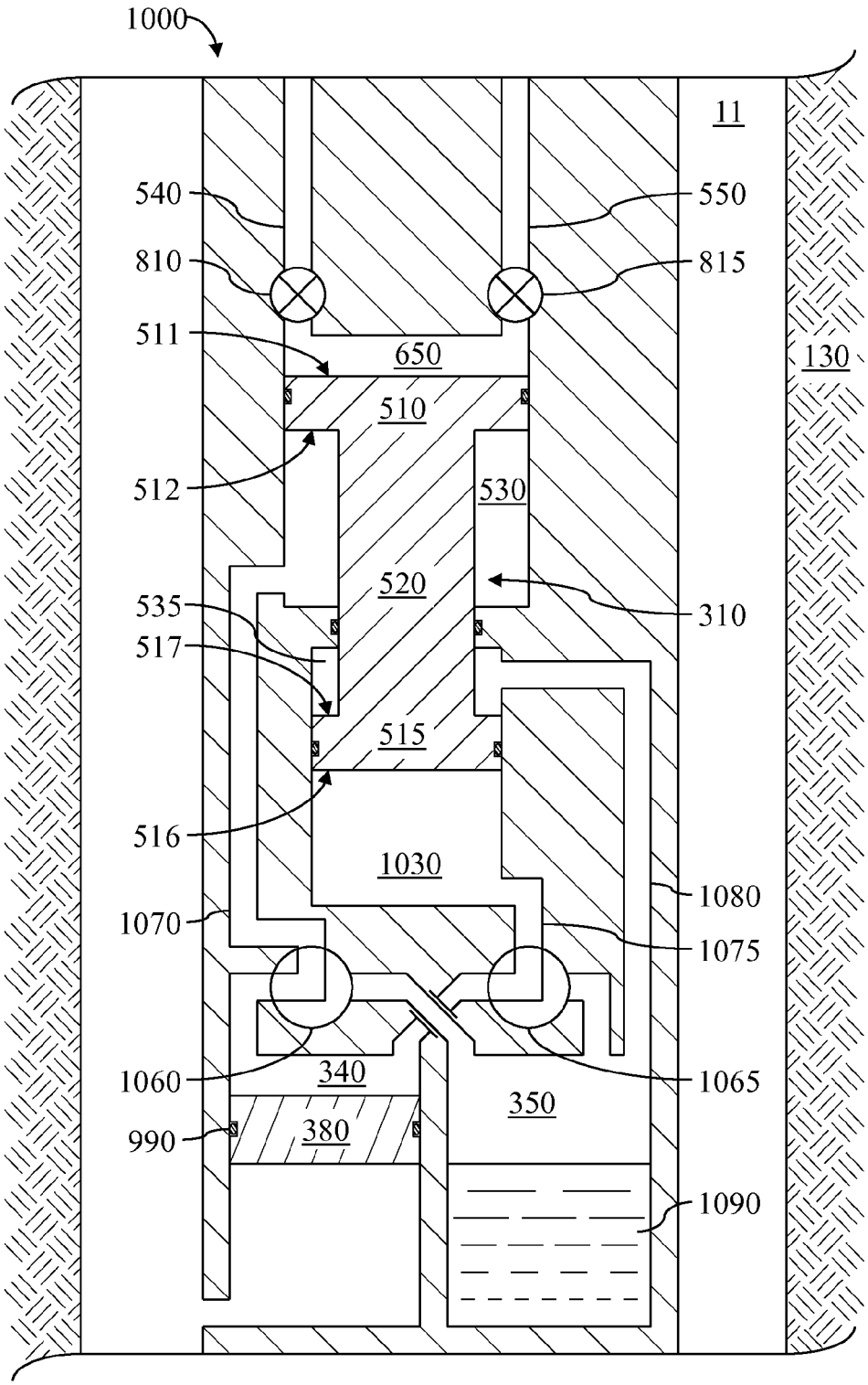
FIG. 26 is a schematic view of at least a portion of apparatus according to one or more aspects of the present disclosure.

In each of the power modes depicted in FIGS. 23-25, the suction stroke is followed by substantially the same exhaust stroke, as depicted in FIG. 26. That is, the valves 1060 and 1065 are configured to fluidly connect the first working chamber 530 and the third working chamber 1030 to the high-pressure chamber 340. Accordingly, the pressure in the second working chamber 535, which is in constant fluid communication with the low-pressure chamber 350, imparts the return movement of the piston 310.

With respect to the example implementation depicted in FIGS. 23-26, the maximum differential pressure ("PD") that can be created during intake or exhaust depends on the piston areas exposed in the working chambers 530, 535, and 1030, and can be expressed as a percentage of hydrostatic pressure ("PH"). For example, for an intake stroke in the low power mode, PD may be less than PH by an amount ranging between about 20% and about 40%, such as about 30%, although other values are also within the scope of the present disclosure. For an intake stroke in the medium power mode, PD may be less than PH by an amount ranging between about 35% and about 60%, such as about 47%, although other values are also within the scope of the present disclosure. For an intake stroke in the high power mode, PD may be less than PH by about 100%, because P1+P2 is 100%. For an exhaust stroke, PD may be greater than PH by an amount ranging between about 15% and 35%, such as about 24%, although other values are also within the scope of the present disclosure.

A person having ordinary skill in the art should also recognize that the example implementation depicted in FIGS. 23-26 (among others within the scope of the present disclosure) may not be limited to two "power" chambers, and that many more permutations may be possible with additional power chambers. For example, a stepped piston with four power chambers (via two surfaces facing uphole and two surfaces facing downhole in their respective chambers) can be dimensioned and/or otherwise configured to yield twelve different suction differentials and three different exhaust differentials. Such embodiments may provide finer granularity in the choice of a suction differential compatible with formation strength and sample quality, together with a further reduction in consumption of on-board working fluid.

A person having ordinary skill in the art will also readily recognize that, in the implementations explicitly described herein and others within the scope of the present disclosure, various isolation features, sealing members, and/or other means 990 may be utilized for isolation of various chambers (e.g., chambers 320, 330, 340, 350, 530, and 535). Such means 990 may be utilized to, for example, prevent inadvertent leakage as a first component (e.g., the piston 310) axially reciprocates relative to an adjacent second component within the downhole tool. Such means 990 may include, for example, O-rings, wipers, gaskets, and/or other seals within the scope of the present disclosure, and may be manufactured from one or more rubber, silicon, elastomer, copolymer, metal, and/or other materials. Examples of such means 990 are depicted in FIGS. 3-26 as being O-rings of substantially circular cross-section installed in respective glands, grooves, recesses, and/or other features of first and/or second adjacent components to form a face seal between the first and second components. However, a person having ordinary skill in the art will readily recognize how such means 990 may be mechanically integrated into the various apparatus described above in other manners also within the scope of the present disclosure.

In view of the entirety of the present disclosure, including the figures, a person having ordinary skill in the art will readily recognize that the present disclosure introduces an apparatus comprising: a downhole tool for conveyance within a wellbore extending into a subterranean formation, wherein the downhole tool comprises: a moveable member comprising: a first surface defining a moveable boundary of a first chamber; and a second surface defining a moveable boundary of a second chamber; and hydraulic circuitry selectively operable to establish reciprocating motion of the moveable member by exposing the first chamber to an alternating one of a first pressure and a second pressure that may be substantially less than the first pressure. The hydraulic circuitry may be operable to prevent exposure of the first chamber to the first and second pressures simultaneously.

The hydraulic circuitry may comprise a two-position valve. The two-position valve may be selectively operable between: a first position exposing the first chamber to the first pressure; and a second position exposing the first chamber to the second pressure. The two-position valve may be selectively operable between: a first position exposing the first chamber to the first pressure and preventing exposure of the first chamber to the second pressure; and a second position exposing the first chamber to the second pressure and preventing exposure of the first chamber to the first pressure.

The moveable member may comprise a piston having the opposing first and second surfaces. The moveable member may comprise a sealing member preventing fluid communication between the first and second chambers. The sealing member may comprise an O-ring.

The downhole tool may further comprise: a third chamber containing fluid at the first pressure; and a fourth chamber containing fluid at the second pressure. Exposing the first chamber to an alternating one of the first pressure and the second pressure may comprise exposing the first chamber to an alternating one of the third chamber and the fourth chamber. The hydraulic circuitry may be operable to: establish fluid communication between the second and fourth chambers when the first and third chambers are in fluid communication; and establish fluid communication between the second and third chambers when the first and fourth chambers are in fluid communication. The hydraulic circuitry may be operable to prevent the first chamber from being in simultaneous fluid communication with the third and fourth chambers. The hydraulic circuitry may comprise a valve, and fluid communication established between the second chamber and one of the third and fourth chambers may include fluid communication via one or more flowlines collectively extending between ones of the second chamber, the third chamber, the fourth chamber, and the valve. The fluid in the third and fourth chambers may substantially comprise hydraulic oil, nitrogen, and/or argon.

The second pressure may be substantially atmospheric pressure. The second pressure may be substantially less than atmospheric pressure.

The first pressure may be a hydrostatic pressure of fluid within the wellbore. The moveable member may be a first moveable member, and the downhole tool may further comprise a second moveable member having opposing first and second surfaces. The first surface of the second moveable member may define a moveable boundary of a third chamber containing fluid at the first pressure. The second surface of the second moveable member may be in fluid contact with the fluid in the wellbore.

The downhole tool may comprise a biasing member urging the moveable member in a direction substantially parallel to a longitudinal axis of the moveable member. The moveable member may be a piston. The piston may comprise a piston head having opposing first and second surfaces. The second surface of the piston head may be smaller in area than the first surface of the piston head. The downhole tool may further comprise a biasing member chamber having a moveable boundary defined by the second surface of the piston head. The biasing member may be contained within the biasing member chamber and exert a force on the second surface of the piston head. The biasing member may be contained within the biasing member chamber and exert a force on the end of the piston.

The moveable member may translate in a first direction in response to exposure of the first chamber to the first pressure, and may translate in a second direction in response to exposure of the first chamber to the second pressure. The first and second directions may be substantially opposites. Translation of the moveable member in the first direction may volumetrically increase the first chamber and volumetrically decrease the second chamber. Translation of the moveable member in the second direction may volumetrically increase the second chamber and volumetrically decrease the first chamber.

The downhole tool may be coupled to a conveyance operable to convey the downhole tool within the wellbore. The conveyance may comprise a wireline and/or a drill string. The downhole tool may further comprise a fluid communication device operable to establish fluid communication between the downhole tool and the subterranean formation.

The present disclosure also introduces a method comprising: conveying a downhole tool within a wellbore extending into a subterranean formation, wherein the downhole tool comprises a moveable member, a first chamber comprising fluid at a first pressure, and a second chamber comprising fluid at a second pressure that may be substantially less than the first pressure; and reciprocating the moveable member by selectively exposing the moveable member to an alternating one of the first and second pressures.

The moveable member may comprise opposing first and second surfaces, and selectively exposing the moveable member to an alternating one of the first and second chambers may comprise alternatingly: exposing the first surface to the first pressure while exposing the second surface to the second pressure; and exposing the first surface to the second pressure while exposing the second surface to the first pressure.

The moveable member may comprise opposing first and second surfaces, and selectively exposing the moveable member to an alternating one of the first and second chambers may comprise alternatingly: exposing the first surface to the first pressure, but not the second pressure, while exposing the second surface to the second pressure, but not the first pressure; and exposing the first surface to the second pressure, but not the first pressure, while exposing the second surface to the first pressure, but not the second pressure.

The second pressure may be substantially atmospheric pressure. The second pressure may be substantially less than atmospheric pressure.

The first pressure may be a hydrostatic pressure of fluid within the wellbore. The moveable member may be a first moveable member, and the downhole tool may further comprise a second moveable member having opposing first and second surfaces. The first surface of the second moveable member may define a moveable boundary of the first chamber, and the second surface of the second moveable member may be in fluid contact with fluid in the wellbore.

The moveable member may translate in a first direction in response to exposure to the first pressure, and may translate in a second direction in response to exposure to the second pressure. The first and second directions may be substantially opposites. The downhole tool may further comprise: a third chamber having a moving boundary defined by a first surface of the moveable member; and a fourth chamber having a moving boundary defined by a second surface of the moveable member. Translation of the moveable member in the first direction may volumetrically increase the third chamber and volumetrically decrease the fourth chamber. Translation of the moveable member in the second direction may volumetrically increase the fourth chamber and volumetrically decrease the third chamber.

Conveying the downhole tool within the wellbore may comprise conveying the downhole tool via at least one of a wireline and a drill string.

The hydraulic circuitry may comprise a two-position valve, and selectively exposing the moveable member to an alternating one of the first and second pressures may comprise selectively operating the two-position valve between: a first position exposing the moveable member to the first pressure; and a second position exposing the moveable member to the second pressure.

The hydraulic circuitry may comprise a two-position valve, and selectively exposing the moveable member to an alternating one of the first and second pressures may comprise selectively operating the two-position valve between: a first position exposing the moveable member to the first pressure and preventing exposure of the moveable member to the second pressure; and a second position exposing the moveable member to the second pressure and preventing exposure of the moveable member to the first pressure.

The present disclosure also introduces a method comprising: conveying a downhole tool within a wellbore extending into a subterranean formation, wherein the downhole tool comprises a high-pressure chamber, a low-pressure chamber, a first working chamber, and a second working chamber; and pumping fluid from the subterranean formation by operating the downhole tool to alternatingly: expose the first working chamber to the high-pressure chamber while exposing the second working chamber to the low-pressure chamber; and expose the first working chamber to the low-pressure chamber while exposing the second working chamber to the high-pressure chamber.

The downhole tool may further comprise an intake conduit and an exhaust conduit, and pumping fluid may comprise pumping fluid from the intake conduit to the exhaust conduit. The method may further comprise establishing fluid communication between the intake conduit and the subterranean formation prior to initiating the pumping. The downhole tool may further comprise a first pumping chamber and a second pumping chamber, and pumping fluid from the intake conduit to the exhaust conduit ay comprises: while exposing the first working chamber to the high-pressure chamber and exposing the second working chamber to the low-pressure chamber, drawing fluid from the intake conduit into the first pumping chamber while expelling fluid from the second pumping chamber into the exhaust conduit; and while exposing the first working chamber to the low-pressure chamber and exposing the second working chamber to the high-pressure chamber, drawing fluid from the intake conduit into the second pumping chamber while expelling fluid from the first pumping chamber into the exhaust conduit. The downhole tool may further comprise a moveable member comprising: a first piston head having a first surface and a second surface that may be substantially smaller than the first surface, wherein the first surface may define a moving boundary of the first working chamber, and wherein the second surface may define a moving boundary of the second pumping chamber; and a second piston head having a third surface and a fourth surface that may be substantially smaller than the third surface, wherein the third surface may define a moving boundary of the second working chamber, and wherein the fourth surface may define a moving boundary of the first pumping chamber. Exposing the first working chamber to the high-pressure chamber and exposing the second working chamber to the low-pressure chamber may translate the moveable member in a first direction, and translation of the moveable member in the first direction may draw fluid from the intake conduit into the first pumping chamber while expelling fluid from the second pumping chamber into the exhaust conduit. Exposing the first working chamber to the low-pressure chamber and exposing the second working chamber to the high-pressure chamber may translate the moveable member in a second direction substantially opposite the first direction, and translation of the moveable member in the second direction may expel fluid from the first pumping chamber into the exhaust conduit while drawing fluid from the intake conduit into the second pumping chamber.

The moveable member may further comprise a central member linking the first and second piston heads, and the central member may comprise a surface defining boundaries of the first and second pumping chambers.

The downhole tool may further comprise a moveable member comprising: a first piston head having a first surface and a second surface that may be substantially smaller than the first surface, wherein the first surface may define a moving boundary of the second pumping chamber, and wherein the second surface may define a moving boundary of the first working chamber; and a second piston head having a third surface and a fourth surface that may be substantially smaller than the third surface, wherein the third surface may define a moving boundary of the first pumping chamber, and wherein the fourth surface may define a moving boundary of the second working chamber. The moveable member may further comprise a central member linking the first and second piston heads, and the central member may comprise a surface defining boundaries of the first and second working chambers.

The downhole tool may further comprise a moveable member comprising: a first end having a first surface defining a moving boundary of the first pumping chamber; a second end having a second surface defining a moving boundary of the second pumping chamber; and a flange member extending radially outward from a central portion of the moveable member and having: a third surface defining a moving boundary of the first working chamber; and a fourth surface defining a moving boundary of the second working chamber. The moveable member may further comprise: a fifth surface extending at least partially between the first and third surfaces and defining a boundary of the first working chamber; and a sixth surface extending at least partially between the second and fourth surfaces and defining a boundary of the second working chamber.

The downhole tool may further comprise a moveable member comprising: a first end having a first surface defining a moving boundary of the second working chamber; a second end having a second surface defining a moving boundary of the first working chamber; and a flange member extending radially outward from a central portion of the moveable member and having: a third surface defining a moving boundary of the second pumping chamber; and a fourth surface defining a moving boundary of the first pumping chamber. The moveable member may further comprise: a fifth surface extending at least partially between the first and third surfaces and defining a boundary of the second pumping chamber; and a sixth surface extending at least partially between the second and fourth surfaces and defining a boundary of the first pumping chamber.

The present disclosure also introduces a method comprising: conveying a downhole tool within a wellbore extending into a subterranean formation, wherein the downhole tool comprises a high-pressure chamber, a low-pressure chamber, a working chamber, a pumping chamber, an intake conduit, and an exhaust conduit; and pumping subterranean formation fluid from the intake conduit to the exhaust conduit via the pumping chamber by operating the downhole tool to alternatingly: expose the pumping chamber to the intake conduit while exposing the working chamber to the low-pressure chamber; and expose the pumping chamber to the exhaust conduit while exposing the working chamber to the high-pressure chamber.

The method may further comprise establishing fluid communication between the intake conduit and the subterranean formation prior to initiating the pumping.

Exposing the pumping chamber to the intake conduit while exposing the working chamber to the low-pressure chamber may draw subterranean formation fluid from the intake conduit into the pumping chamber. Exposing the pumping chamber to the exhaust conduit while exposing the working chamber to the high-pressure chamber may expel fluid from the pumping chamber into the exhaust conduit.

The exhaust conduit may be in fluid communication with the wellbore.

The high-pressure chamber may be in fluid communication with the wellbore.

The working chamber may be a first working chamber, and the downhole tool may further comprise a second working chamber in substantially constant fluid communication with the low-pressure chamber. The downhole tool may further comprise a moveable member comprising: a first piston head having a first surface and a second surface that may be substantially smaller than the first surface, wherein the first surface may define a moving boundary of the pumping chamber, and wherein the second surface may define a moving boundary of the first working chamber; and a second piston head having a third surface and a fourth surface that may be substantially smaller than the third surface, wherein the third surface may define a moving boundary of the high-pressure chamber, and wherein the fourth surface may define a moving boundary of the second working chamber. The moveable member may further comprise a central member linking the first and second piston heads, and the central member may comprise a surface defining boundaries of the first and second working chambers.

The downhole tool may further comprise a floating piston having first and second opposing surfaces, wherein the first surface of the floating piston may define a moving boundary of the high-pressure chamber, and wherein the second surface of the floating piston may be in substantially constant fluid communication with the wellbore.

The downhole tool may further comprise a fill port in selective fluid communication with the high-pressure chamber, and the method may further comprise pressurizing the high-pressure chamber via injection of a fluid through the fill port.

The downhole tool may further comprise a moveable member and a biasing member. The moveable member may define moveable boundaries of the working chamber and the pumping chamber. The biasing member may urge movement of the moveable member to volumetrically enlarge the working chamber and volumetrically contract the pumping chamber. Exposing the working chamber to the low-pressure chamber may overcome the biasing member to reverse movement of the moveable member, thereby volumetrically contracting the working chamber and volumetrically enlarging the pumping chamber. The method may further comprise establishing fluid communication between the intake conduit and the subterranean formation prior to initiating the pumping. The moveable member may comprise a piston head having a first surface and a second surface that may be substantially smaller than the first surface, wherein the first surface may define a moving boundary of the pumping chamber, and wherein the second surface may be directly acted upon by the biasing member. An end of the moveable member opposite the piston head may define a moving boundary of the working chamber. The moveable member may comprise a piston head having a first surface and a second surface that may be substantially smaller than the first surface. The first surface of the moveable member may define a moving boundary of the pumping chamber. The second surface of the moveable member may define a moving boundary of the working chamber. An end of the moveable member opposite the piston head may be directly acted upon by the biasing member.

The present disclosure also introduces an apparatus comprising: a downhole tool for conveyance within a wellbore extending into a subterranean formation, wherein the downhole tool comprises: at least one working chamber; at least one pumping chamber; intake and exhaust conduits each in selective fluid communication with the at least one pumping chamber; and hydraulic circuitry operable to pump subterranean formation fluid from the intake conduit to the exhaust conduit via the at least one pumping chamber by alternatingly exposing the at least one working chamber to different first and second pressures.

The downhole tool may further comprise a moveable member having at least one surface defining a moveable boundary of the at least one working chamber. Alternatingly exposing the at least one working chamber to the first and second pressures may comprise alternatingly exposing the first and second pressures to the at least one surface of the moveable member. Alternatingly exposing the first and second pressures to the at least one surface of the moveable member may translate the moveable member in corresponding first and second directions that volumetrically change the at least one pumping chamber to alternatingly: draw subterranean formation fluid from the intake conduit into the at least one pumping chamber; and expel subterranean formation fluid from the at least one pumping chamber into the exhaust conduit.

The exhaust conduit may be in fluid communication with the wellbore.

The hydraulic circuitry may comprise a two-position valve. The two-position valve may be selectively operable between first and second positions exposing the at least one working chamber to the first and second pressures, respectively. The two-position valve may be selectively operable between first and second positions each exposing the at least one working chamber to an exclusive one of the first and second pressures, respectively.

The downhole tool may further comprise: a high-pressure chamber comprising fluid at the first pressure; and a low-pressure chamber comprising fluid at the second pressure, wherein the second pressure may be substantially less than the first pressure. Alternatingly exposing the at least one working chamber to the first and second pressures may comprise establishing fluid communication between the at least one working chamber and an alternating one of the high- and low-pressure chambers. The high-pressure chamber may be in fluid communication with the wellbore. The downhole tool may further comprise a floating piston having opposing first and second surfaces, wherein: the first surface may define a moveable boundary of the high-pressure chamber; and the second surface may be exposed to the wellbore. The downhole tool may further comprise a port operable for fluid communication with one of the high- and low-pressure chambers.

The downhole tool may further comprise a fluid communication device operable to establish fluid communication between the intake conduit and the subterranean formation.

The at least one working chamber may comprise first and second working chambers. The at least one pumping chamber may comprise first and second pumping chambers. The downhole tool may further comprise a moveable member having: a first surface defining a moveable boundary of the second working chamber; a second surface defining a moveable boundary of the first pumping chamber; a third surface defining a moveable boundary of the first working chamber; and a fourth surface defining a moveable boundary of the second pumping chamber. The second pressure may be substantially less than the first pressure. Alternatingly exposing the at least one working chamber to different first and second pressures may comprise alternatingly: exposing the first working chamber to the first pressure while exposing the second working chamber to the second pressure; and exposing the first working chamber to the second pressure while exposing the second working chamber to the first pressure. Exposing the first working chamber to the first pressure while exposing the second working chamber to the second pressure may move the moveable member in a first direction and simultaneously: draw subterranean formation fluid from the intake conduit into the first pumping chamber; and expel subterranean formation fluid from the second pumping chamber into the exhaust conduit. Exposing the first working chamber to the second pressure while exposing the second working chamber to the first pressure may move the moveable member in a second direction and simultaneously: draw subterranean formation fluid from the intake conduit into the second pumping chamber; and expel subterranean formation fluid from the first pumping chamber into the exhaust conduit.

The moveable member may comprise: a first piston head comprising the first surface and the second surface opposing the first surface; a second piston head comprising the third surface and the fourth surface opposing the third surface; and a member extending between the first and second piston heads and having at least one surface defining moveable boundaries of the first and second pumping chambers.

The at least one working chamber may comprise first and second working chambers, and the at least one pumping chamber may comprise first and second pumping chambers. The downhole tool may further comprise a moveable member having: a first surface defining a moveable boundary of the first pumping chamber; a second surface defining a moveable boundary of the first working chamber; a third surface defining a moveable boundary of the second pumping chamber; and a fourth surface defining a moveable boundary of the second working chamber. The second pressure may be substantially less than the first pressure. Alternatingly exposing the at least one working chamber to different first and second pressures may comprise alternatingly: exposing the first working chamber to the first pressure while exposing the second working chamber to the second pressure; and exposing the first working chamber to the second pressure while exposing the second working chamber to the first pressure. Exposing the first working chamber to the first pressure while exposing the second working chamber to the second pressure may move the moveable member in a first direction and simultaneously: draw subterranean formation fluid from the intake conduit into the second pumping chamber; and expel subterranean formation fluid from the first pumping chamber into the exhaust conduit. Exposing the first working chamber to the second pressure while exposing the second working chamber to the first pressure may move the moveable member in a second direction and simultaneously: draw subterranean formation fluid from the intake conduit into the first pumping chamber; and expel subterranean formation fluid from the second pumping chamber into the exhaust conduit. The moveable member may comprise: a first piston head comprising the first surface and the second surface opposing the first surface; a second piston head comprising the third surface and the fourth surface opposing the third surface; and a member extending between the first and second piston heads and having at least one surface defining moveable boundaries of the first and second working chambers.

The at least one working chamber may comprise first and second working chambers, and the at least one pumping chamber may comprise first and second pumping chambers. The downhole tool may further comprise a moveable member comprising: a first end comprising a moveable boundary of the first pumping chamber; a second end comprising a moveable boundary of the second pumping chamber; and a flange portion comprising: a first surface defining a moveable boundary of the first working chamber; and a second surface defining a moveable boundary of the second working chamber. The second pressure may be substantially less than the first pressure. Alternatingly exposing the at least one working chamber to different first and second pressures may comprise alternatingly: exposing the first working chamber to the first pressure while exposing the second working chamber to the second pressure; and exposing the first working chamber to the second pressure while exposing the second working chamber to the first pressure. Exposing the first working chamber to the first pressure while exposing the second working chamber to the second pressure may move the moveable member in a first direction and simultaneously: draw subterranean formation fluid from the intake conduit into the first pumping chamber; and expel subterranean formation fluid from the second pumping chamber into the exhaust conduit. Exposing the first working chamber to the second pressure while exposing the second working chamber to the first pressure may move the moveable member in a second direction and simultaneously: draw subterranean formation fluid from the intake conduit into the second pumping chamber; and expel subterranean formation fluid from the first pumping chamber into the exhaust conduit. The moveable member may comprise at least one surface defining moveable boundaries of the first and second working chambers.

The at least one working chamber may comprise first and second working chambers, and the at least one pumping chamber may comprise first and second pumping chambers. The downhole tool may further comprise a moveable member comprising: a first end comprising a moveable boundary of the first working chamber; a second end comprising a moveable boundary of the second working chamber; and a flange portion comprising: a first surface defining a moveable boundary of the first pumping chamber; and a second surface defining a moveable boundary of the second pumping chamber. The second pressure may be substantially less than the first pressure. Alternatingly exposing the at least one working chamber to different first and second pressures may comprise alternatingly: exposing the first working chamber to the first pressure while exposing the second working chamber to the second pressure; and exposing the first working chamber to the second pressure while exposing the second working chamber to the first pressure. Exposing the first working chamber to the first pressure while exposing the second working chamber to the second pressure may move the moveable member in a first direction and simultaneously: draw subterranean formation fluid from the intake conduit into the second pumping chamber; and expel subterranean formation fluid from the first pumping chamber into the exhaust conduit. Exposing the first working chamber to the second pressure while exposing the second working chamber to the first pressure may move the moveable member in a second direction and simultaneously: draw subterranean formation fluid from the intake conduit into the first pumping chamber; and expel subterranean formation fluid from the second pumping chamber into the exhaust conduit. The moveable member may comprise at least one surface defining moveable boundaries of the first and second pumping chambers.

The downhole tool may further comprise a moveable member and a biasing member. The moveable member may define moveable boundaries of the at least one working chamber and the at least one pumping chamber. The biasing member may urge movement of the moveable member to volumetrically enlarge the at least one working chamber and volumetrically contract the at least one pumping chamber. Exposing the at least one working chamber to the first pressure may urge movement of the moveable member to volumetrically enlarge the at least one working chamber and volumetrically contract the at least one pumping chamber. Exposing the at least one working chamber to the second pressure may urge reverse movement of the moveable member to volumetrically contract the at least one working chamber and volumetrically enlarge the at least one pumping chamber.

The moveable member may comprise a piston head having first and second surfaces, wherein the second surface may be substantially smaller than the first surface, the first surface may define a moveable boundary of the at least one pumping chamber, the second surface may be directly acted upon by the biasing member, and an end of the moveable member opposite the piston head may define a moveable boundary of the at least one working chamber.

The moveable member may comprise a piston head having first and second surfaces, wherein the second surface may be substantially smaller than the first surface, the first surface may define a moveable boundary of the at least one pumping chamber, the second surface may define a moveable boundary of the at least one working chamber, and an end of the moveable member opposite the piston head may be directly acted upon by the biasing member.

The downhole tool may comprise a moveable member defining moveable boundaries of the at least one working chamber and the at least one pumping chamber, and the at least one working chamber may comprise first and second working chambers. The moveable member may comprise a piston head having first and second surfaces, wherein the second surface may be substantially smaller than the first surface, the first surface may define a moveable boundary of the first working chamber, the second surface may define a moveable boundary of the second working chamber, and alternatingly exposing the at least one working chamber to the first and second pressures may comprise alternatingly: exposing the first working chamber to the first pressure while exposing the second working chamber to the second pressure; and exposing the first working chamber to the second pressure while exposing the second working chamber to the first pressure. An end of the moveable member may comprise a moveable boundary of the at least one pumping chamber. Exposing the first working chamber to the first pressure while exposing the second working chamber to the second pressure may urge movement of the moveable member to volumetrically enlarge the at least one pumping chamber, whereas exposing the first working chamber to the second pressure while exposing the second working chamber to the first pressure may urge reverse movement of the moveable member to volumetrically contract the at least one pumping chamber.

The at least one working chamber may comprises first and second working chambers, and the downhole tool may comprise a moveable member having: a first surface defining a moveable boundary of the at least one pumping chamber; a second surface defining a moveable boundary of the first working chamber; a third surface in fluid communication with the wellbore; and a fourth surface defining a moveable boundary of the second working chamber. The second pressure may be substantially less than the first pressure, and alternatingly exposing the at least one working chamber to different first and second pressures may comprise alternatingly: exposing the first working chamber to the first pressure while exposing the second working chamber to the second pressure; and exposing the first working chamber to the second pressure while exposing the second working chamber to the second pressure. Exposing the first working chamber to the first pressure may comprise exposing the first working chamber to the wellbore. The downhole tool may further comprise a low-pressure chamber, and exposing the first and second working chambers to the second pressure may comprise establishing fluid communication between the low-pressure chamber and the first and second working chambers. The moveable member may comprise: a first piston head comprising the first surface and the second surface opposing the first surface; a second piston head comprising the third surface and the fourth surface opposing the third surface; and a member extending between the first and second piston heads and having at least one surface defining moveable boundaries of the first and second working chambers.

The at least one working chamber may comprise first and second working chambers, and the downhole tool may further comprise a high-pressure chamber and a floating piston having opposing first and second sides. The first side of the floating piston may define a moveable boundary of the high-pressure chamber, and the second side of the floating piston may be exposed to the wellbore. The downhole tool may further comprise a moveable member having: a first surface defining a moveable boundary of the at least one pumping chamber; a second surface defining a moveable boundary of the first working chamber; a third surface defining a moveable boundary of the high-pressure chamber; and a fourth surface defining a moveable boundary of the second working chamber. The second pressure may be substantially less than the first pressure, and alternatingly exposing the at least one working chamber to different first and second pressures may comprise alternatingly: establishing fluid communication between the first working chamber and the high-pressure chamber while exposing the second working chamber to the second pressure; and establishing fluid communication between the first working chamber and the second pressure while exposing the second working chamber to the second pressure. The downhole tool may further comprise a low-pressure chamber, wherein establishing fluid communication between the first working chamber and the second pressure may comprise establishing fluid communication between the first working chamber and the low-pressure chamber, and exposing the second working chamber to the second pressure may comprise establishing fluid communication between the second working chamber and the low-pressure chamber. The downhole tool may further comprise an externally accessible port in selective fluid communication with the low-pressure chamber. The second working chamber may be in constant fluid communication with the low-pressure chamber. The moveable member may comprise: a first piston head comprising the first surface and the second surface opposing the first surface; a second piston head comprising the third surface and the fourth surface opposing the third surface; and a member extending between the first and second piston heads and having at least one surface defining moveable boundaries of the first and second working chambers.

The at least one working chamber may comprise first and second working chambers, and the downhole tool may further comprise a high-pressure chamber, an externally accessible port in selective fluid communication with the high-pressure chamber, and a moveable member having: a first surface defining a moveable boundary of the at least one pumping chamber; a second surface defining a moveable boundary of the first working chamber; a third surface defining a moveable boundary of the high-pressure chamber; and a fourth surface defining a moveable boundary of the second working chamber. The second pressure may be substantially less than the first pressure, and alternatingly exposing the at least one working chamber to different first and second pressures may comprise alternatingly: establishing fluid communication between the first working chamber and the wellbore while exposing the second working chamber to the second pressure; and establishing fluid communication between the first working chamber and the second pressure while exposing the second working chamber to the second pressure. The downhole tool may further comprise a low-pressure chamber, wherein exposing the second working chamber to the second pressure may comprise establishing fluid communication between the second working chamber and the low-pressure chamber, whereas establishing fluid communication between the first working chamber and the second pressure may comprise establishing fluid communication between the first working chamber and the low-pressure chamber. The moveable member may comprise: a first piston head comprising the first surface and the second surface opposing the first surface; a second piston head comprising the third surface and the fourth surface opposing the third surface; and a member extending between the first and second piston heads and having at least one surface defining moveable boundaries of the first and second working chambers.

The present disclosure also introduces an apparatus comprising: a downhole tool for conveyance within a wellbore extending into a subterranean formation, wherein the downhole tool comprises: a moveable member comprising: a first surface defining a moveable boundary of a first chamber; and a second surface defining a moveable boundary of a second chamber; a motion member driven by the moveable member and having at least a portion positioned outside the first and second chambers; and hydraulic circuitry operable to establish reciprocation of the motion member by alternatingly exposing the first chamber to different first and second pressures.

The downhole tool may further comprise: a third chamber comprising fluid at the first pressure; and a fourth chamber comprising fluid at the second pressure. Alternatingly exposing the first chamber to different first and second pressures may comprise establishing fluid communication between the first chamber and an alternating one of the third and fourth chambers.

The reciprocation may comprise linear motion in first and second opposite directions. The reciprocation may comprise rotational motion in first and second opposite directions.

The moveable member may further comprise: a first piston head having the first surface and a third surface that is substantially smaller than the first surface; and a second piston head having the second surface and a fourth surface that is substantially smaller than the second surface.

The hydraulic circuitry may be operable to establish reciprocation of the motion member by alternatingly: exposing the first chamber to the first pressure while exposing the second chamber to the second pressure; and exposing the first chamber to the second pressure while exposing the second chamber to the first pressure.

Alternatingly exposing the first chamber to the first and second pressures may translate the moveable member in corresponding first and second directions that may volumetrically change the first and second chambers.

The hydraulic circuitry may comprise a two-position valve. The two-position valve may be selectively operable between first and second positions each exposing the first chamber to a respective one of the first and second pressures. The two-position valve may be selectively operable between first and second positions each exposing the first chamber to an exclusive one of the first and second pressures, respectively.

The downhole tool may further comprise: a high-pressure chamber comprising fluid at the first pressure; and a low-pressure chamber comprising fluid at the second pressure, wherein the second pressure is substantially less than the first pressure. Alternatingly exposing the first chamber to the first and second pressures may comprise establishing fluid communication between the first chamber and an alternating one of the high- and low-pressure chambers. The high-pressure chamber may be in fluid communication with the wellbore. The downhole tool may further comprise a floating piston having opposing first and second surfaces, wherein: the first surface defines a moveable boundary of the high-pressure chamber; and the second surface is exposed to the wellbore. The downhole tool may further comprise a port operable for fluid communication with one of the high- and low-pressure chambers.

The downhole tool may further comprise a fluid communication device operable to establish fluid communication between the downhole tool and the subterranean formation.

The motion member may extend from the second surface of the moveable member to a location outside the second chamber.

The downhole tool may further comprise an elongated passageway, wherein the motion member may extend at least partially within the elongated passageway and comprise a first magnetic member, and the moveable member may further comprise a second magnetic member positioned relative to the first magnetic member such that reciprocation of the moveable member is imparted to the motion member via magnetic interaction between the first and second magnetic members.

The downhole tool may further comprise an elongated passageway, wherein the motion member may extend at least partially within the elongated passageway and comprise a first electromagnetic member, and the moveable member may further comprise a second electromagnetic member positioned relative to the first electromagnetic member such that reciprocation of the moveable member is imparted to the motion member via interaction between the first and second electromagnetic members.

The moveable member may further comprise a linear gear extending substantially parallel to a direction of the reciprocation, and the motion member may be a rotational geared member engaged with the linear gear such that linear reciprocation of the moveable member imparts rotational reciprocation to the motion member.

The present disclosure also introduces a method comprising: conveying a downhole tool within a wellbore extending into a subterranean formation, wherein the downhole tool comprises a first chamber, a second chamber, a moveable member, and a motion member, wherein: a first surface of the moveable member defines a moveable boundary of the first chamber; a second surface of the moveable member defines a moveable boundary of the second chamber; and at least a portion of the motion member is positioned outside the first and second chambers; and reciprocating the motion member by alternatingly exposing the first chamber to different first and second pressures.

The downhole tool may further comprise a third chamber comprising fluid at the first pressure and a fourth chamber comprising fluid at the second pressure, wherein reciprocating the motion member by alternatingly exposing the first chamber to different first and second pressures may comprise establishing fluid communication between the first chamber and an alternating one of the third and fourth chambers.

Reciprocating the motion member may comprise linearly reciprocating the motion member in first and second opposite directions. Reciprocating the motion member may comprise rotationally reciprocating the motion member in first and second opposite directions.

The moveable member may further comprise a first piston head, having the first surface and a third surface that may be substantially smaller than the first surface, and a second piston head, having the second surface and a fourth surface that may be substantially smaller than the second surface, and reciprocating the motion member by alternatingly exposing the first chamber to different first and second pressures may comprise alternatingly: exposing the first chamber to the first pressure while exposing the second chamber to the second pressure; and exposing the first chamber to the second pressure while exposing the second chamber to the first pressure.

Reciprocating the motion member may comprise operating a two-position valve. Operating the two-position valve may comprise transitioning the two-position valve between first and second positions each exposing the first chamber to a respective one of the first and second pressures. Operating the two-position valve may comprise transitioning the two-position valve between first and second positions each exposing the first chamber to an exclusive one of the first and second pressures, respectively.

The downhole tool may further comprise a high-pressure chamber comprising fluid at the first pressure, and a low-pressure chamber comprising fluid at the second pressure, wherein the second pressure is substantially less than the first pressure, and wherein reciprocating the motion member by alternatingly exposing the first chamber to different first and second pressures may comprise establishing fluid communication between the first chamber and an alternating one of the high- and low-pressure chambers. The high-pressure chamber may be in fluid communication with the wellbore. The downhole tool may further comprise a floating piston having opposing first and second surfaces, wherein the first surface may define a moveable boundary of the high-pressure chamber, and wherein the second surface may be exposed to the wellbore. The downhole tool may further comprise an externally accessible port operable for fluid communication with one of the high- and low-pressure chambers, and the method may further comprise adjusting pressure within one of the high- and low-pressure chambers via the externally accessible port.

The method may further comprise establishing fluid communication between the downhole tool and the subterranean formation via a fluid communication device of the downhole tool.

The present disclosure also introduces an apparatus comprising: a downhole tool for conveyance within a wellbore extending into a subterranean formation, wherein the downhole tool comprises: a moveable member comprising: a first surface defining a moveable boundary of a first chamber; and a second surface defining a moveable boundary of a second chamber; and hydraulic circuitry selectively operable to establish reciprocating motion of the moveable member by exposing the first chamber to an alternating one of a first pressure and a second pressure that is substantially less than the first pressure. The moveable member may comprise opposing first and second piston heads of different sizes. The first surface may be a first surface of the first piston head. The first chamber may be a first working chamber. The second surface may be a first surface of the second piston head. The second chamber may be a second working chamber. A second surface of the first piston head may define a moveable boundary of a sampling chamber in selective fluid communication with the subterranean formation. A second surface of the second piston head may define a moveable boundary of a third working chamber. Exposing the first chamber to the first pressure may comprise establishing fluid communication between the first chamber and a high-pressure chamber of the downhole tool. Exposing the first chamber to the second pressure may comprise establishing fluid communication between the first chamber and a low-pressure chamber of the downhole tool. The hydraulic circuitry may include: a first valve fluidly connecting the first working chamber to a selective one of the high- and low-pressure chambers; a second valve fluidly connecting the third working chamber to a selective one of the high- and low-pressure chambers; and at least one flowline fluidly connecting the second working chamber to the low-pressure chamber.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool for conveyance within a wellbore extending into a subterranean formation, wherein the downhole tool comprises:

a moveable member comprising:

a first surface defining a moveable boundary of a first chamber; and a second surface defining a moveable boundary of a second chamber; and hydraulic circuitry selectively operable to establish reciprocating motion of the moveable member by alternatively setting a first pressure and a second pressure in the first chamber wherein the second pressure is substantially less than the first pressure, the moveable member comprises opposing first and second piston heads of different size;

the first surface is a first surface of the first piston head;

the first chamber is a first working chamber;

the second surface is a first surface of the second piston head;

the second chamber is a second working chamber;

a second surface of the first piston head defines a moveable boundary of a sampling chamber in selective fluid communication with the subterranean formation distinct from the first and second working chambers;

a second surface of the second piston head defines a moveable boundary of a third working chamber distinct from the first and second working chambers and from the sampling chamber;

exposing the first chamber to the first pressure comprises establishing fluid communication between the first chamber and a high-pressure chamber of the downhole tool;

exposing the first chamber to the second pressure comprises establishing fluid communication between the first chamber and a low-pressure chamber of the downhole tool; and the hydraulic circuitry includes:

a first valve fluidly connecting the first working chamber to a selective one of the high- and low-pressure chambers;

a second valve fluidly connecting the third working chamber to a selective one of the high- and low-pressure chambers; and at least one flowline fluidly connecting the second working chamber to the low-pressure chamber.

2. The apparatus of claim 1 wherein the first pressure is a hydrostatic pressure of fluid within the wellbore.

3. The apparatus of claim 2 wherein:

the moveable member is a first moveable member;

the downhole tool further comprises a second moveable member having opposing first and second surfaces;

the first surface of the second moveable member defines a moveable boundary of the third chamber containing fluid at the first pressure; and the second surface of the second moveable member is in fluid contact with the fluid in the wellbore.

4. The apparatus of claim 1 wherein:

the moveable member translates in a first direction in response to exposure of the first chamber to the first pressure;

the moveable member translates in a second direction in response to exposure of the first chamber to the second pressure;

translation of the moveable member in the first direction volumetrically increases the first chamber and volumetrically decreases the second chamber; and translation of the moveable member in the second direction volumetrically increases the second chamber and volumetrically decreases the first chamber.

5. The apparatus of claim 1 wherein the hydraulic circuitry is operable to prevent exposure of the first chamber to the first and second pressures simultaneously.

6. The apparatus of claim 1 wherein the first valve is selectively operable between:

a first position exposing the first chamber to the first pressure; and a second position exposing the first chamber to the second pressure.

7. The apparatus of claim 1 wherein the first valve is selectively operable between:

a first position exposing the first chamber to the first pressure and preventing exposure of the first chamber to the second pressure; and a second position exposing the first chamber to the second pressure and preventing exposure of the first chamber to the first pressure.

8. The apparatus of claim 1 wherein the downhole tool further comprises a fluid communication device operable to establish fluid communication between the downhole tool and the subterranean formation.

9. A method, comprising:

conveying a downhole tool for conveyance within a wellbore extending into a subterranean formation, wherein the downhole tool is according to claim 1, wherein the method comprises:

reciprocating the moveable member by alternatively setting an a first pressure and a second pressure in the first chamber wherein the second pressure is substantially less than the first pressure and by setting one of the first and second pressure in the second chamber while setting the other of the first and second pressure in the first chamber, wherein exposing the first chamber to the first pressure comprises establishing fluid communication between the first chamber and a high-pressure chamber of the downhole tool; and exposing the first chamber to the second pressure comprises establishing fluid communication between the first chamber and a low-pressure chamber of the downhole tool.

10. The method of claim 9 wherein the first pressure is a hydrostatic pressure of fluid within the wellbore, and wherein the second pressure is no greater than substantially atmospheric pressure.

11. The method of claim 9 wherein:

the moveable member translates in a first direction in response to exposure to the first pressure;

the moveable member translates in a second direction in response to exposure to the second pressure; and the first and second directions are substantially opposites.

12. The method of claim 9 wherein conveying the downhole tool within the wellbore comprises conveying the downhole tool via at least one of a wireline and a drill string.

* * * * *